US007640998B2

(12) United States Patent
Howell, Jr.

(10) Patent No.: US 7,640,998 B2
(45) Date of Patent: Jan. 5, 2010

(54) EXCAVATION APPARATUS

(76) Inventor: Richard L. Howell, Jr., 5463 Robin Cir., Yorba Linda, CA (US) 92886

( * ) Notice: Subject to any disclaimer, the term of this patent is extended or adjusted under 35 U.S.C. 154(b) by 126 days.

(21) Appl. No.: 12/074,599

(22) Filed: Mar. 5, 2008

(65) Prior Publication Data

US 2008/0217037 A1 Sep. 11, 2008

Related U.S. Application Data

(60) Provisional application No. 60/905,201, filed on Mar. 6, 2007.

(51) Int. Cl.
*E21B 7/02* (2006.01)

(52) U.S. Cl. ..... 173/184; 173/28; 405/259.1; 405/259.3

(58) Field of Classification Search ..... 173/184, 173/28; 405/259.1, 259.3
See application file for complete search history.

(56) References Cited

U.S. PATENT DOCUMENTS

| | | | | |
|---|---|---|---|---|
| 1,971,922 A | | 8/1934 | Smith | |
| 3,022,839 A | | 2/1962 | Troche | |
| 3,426,857 A | | 2/1969 | Bland | |
| 3,598,188 A | | 8/1971 | Foster | |
| 3,736,993 A | | 6/1973 | West | |
| 3,753,468 A | | 8/1973 | Casagrande | |
| 3,768,578 A | | 10/1973 | Russell, Jr. | |
| 3,774,697 A | | 11/1973 | Brown | |
| 3,809,344 A | * | 5/1974 | Kolderup et al. | 173/185 |
| 3,867,989 A | * | 2/1975 | Hisey et al. | 173/147 |
| 4,020,909 A | | 5/1977 | Airaudo | |
| 4,035,969 A | | 7/1977 | Casagrande | |

(Continued)

*Primary Examiner*—Brian D Nash
(74) *Attorney, Agent, or Firm*—F. Eugene Logan

(57) ABSTRACT

An excavation apparatus having a mast, a sled slidably mounted thereon, a sled driving system for downcrowding and upcrowding the sled along the mast, and non-rotatable but extendable kelly sections that prevent slippage of the sled on the mast. An outer kelly section is attached to the sled, and an inner kelly section is extendable therefrom and retractable therein. A bushing maintains slidable alignment of the kelly sections on the mast. The inner kelly section is automatically powered into and out of the outer kelly section a distance proportional to the distance that the sled is downcrowded or upcrowded along the mast while preventing slippage. A rotary motor, attached to the sled, rotates a telescopic shaft housed within the kelly sections. A transmission secured to the lower end of the inner kelly section increases downhole torque. A boom connector downcrowds and upcrowds the mast for additional drilling depth capability.

23 Claims, 34 Drawing Sheets

U.S. PATENT DOCUMENTS 4,099,579 A * 7/1978 Stormon ..... 173/4
4,124,081 A * 11/1978 Deike ..... 173/28
4,137,974 A 2/1979 Decker
4,258,796 A * 3/1981 Horning et al. ..... 175/52
4,371,041 A * 2/1983 Becker et al. ..... 173/28
4,627,499 A 12/1986 Magee et al.
4,703,811 A * 11/1987 Lam ..... 173/28
4,877,091 A 10/1989 Howell, Jr.
4,938,296 A 7/1990 Brazell, II
5,029,655 A 7/1991 Ebeling
5,273,124 A 12/1993 Lloyd et al.
5,592,993 A 1/1997 Parrish, II et al.
5,697,457 A 12/1997 Back
5,746,277 A 5/1998 Howell, Jr.
5,778,987 A * 7/1998 Baiden et al. ..... 173/19
5,884,712 A 3/1999 Hakkinen
5,944,452 A * 8/1999 Reinert, Sr. ..... 405/232
6,305,480 B1 * 10/2001 Franklin ..... 173/27
6,715,564 B2 4/2004 Buckland
6,725,946 B2 4/2004 Howell, Jr.
6,860,337 B1 * 3/2005 Orr et al. ..... 173/28
2003/0037940 A1 * 2/2003 Howell, Jr. ..... 173/184
2006/0042811 A1 * 3/2006 Hagemeyer ..... 173/1
2006/0278419 A1 * 12/2006 Hinshaw et al. ..... 173/184

* cited by examiner

FIG. 15
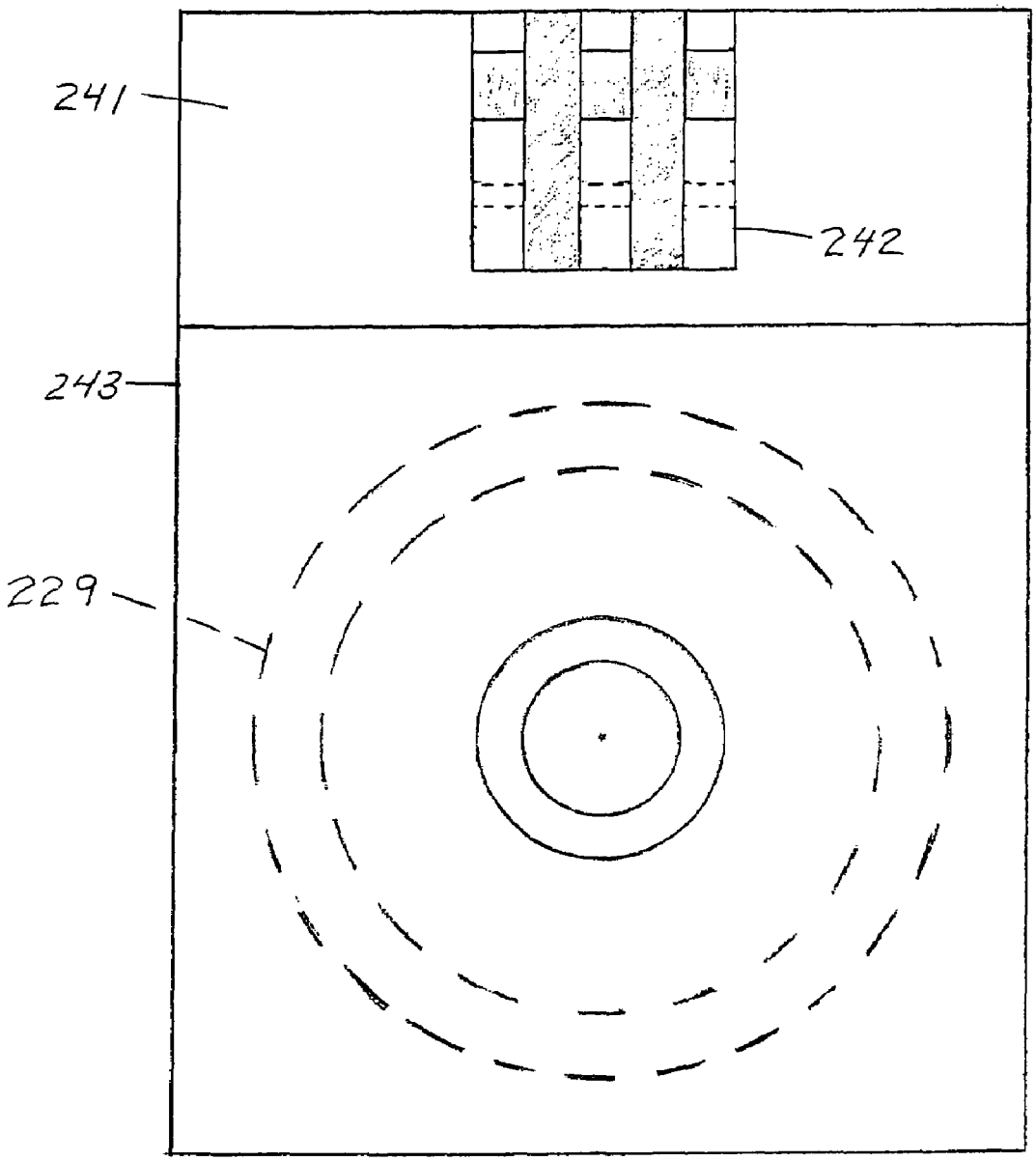
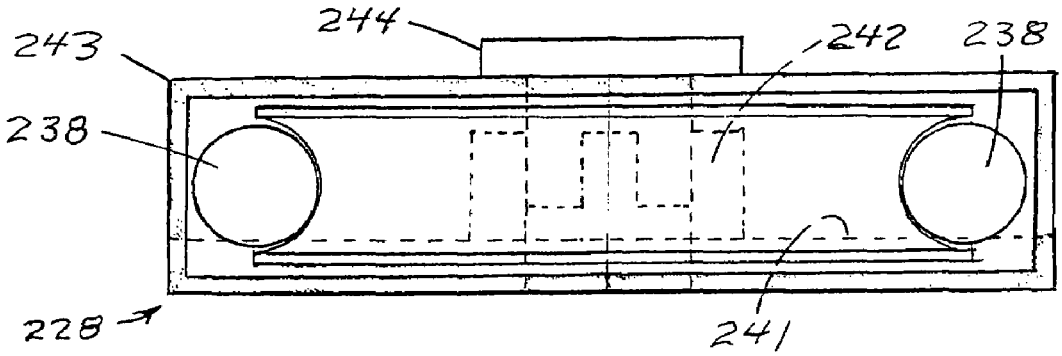
FIG. 16

EXCAVATION APPARATUS

CROSS-REFERENCE TO RELATED APPLICATIONS

This application claims the benefit of U.S. Provisional Application Ser. No. 60/905,201, filed Mar. 6, 2007 and entitled "EXCAVATION APPARATUS."

BACKGROUND OF THE INVENTION

Non-rotating kelly sections are shown in a drilling device in U.S. Pat. No. 1,971,922. The weight of the device, which does not have a power downcrowding mechanism, forces the auger into the ground.

U.S. Pat. No. 3,426,857 shows a drilling device with a single kelly bar supported from the end of a boom of a track type vehicle. The single kelly bar slides through a housing of a rotatable guide which rotates the kelly bar. The rotatable guide is supported frame attached to the lower portion of the boom. No means of downcrowding is provided. Another rig with telescoping kelly sections is shown in U.S. Pat. No. 3,753,468. The outer kelly section slides axially within a guidance sleeve supported at its top end by the free end of the boom and at its bottom end by a hydraulic cylinder attached to the track type vehicle. Telescopic sections and control are also described in U.S. Pat. No. 4,035,969.

U.S. Pat. No. 4,137,974 shows telescoping kelly sections driven by a rotary table. The housing of the rotary table is mounted at the lower end of relatively tall derrick. The kelly sections when retracted are surrounded by the derrick structure. Downcrowding is achieved by a mechanism which includes a drum having two cables wound in opposite senses thereon. The drum is hydraulically driven. A pulley system is mounted on the top of the derrick and another pulley system is mounted on the top of the outer kelly section. The pulley systems and the derrick would make it difficult to interchange the kelly sections since free access to the top of the kelly sections is not possible in such a rig.

U.S. Pat. No. 4,627,499 shows a drilling device supported on the end of a boom of a track type vehicle. The drilling device is of the drill mast type with a single kelly bar which slides through a housing of a final drive unit. The axis of the mast and kelly bar appear to be the same. Because the mast is directly over the kelly bar a relatively high overhead or ceiling is required for drilling vertical holes.

A more useful downcrowdable augering apparatus having kelly sections is disclosed in U.S. Pat. No. 4,877,091. The apparatus of U.S. Pat. No. 4,877,091 is very useful in sites having low overhead or ceiling. In U.S. Pat. No. 4,877,091 the kelly rotating means is bolted directly to the outer kelly section and as a consequence the outer kelly section is not permitted to slide through the kelly rotating means. Since the top of the kelly assembly is closed changing and/or replacing the kelly sections is more difficult than if the top of the outer kelly section were open.

Another useful downcrowdable augering apparatus having kelly sections is disclosed in U.S. Pat. No. 5,746,277 which is concerned with making such apparatus and rigs readily adaptable to mounting on a wide variety of vehicles ranging from light truck beds a to large track type vehicles including caterpillar type machines. The invention facilitates maintenance and changing of kelly assemblies by its unobstructed access to the top of the kelly assembly. For example the top of the kelly assembly is free of rotary drive mechanisms and pulleys associated therewith. U.S. Pat. Nos. 4,877,091 and 5,746,277 are hereby incorporated herein by reference.

U.S. Pat. No. 6,725,946 discloses an excavation apparatus which can be adapted to a variety of vehicles including smaller excavating machines such as backhoes and small trucks. The excavation apparatus can be quickly and easily connected and disconnected to vehicles by a one or two persons with a minimum of tools thereby allowing such vehicles to be converted as needed. For example, the smaller rear bucket on backhoes can quickly removed and the excavation apparatus installed in place of the rear bucket in about twenty minutes including the required hydraulic lines. The excavation apparatus of U.S. Pat. No. 6,725,946 does not require a winch for letting out and retracting the cable. Nor does it require a reel for storing the retracted cable.

Patent Application Pub. No. 2003/0051888 discloses a hydraulic drilling rig having a leader on a side that has means for downcrowding on a boom. The boom is telescopic but the leader is not. An auger motor, which is mounted on the opposite side of the leader from the boom, powers a drill string. The auger motor is fixed to the leader and does not move relative to the leader. The rig does not have telescopic shaft means but rather a drill string that can be lengthened by adding drill string sections. There is no lower bearing for the drill string.

U.S. Pat. No. 6,105,684 for a roof bolter or roof bolt installation apparatus for use in mines discloses reelless extension apparatus that can also be used for drilling holes or coring purposes without installation of roof bolts. The invention supports a mine roof while holes are drilled in the roof and roof bolts are set. A drilling unit is slidably mounted on rods. The drilling unit includes a hydraulic motor that can be fitted to a drill rod, a roof bolt or a nut.

U.S. Pat. No. 5,884,712 discloses a rock-drilling machine. FIG. 1 schematically illustrates a telescope feed beam having an outer portion and an inner telescopic portion. A feed cylinder with a piston is connected to the outer portion. A cylinder is connected to a feed roller. Around the feed roller is a feed wire or chain that displaces the rock-drilling machine along the feed beam. The telescopic second portion of the feed beam is connected to an end of a rod of an extension cylinder. The other end of the extension cylinder is connected to the outer portion of the feed beam. A drill rod is attached to the rock-drilling machine. A distal end of the drill rod is supported by the inner telescopic portion of the feed beam.

U.S. Pat. No. 5,697,457 discloses a derrick for a drilling rig having a mast pivotally mounted on a truck bed. The mast contains a guide tube slidably contained within the mast. A drill driving top head is attached near the bottom portion of guide tube through an elongated slot in the wall of the mast. The top of a long drill pipe is attached to drill driving top head. A bit is attached to the bottom of the long drill pipe. A bottom portion of the long drill pipe is guided in a bearing table. The guide tube is hydraulically driven up and down the mast by a multistage ram having an upper ring-mounted head and a pin, which drives a top plate of the guide tube.

U.S. Pat. No. 5,592,993 discloses a rig mounted on the distal end of a boom of a backhoe. A travel block with an attached auger motor is attached to a square inner body that is driven down a square outside body by chains. One end of each of the chains is attached to the base of square outside body and the other end of each chain is attached to the travel block. The travel block is raised two feet for every foot of extension of a piston rod. An upper end of an extender rod is connected to the auger motor and a lower end to an auger. The lower end of the extender rod is guided by a stabilizer. The extender rod is not telescopic.

U.S. Pat. No. 5,431,234 discloses a ground-drilling device used for assembly of drill strings for drilling into the earth.

The device can be configured in six different arrangements on a track. Since many of the features of the six embodiments are the same, the comments below concern the first embodiment.

The main components of the ground-drilling device are:

an elongated mount having a first linear track;

a mount head on the fore distal end of the elongated mount for receiving, assembling and disassembling drill pipe sections;

a main carriage guided by the first linear track, the main carriage having a second linear track;

a hydraulic piston-cylinder unit for driving the main carriage;

a forward subcarriage and a rear subcarriage, both of which are guided by the second linear track, the forward subcarriage carries a first drilling unit for rotating an outer drill pipe, the rear subcarriage carries a second drilling unit for rotating and striking an inner drill pipe that extends within the outer drill pipe, the rear subcarriage is clamped to the second track; and a second hydraulic piston-cylinder unit 44 for driving the forward subcarriage.

U.S. Pat. No. 5,273,124 discloses an earth drilling apparatus mounted on a vehicle for drilling holes for utility poles. The vehicle has a rotatable boom that is attached to the drilling apparatus. The apparatus has an elongated guide means which is attached to the boom with a bar through a bore in ear members. A drill head is attached to a plate means that is slidably attached to a guide means. Mounted on the guide means is a rotary motor with a rotatable shaft to which a drill pipe is attached with a rock bit. A percussion tool can be attached between the rotatable shaft and the rock bit. The apparatus has means for advancing and retracting the drill head along the guide means that comprises a hydraulic motor that drives an upper rotatable sprocket, which drives a chain, and a lower rotatable sprocket. One end of the chain is attached in a first direction to the plate means at a tab. The other end of the chain is also attached to plate means in a similar manner as the first end but in an opposite direction.

U.S. Pat. No. 5,213,169 for exploration-sampling drilling system for obtaining multiple samples of subterranean mineral deposits over a grid pattern for evaluation. The drilling rig is designed for any kind of geological formation. Holes in the range of 4 to 7 inches in diameter to depths up to a few thousand feet can be drilled. The drilling rig has a drill string comprising a drill head adapter, intermediate pipe sections, a first section of drill string assembly, and a lower adapter.

U.S. Pat. No. 4,020,909 discloses an earth drilling apparatus having an extendable mast and a rotation head for driving a drill string for drilling deep holes to great depths. The apparatus has an extensible mast having at least two parts namely a ramp or lower fixed part, and a slide or upper movable part. The fixed part comprises two lower posts welded to a drilling table with an aperture for centering a drill string or drill. The upper movable part comprises two upper beams that slide along the lower posts. Raising and lowering of the upper portion of the mast is by means of two double action jacks or cylinders located in the interior of the lower posts. A rotation head is slidably mounted on the two upper beams. Means is provided for synchronizing the movements of raising and lowering the upper portion of the mast with the raising and lowering of the rotation head. Although the mast is extendable it is not telescopic.

U.S. Pat. No. 3,768,578 discloses a drilling apparatus having a telescopic shaft that can be fitted with an auger. Hydraulic pressure applied at a first port retracts three telescopic square sections of the apparatus. The three telescopic square sections are referred to as a shaft. Hydraulic pressure applied at a second port extends the several telescopic square sections of the apparatus. A motor powers a rotary which rotates the outermost telescopic square section. The length of the stroke is approximately equal to the length of the outermost telescopic square section minus the length of a shuttle-barrel. An auger is attached to the lower end of the innermost telescopic square section. All three sections of the telescopic sections rotate.

U.S. Pat. No. 3,613,804 discloses a drilling apparatus with two chucks, namely an axial movable chuck and a stationary chuck. The stationary chuck grips a drill string when supplied with pressure, and the stationary chuck grips the drill string when relieved of pressure fluid. During inserting or withdrawing of the drill string, the supply conduits of the chucks are connected to either the supply conduits of the feed motor so that, automatically, the chucks operate concordantly with the feed motor. The drill pipe is not telescopic.

U.S. Pat. No. 2,410,959 discloses a rig for drilling holes up to about 30 feet. The rig has a drill head for rotating a square spindle that is slidably contained in a slotted tube having a longitudinal slot. A yoke stabilizes the top of the square spindle and rotatably holds it. The yoke extends through the longitudinal slot in the tube and is connected to a means for raising the square spindle and an auger with its load of dirt from an excavated hole. A spindle raising means comprises the yoke that is secured to an endless chain running between several sprockets including a feed sprocket. A hoisting hydraulic cylinder, which is supported by the slotted tube, has a piston that is connected to a rack bar. As the piston and the rack bar are raised, they rotate a pinon and a sprocket, which in turn drives the endless chain, which raises the yoke. Neither the square spindle nor the slotted tube are telescopic.

U.S. Publication or Pat. Nos. 2003/0051888, U.S. Pat. Nos. 6,105,684, 5,884,712, 5,697,457, 5,592,993, 5,431,234, 5,273,124, 5,213,169, 4,020,909, 3,768,578, 3,613,804 and 2,410,959 do not disclose the combination of a telescopic auger shaft means with a non-rotating telescoping outer and inner kelly sections wherein the rotating auger shaft means is surrounded by the non-rotating telescoping outer and inner kelly sections.

U.S. Pat. No. 5,029,655 discloses a drilling machine having a reducing transmission for use underground. The drilling machine has a hydraulic motor and an electric motor that power the transmission. The transmission comprises a first and second planetary stages that provide "slow running" and "fast running" of a drilling rod that is connected to an output chuck of the transmission. The motors and transmission do not go downhole.

U.S. Pat. No. 4,938,296 discloses a hydraulically powered drilling rig for mounting on a vehicle such as a flat bed truck. The rig has a mast assembly that can be raised vertically to an on-hole position. The mast assembly is square in cross section and contains a feed hydraulic cylinder assembly with a piston rod. The lower end of the piston rod is bolted to a cradle that is fixed to a mast link. The upper end of the hydraulic cylinder assembly is fixed to the mast assembly. The hydraulic cylinder assembly drives the mast assembly slidably along the mast link.

A rotary assembly is mounted inside the lower end of the mast assembly. The mast assembly comprises a variable displacement motor that is fixed to a spacer plate in the lower end of the mast assembly. Connected to the variable displacement motor is a two speed gear box that is connected to a planetary gear that is connected to a spindle adapter that is connected to a spindle.

The variable displacement motor, the gear box, the planetary shift and the spindle adapter are mechanically linked, however, the structure is not further described. The rotary assembly turns the drill rods.

When the mast assembly reaches its lowermost position during drilling, it is raised, and another section of drill rod is added.

U.S. Pat. No. 4,938,296 does not disclose a telescopic shaft between the variable displacement motor and the two speed gear box and the planetary gear.

U.S. Pat. No. 3,832,914 discloses a gear train connecting an input shaft to an output shaft. The gear trains comprises two unidirectional driving clutches whereby reversing the rotation of the input shaft will cause the output shaft to turn at a different speed but at the same direction. The torque to output shaft is also changed. A motor drives the input shaft. It would appear that if the gear box is to travel downhole the motor also would have to travel downhole and thus the power lines to the motor hydraulic would also have to go downhole.

U.S. Pat. No. 3,774,697 discloses a transmission comprising planetary gears used with a well drilling derrick. The transmission rotates the upper end of the drill string. The output shaft of the motor is connected to the input shaft of the transmission and the output shaft transmission is connected to the drill string. The motor and transmission do not go downhole.

U.S. Pat. No. 3,598,188 discloses a speed increasing transmissions and a speed decreasing transmissions for use in a derrick. The derrick contains a rotary table or "rotary". The transmissions are secured in and rotated by the rotary. The kelly slides axially through the transmissions. Both of the transmissions have epicyclic gearing that involve first and second stage planet gears that differ only in the arrangement of the gearing.

In the case of the speed decreasing transmission, the housing of the transmission is rotated by the rotary. The housing has a downwardly extending portion that serves as a sun gear between the a anchor ring gear and first stage planet gears. The pins of the first stage planetary gears are journaled at their lower ends by an outwardly extending portion of a second stage sun gear. Between the second stage sun gear and the anchor ring gear are the second stage planet gears. The pins of the second stage planetary gears are journaled at their lower ends by an outwardly extending portion of a sleeve member. The sleeve member rotates at a slower speed and rotates a bushing member which rotates the kelly. The rotary and speed increasing and speed decreasing transmissions do not travel downhole. U.S. Pat. No. 3,598,188 hereby is incorporated herein by reference in its entirety for its disclosure of planetary gears mechanisms.

U.S. Pat. No. 3,426,857 discloses a boring rig with a jib and frame that carries a guide having a rotatable drive mechanism powered by four hydraulic motors. A kelly bar passes through and is rotated by the guide. The guide can not travel downhole.

U.S. Pat. No. 3,022,839 discloses a planetary gear transmission secured from the lower end of an arm 18 deployed from a boom or derrick. The transmission comprises a hydraulic powered rotary motor unit secured to an upper portion and a downwardly extending output shaft. The speed of the output shaft can be shifted manually with a transmission handle or lever. Kelly bar usage is not disclosed. Travel of the transmission downhole may not be possible with this rig. External hydraulic hoses to and from the transmission are required.

SUMMARY OF THE INVENTION

The present invention is directed to an excavation apparatus that can be used on sloping and flat terrains without the use of leveling devices or jacks for excavating holes, and is especially useful for excavating holes in the range of one to four feet in diameter to a depth ranging from 4 to 30 feet. Such excavated holes frequently are used in the preparation of foundation sites for electric farms; foundation sites for poles for transformers, lights, signals, receiving and transmitting apparatuses, and relay cells; and foundation sites for footings for transmission line towers, and other tower structures.

The excavation apparatus can be mounted on a tractor, preferably a crawler tractor, with a boom.

The excavation apparatus comprises a mast with an axial cavity that can be oriented at compound angles relative to the boom of tractor. The mast can be easily downcrowded relative to the boom or boom connector with hydraulic cylinder actuators.

The excavation apparatus further comprises an extendable kelly section system having at least two kelly sections, namely an outer kelly section and an inner kelly section both of which have an axial cavity and are non-rotating. The outer kelly section of the kelly section system is attached to a sled that is slidably attached to the mast. The outer kelly section is offset a small distance from the mast. In preferred embodiment, the axes of the outer and inner kelly section coincide and are parallel to the axis of the mast.

The sled and extendable kelly section system are downcrowded relative to the mast by a sled driving means. The sled driving means comprises a hydraulically powered rotary motor, which is mounted at the top of the mast, that drives a flexible connection system attached to the sled.

A kelly extension system extends and retracts the inner kelly section relative to the outer kelly section such that the distance and direction that the inner kelly section moves relative to the outer kelly section is equal to and in the same direction that the sled moves relative to the mast. Thus, the movement of the inner kelly section is dictated by the movement of the sled.

The kelly extension system comprises sheaves rotatably mounted inside and near each end of the outer kelly section and upcrowd cables and downcrowd cables. One end of each upcrowd and downcrowd cable is anchored to the outside and near the upper end of the inner kelly section. The other end of each upcrowd cable is anchored to a lower end of the mast or an attachment thereto. The other end of each upcrowd cable is anchored to an upper end of the mast or an attachment thereto.

Another or second hydraulically powered rotary motor mounted on the sled drives a telescopic shaft means to which a rotary excavation tool is attached. The telescopic shaft means comprises an upper kelly bar shaft attached to the shaft of the second rotary motor, and a lower kelly bar shaft that is slidably connected to the upper kelly bar shaft. The lower kelly bar shaft is rotatably supported by a bushing attached to the lower end of the non-rotating inner kelly section.

Since the inner kelly section is non-rotating, other devices can be connected to the lower end of the telescopic shaft means and the rotary excavation tool then connected to such other device. An example of such other device is a torque converter unit or transmission for increasing the torque applied to the excavation tool. The torque converter unit if used would replace the lower bushing assembly between the inner kelly section and the telescopic shaft. The torque converter unit or transmission sacrifices RPM for an increase in torque. Therefore, on embodiment of this invention further comprises a means for increasing the torque attached to the lower end of the telescopic shaft.

In one embodiment the torque converter is a one speed transmission that can increase the torque applied to the output shaft of the transmission by up to about three times that of the torque applied to the input shaft of the transmission.

In another embodiment the torque converter is a two speed transmission that when drilling or excavating can also increase the transmission output torque up to about three times that of the transmission input shaft torque. However, when the kelly sections are fully retracted the transmission is automatically shifted into direct drive thereby increasing the transmission output shaft speed or RPM so that it equals that of the transmission input shaft speed or RPM, and thereby decreasing the time required to discharge soil from the auger.

In this invention slippage between the outer kelly section and the inner kelly section is prevented by the kelly section extension system of this invention.

In this invention slippage of outer and inner kelly sections relative to the mast is also prevented by the kelly section extension system of this invention in combination with the sled driving means of this invention.

One improvement of the kelly section extension system of this invention is that it does not require a reel for the collection and storage of cable or chain to downcrowd or upcrowd the inner kelly section relative to the outer kelly section, or to downcrowd or upcrowd the sled and outer kelly section relative to the mast.

A rotary motor mounted on the sled, a telescopic shaft means connected to the rotary motor and inside the non-rotating kelly extension system for connecting to a rotary tool, wherein the rotary motor does not at any time go down the excavated hole.

BRIEF DESCRIPTION OF THE FIGURES

FIG. 15 is an enlarged front view of the traveling sheave assembly of FIG. 9.

FIG. 16 is a bottom view of the traveling sheave assembly of FIG. 15.

DESCRIPTION OF THE PREFERRED EMBODIMENTS

Overview

The terms "downcrowd" and "upcrowd" are used in the excavation industry and herein and mean a "powered downward force" and a "powered upward force". Usually the power is hydraulic and is applied by hydraulic cylinder actuators or hydraulic rotary motors.

Figure 5:
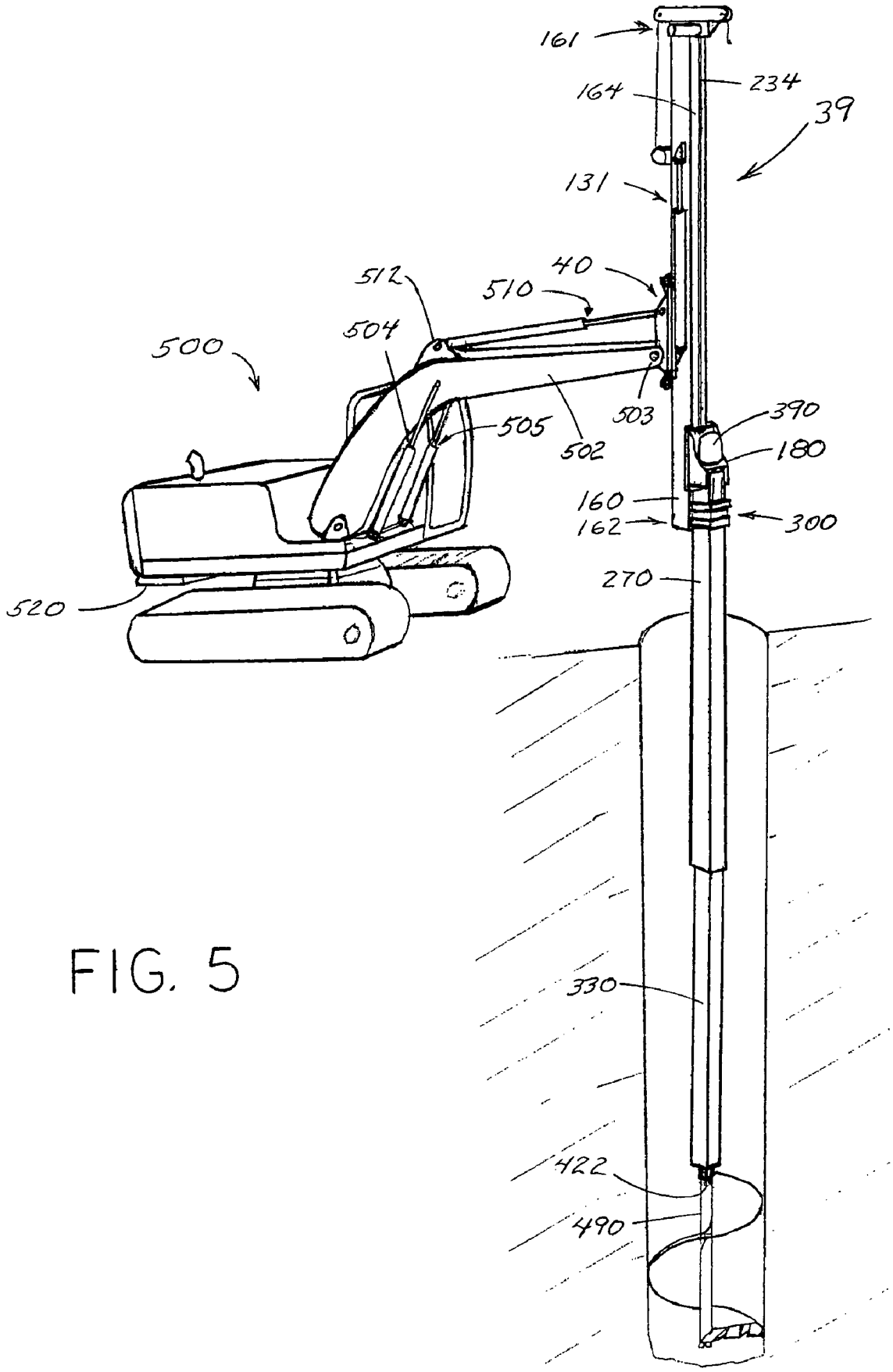
FIG. 5 is the excavation apparatus of FIG. 1 on a tractor with a partly downcrowded mast and fully downcrowded kelly bars at an excavation site.

Unless otherwise specified or indicated, the terms "upper" and "lower" as used in reference to the various components described herein are with reference to the mast being in the vertical position as shown in FIG. 5. Unless otherwise specified or indicated, the terms "fore" and "aft" or "front" and "rear" refer to the orientation of the excavation apparatus when attached to a tractor as shown in FIG. 5.

Unless otherwise specified or indicated, the expressions such as "first end" and "second end", etc. will have the same meaning as "upper end" and "lower end", respectively.

Unless otherwise specified or indicated, the structural components described herein are made of metal, preferably steel, and the metal components are joined by welding or with fasteners, usually nuts and bolts.

Unless otherwise specified or indicated, the mast, the kelly sections and kelly bar shafts are tubular with a square cross section and square internal cavity.

The term "kelly section" as used herein means an extendable but non-rotatable member, whereas the term "kelly bar shaft" as used herein means an extendable and rotatable member.

FIGS. 1, 2, 3 and 4 illustrate one embodiment of this invention of an excavation apparatus comprising a boom connector 40, a mast 160, hydraulic cylinder actuators 130 and 131, a sled 180, an outer kelly section 270 and an inner kelly section 330. Hydraulic cylinder actuators 130 and 131 are identical but on opposite sides of mast 160. Actuators 130 and 131 move mast 160 relative to boom connector 40.

A sled driving means, not seen in FIGS. 1 to 4, moves sled 180 relative to mast 160. A kelly section extension system, not seen in FIGS. 1 to 4, move the outer and inner kelly sections such that for every inch sled 180 moves in either direction relative to mast 160, outer kelly section 330 moves two inches relative to mast 160 in the same direction. Slippage of outer and outer kelly sections relative to mast 160 is prevented by the sled driving means of this invention.

A rotary motor 390 rotates telescopic shaft means 420 and any excavation tool attached thereto, e.g. tool 490.

Figure 1:
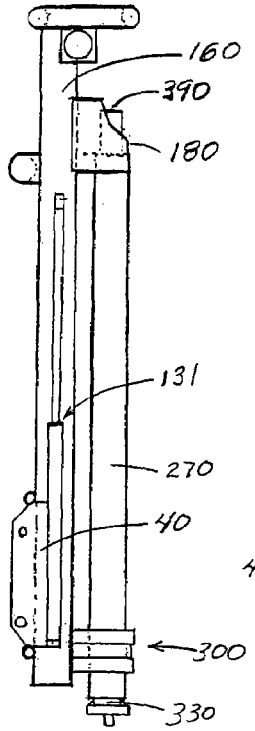
FIG. 1 is an elevational view of an excavation apparatus of this invention with a fully upcrowded mast and kelly bars relative to its boom connector.

In FIG. 1 both mast 160 and sled 180 are fully upcrowded.

Figure 2:
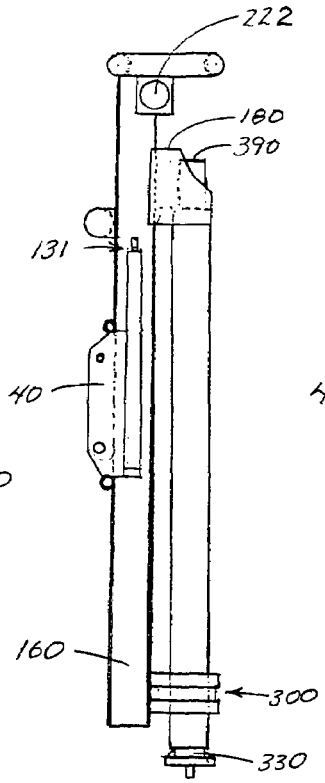
FIG. 2 is an elevational view of the excavation apparatus of FIG. 1 with a fully downcrowded mast and upcrowded kelly bars.

In FIG. 2 mast 160 is fully downcrowded and sled 180 is fully upcrowded.

Figure 3:
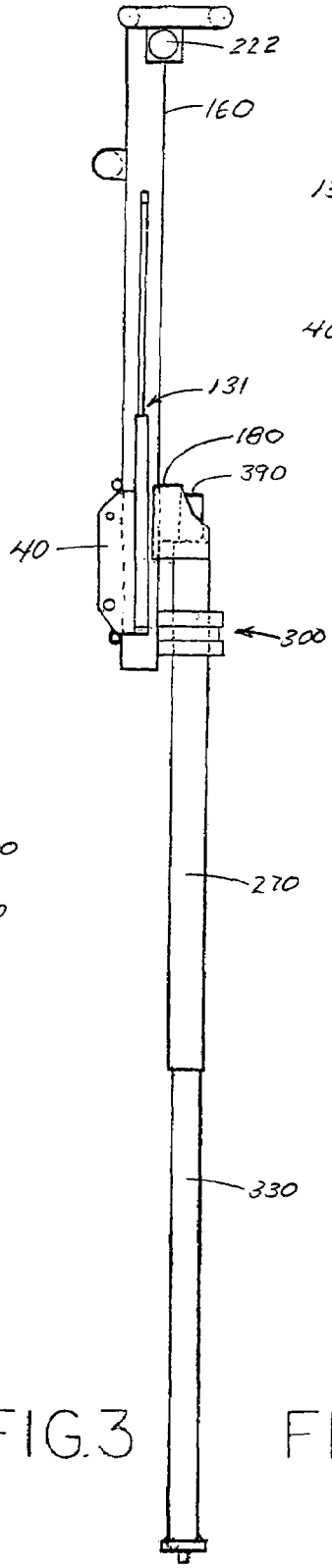
FIG. 3 is an elevational view of the excavation apparatus of FIG. 1 with a upcrowded mast and fully downcrowded kelly bars.

In FIG. 3 mast 160 is fully upcrowded and sled 180 is fully downcrowded.

Figure 4:
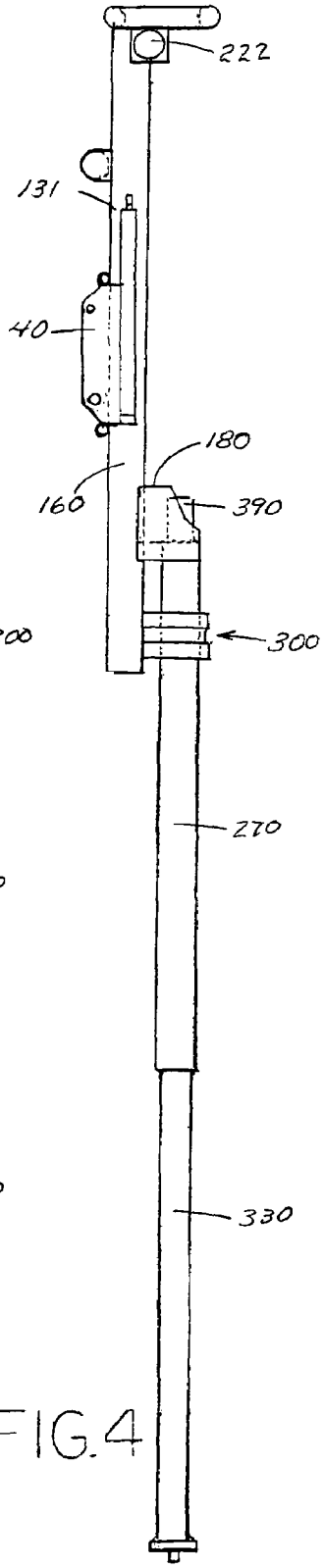
FIG. 4 is an elevational view of the excavation apparatus of FIG. 1 with a fully downcrowded mast and kelly bars.

In FIG. 4 both mast 160 and sled 180 are fully downcrowded.

FIGS. 5, 6, 7A, 7B, 8A and 8B illustrate a preferred embodiment of an excavation apparatus 39 of this invention when attached to a tractor 500.

In this embodiment of this invention excavation apparatus 39 comprises

Figure 31:
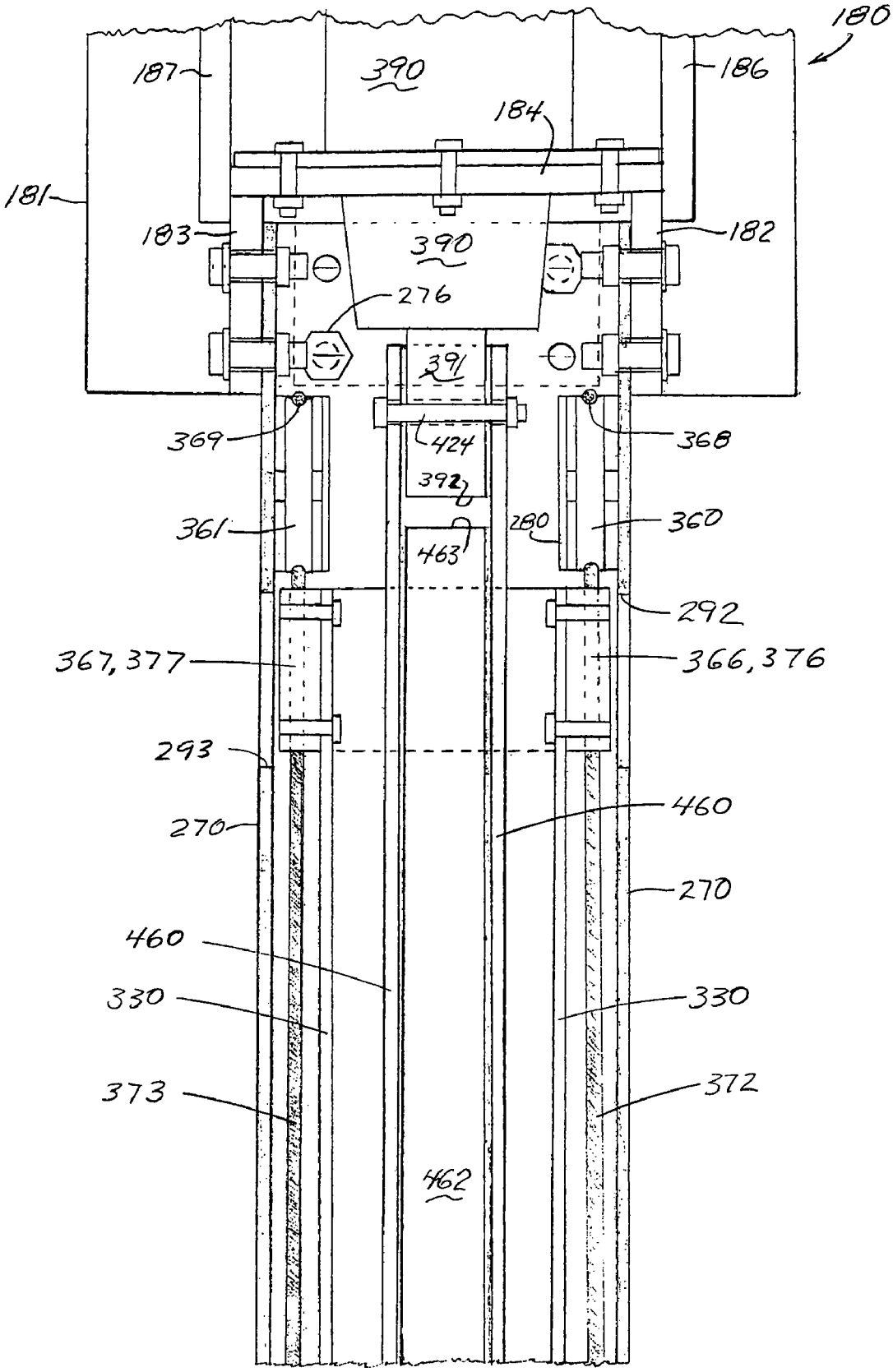
FIG. 31 is an enlarged -detailed view, in cross section, looking in the aft direction similar to FIG. 27 but with a second embodiment of a telescopic shaft means of this invention.
Figure 32:
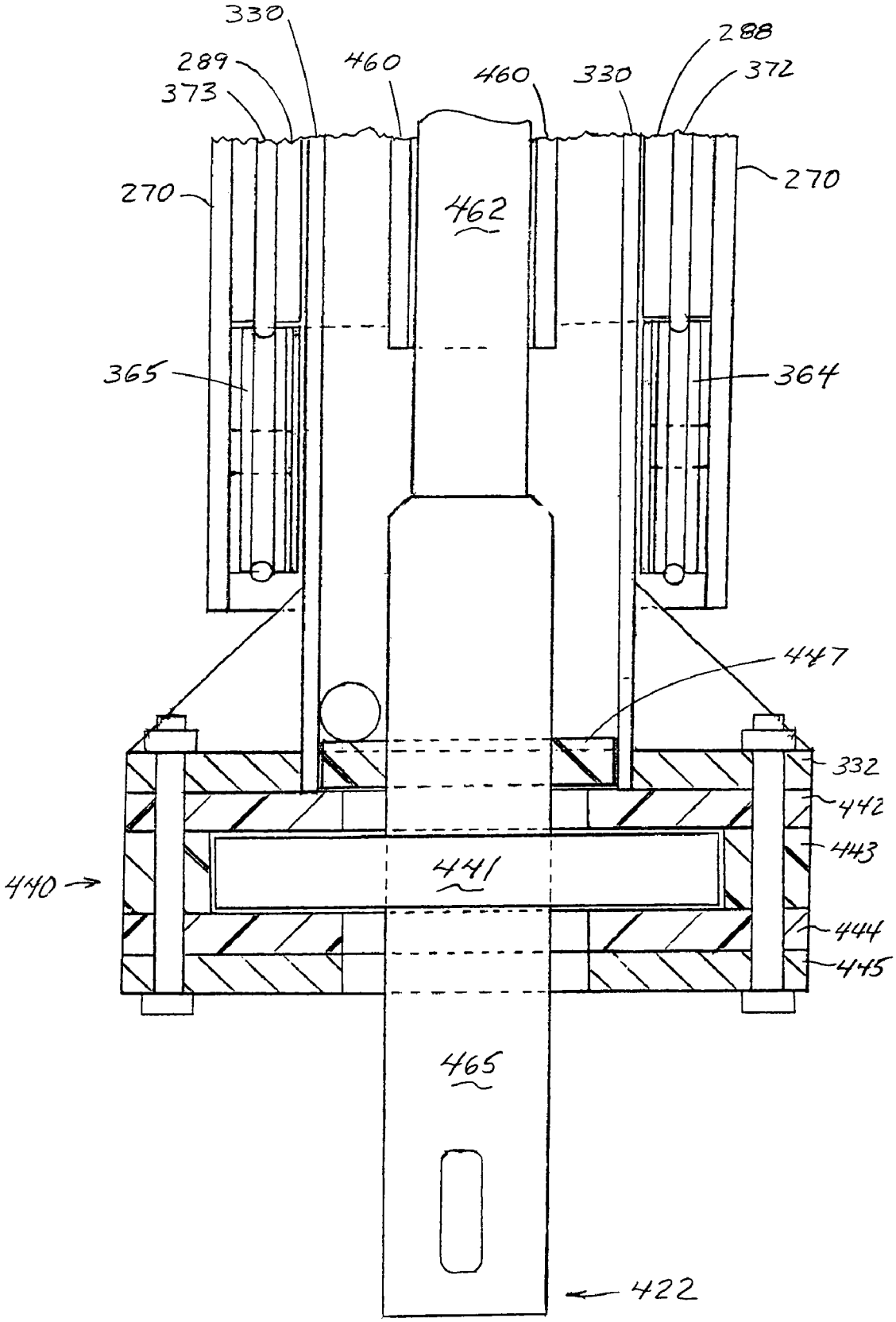
FIG. 32 is an enlarged detailed view, in cross section, looking in the aft direction similar to FIG. 30 but with the second embodiment of the shaft bearing assembly of FIG. 31.

- a boom connector 40 supported by, and pivotally mounted on, a boom 502 at a distal end 503 thereof,
- a mast 160 supported by boom connector 40,
- a sled 180 slidably mounted on mast 160,
- an outer kelly section 270 secured at first end 271 thereof to sled 180 in a non-rotational relationship therewith,
- bushing assembly means 300, supported by mast 160 proximate a second end 162 thereof, for maintaining outer kelly section 270 in a slidable relationship with bushing assembly means 300,
- an inner kelly section 330 extendable from and retractable into outer kelly section 270 in a non-rotational relationship therewith,
- rotary motor 390 mounted on sled 180, and
- telescopic shaft means 420 having a first end 421 connected to the shaft 391 of rotary motor 390 and a second end 422 for connecting to an excavation tool 490; see FIGS. 31 and 32.

Depending on the weight of excavation apparatus 39 a tractor counter weight 520 may be required; see FIG. 5.

In this embodiment, mast 160 is slidably mounted on boom connector 40. A pair of synchronized hydraulic cylinder actuators 130 and 131 downcrowds and upcrowds mast 160 relative to boom connector 40. Actuator 130 is identical to actuator 131 but is mounted on the opposite side of boom connector 40 and mast 160.

Figure 7A:
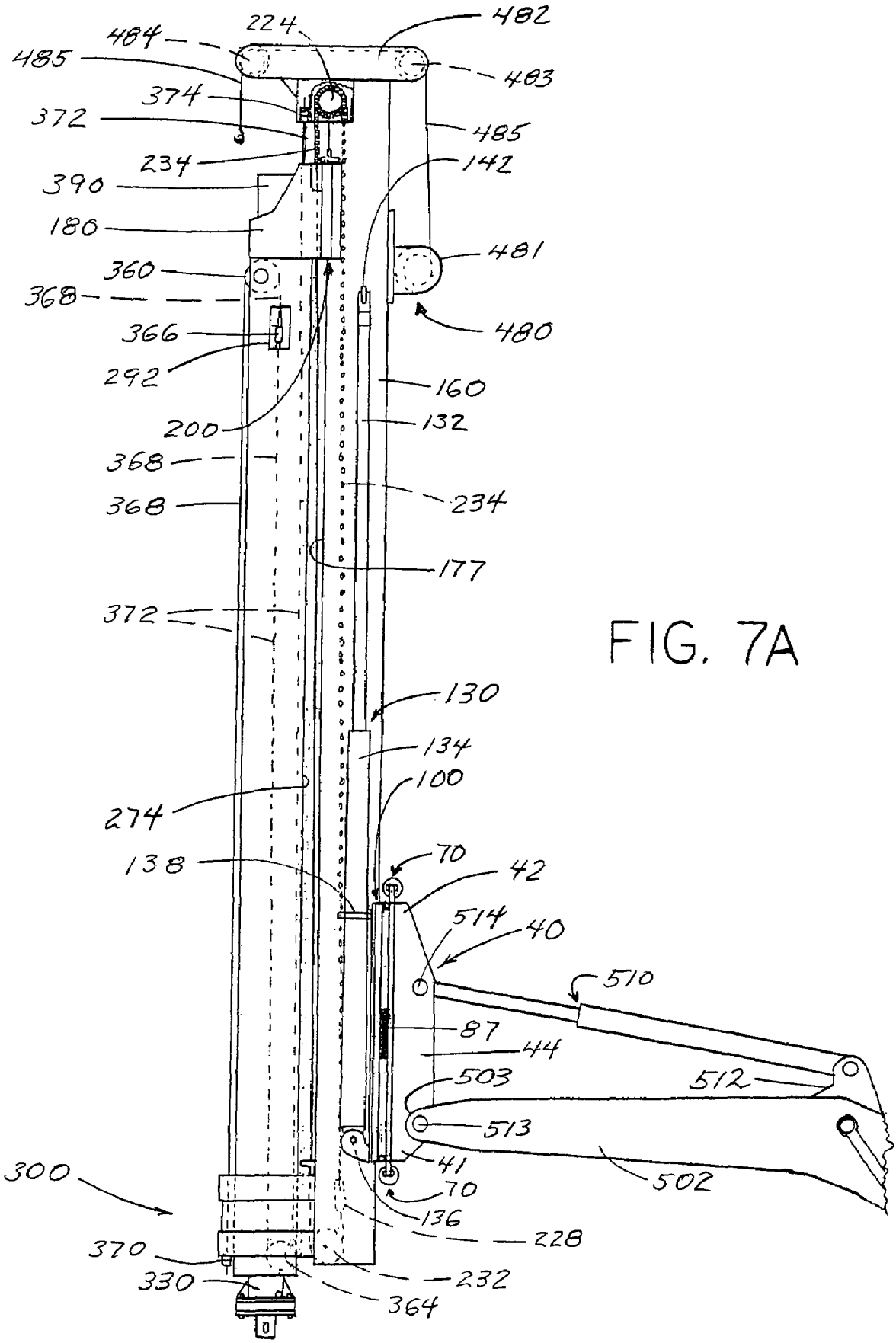
FIG. 7A is a detailed elevational view of the excavation apparatus of FIG. 5 with the mast fully upcrowded and the kelly bars fully upcrowded.
Figure 7B:
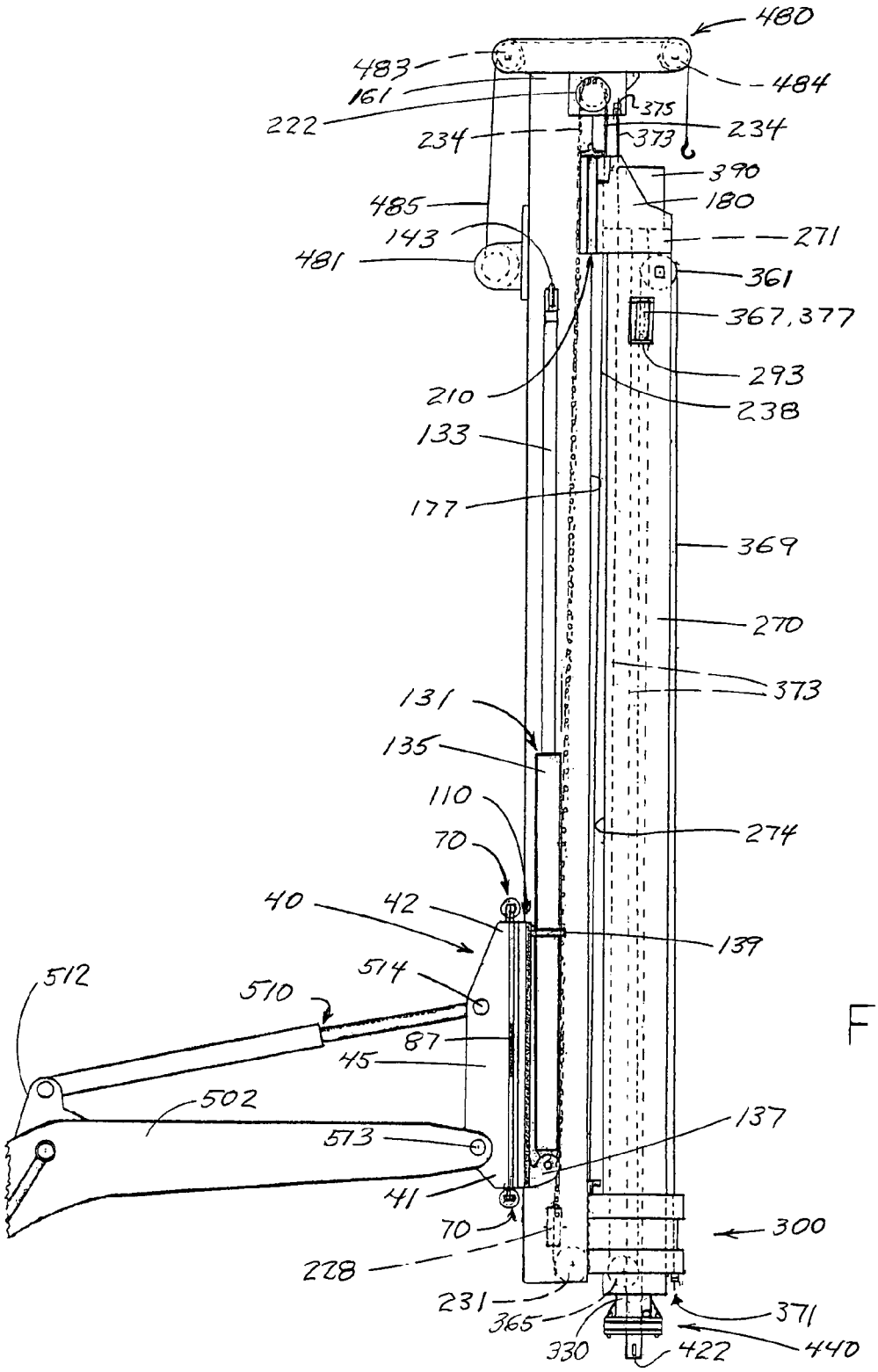
FIG. 7B is a detailed elevational view of the opposite side view of the excavation apparatus of FIG. 7A.

As illustrated in FIGS. 7A and 7B, mast 160 has been upcrowded on boom connector 40 to approximately the maximum distance possible by the complete extension of piston rods 132 and 133 out of barrels 134 and 135 of hydraulic cylinder actuators 130 and 131, respectively.

Figure 8A:
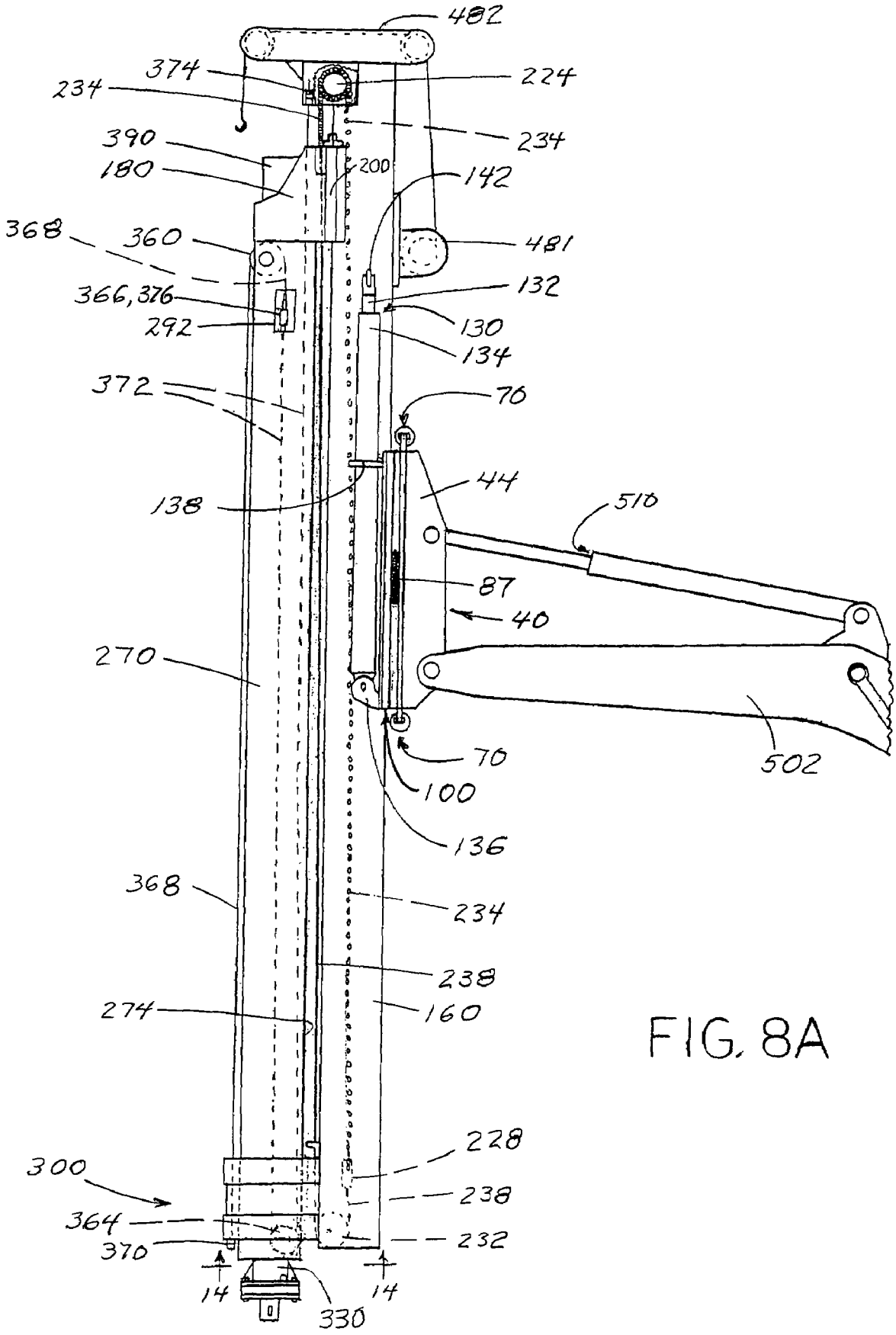
FIG. 8A is a detailed elevational view of the excavation apparatus of FIG. 7A with the mast fully downcrowded and the kelly bars fully upcrowded.
Figure 8B:
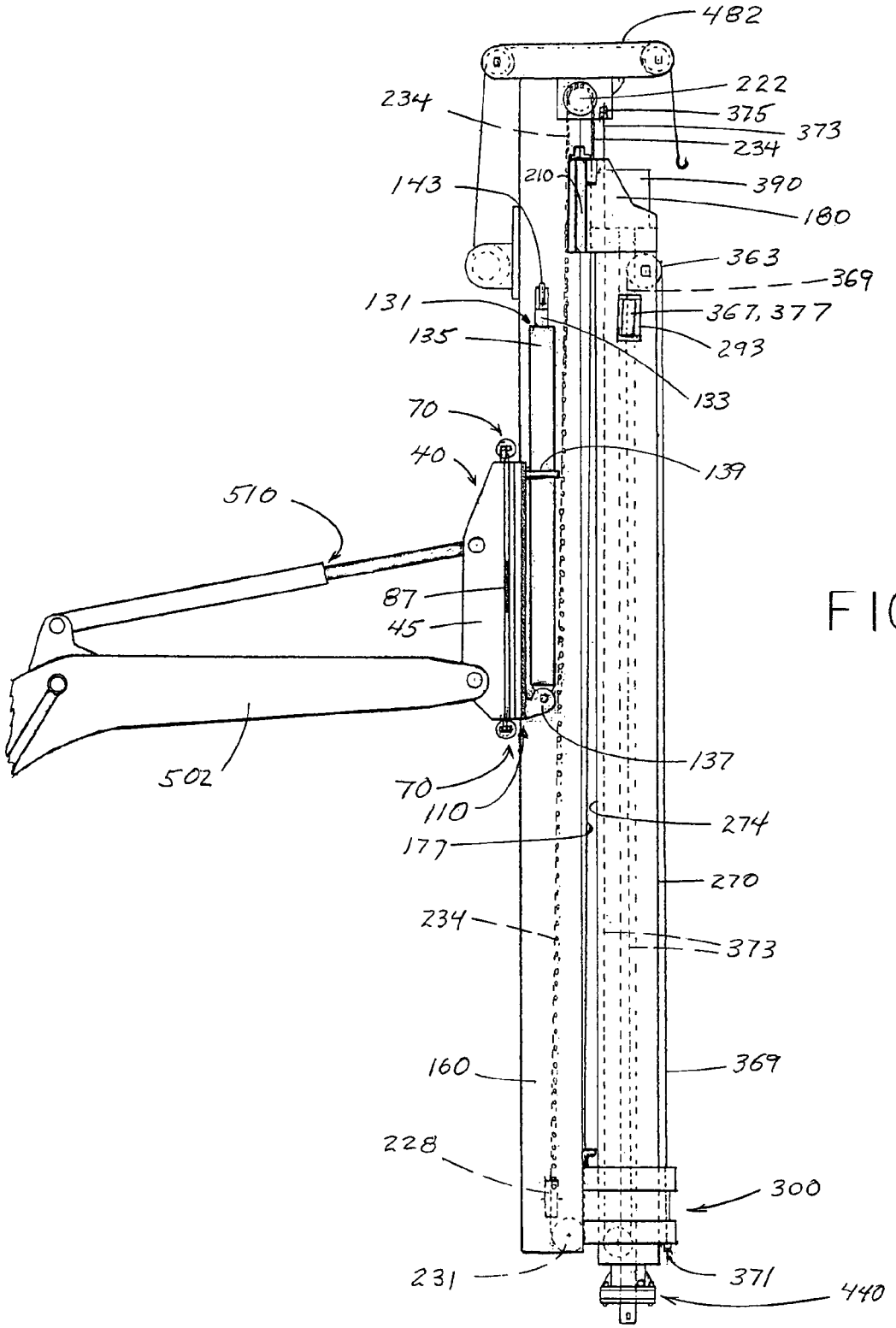
FIG. 8B is a detailed elevational view of the opposite side view of the excavation apparatus of FIG. 8A.

Whereas as illustrated in FIGS. 8A and 8B, mast 160 has been downcrowded on boom connector 40 to approximately the maximum distance possible by the complete retraction of piston rods 132 and 133 into barrels 134 and 135 of hydraulic cylinder actuators 130 and 131, respectively.

Figure 6:
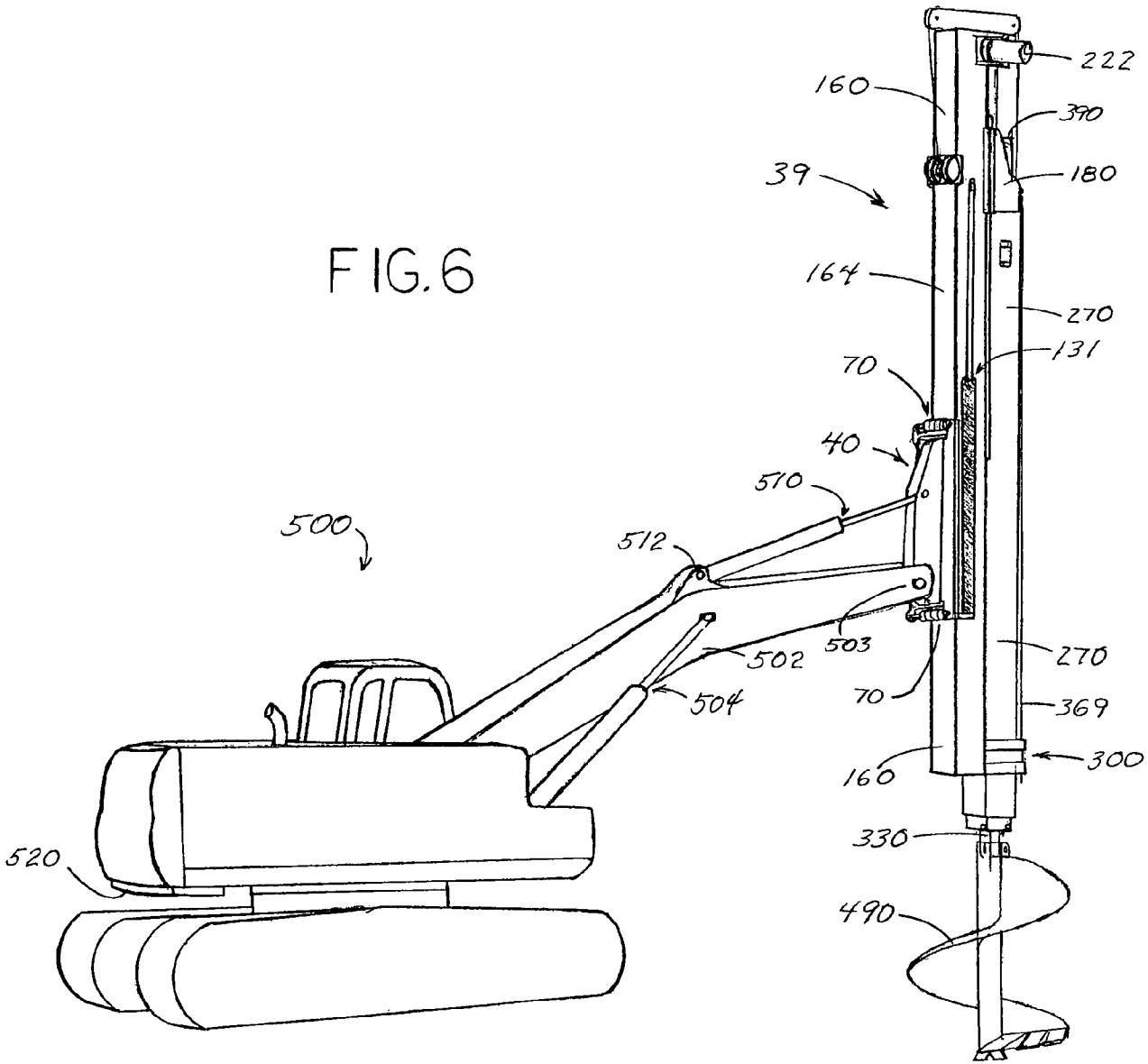
FIG. 6 is the excavation apparatus of FIG. 5 with mast slightly downcrowded and the kelly bars almost fully upcrowded.

As illustrated in FIGS. 5 and 6, mast 160 is shown downcrowded on boom connector 40 only a portion of the full mast downcrowdable range provided by hydraulic cylinder actuators 130 and 131.

Although the hydraulic cylinder actuators shown in the preferred embodiments are single stage, multistage actuators can also be use.

Fore and Aft Adjustment

It is to be noted that in this embodiment of this invention the vertical orientation of the mast can be adjusted to vertical or off-vertical, if desired, without using outboard leveling and stabilizing devices connected to the tractor 500 regardless of whether or not the tractor is on level ground or not. For example, the distal end 503 of boom 502 is pivotally connected by pin 513 to boom connector 40 proximate a lower end 41 thereof. Boom 502 is raised and lowered by a pair of synchronized hydraulic cylinder actuators 504 and 505 of tractor 500.

Furthermore, hydraulic cylinder actuator 510 is pivotally connected by pin 514 at one distal end to journal housing means 512 of boom 502, and pivotally connected at the actuator's opposite distal end to boom connector 4.0 at a point about midway between lower end 41 and upper end 42 of boom connector 40, thereby providing for fore and aft tilt control of the boom connector in the plane of the boom and the excavation apparatus mounted thereon.

Boom connector 40 preferably also comprises side-to-side tilt means 70 for tilting mast 160 to the left and right relative to the plane of boom 502. For this embodiment of this invention mast 160 is slidably mounted on the side-to-side tilt means section of boom connector 40 as will be described below in more detail.

Sled Driving Means

In addition to downcrowding mast 160 on boom connector 40, sled 180 can be downcrowded relative to mast 160 thereby providing an increased depth to which the excavation apparatus can reach as illustrated in FIGS. 4 and 5.

A sled driving means 220 is provided for downcrowding and upcrowding sled 180 along mast 160 as schematically illustrated in FIGS. 9, 10, 11, 12 and 13.

Figure 14:
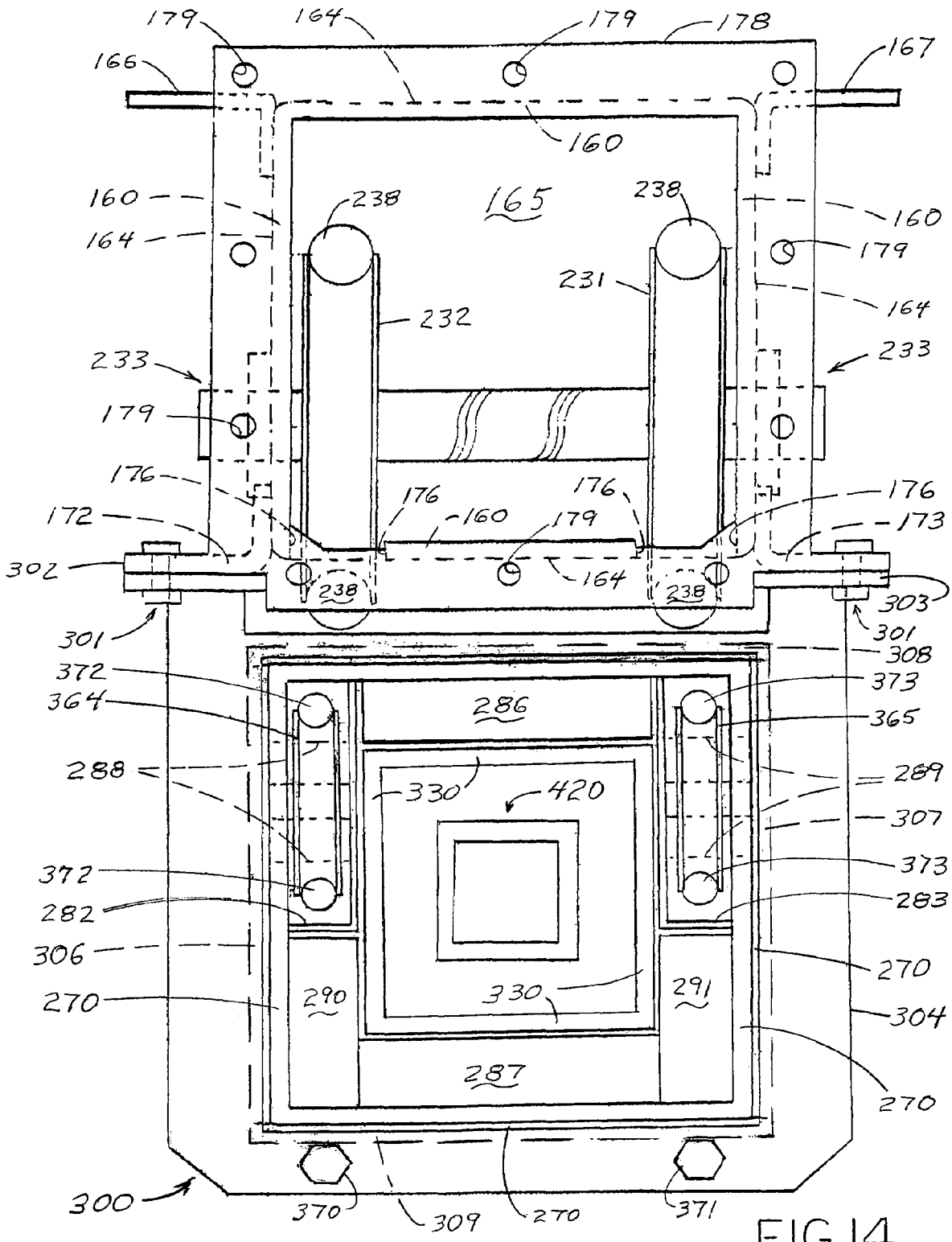
FIG. 14 is a bottom view of the lower end of the mast, the outer and inner kelly sections, and the upper and lower kelly bar telescopic shafts of this invention taken in the direction of line 14-14 of FIG. 8A.

In this embodiment mast 160 is of annular or hollow construction, preferably with a square-shaped outer surface 164 and an axially coincident square-shaped cavity 165 as illustrated in FIG. 14. The sled driving means resides partly within cavity 165 and partly outside of mast 160 and surface 164.

FIGS. 9, 10, 11, 12 and 13 are schematic representations of a sled driving means 220 especially useful for heavy duty excavations. In this embodiment, sled driving means 220 comprises a rotary motor 222 mounted on mast 160 proximate upper or first end 161 thereof, and a flexible connection system. Preferably the flexible connection system comprises a sprocket gear 224 having three parallel sets of identical circumferential teeth driven by rotary motor 222, a traveling sheave assembly 228 having a traveling sheave 229, and a pair of spaced apart identical fixed sheaves 231 and 232 rotatably mounted on a common shaft inside of cavity 165 of mast 160 proximate lower or second end 162 thereof on journal bearing unit 233. A small portion of fixed sheaves 231 and 232 extend through openings 176 in mast; see FIG. 14. Sprocket gear teeth are indicated in the breakaway portion of FIG. 12.

Figure 9:
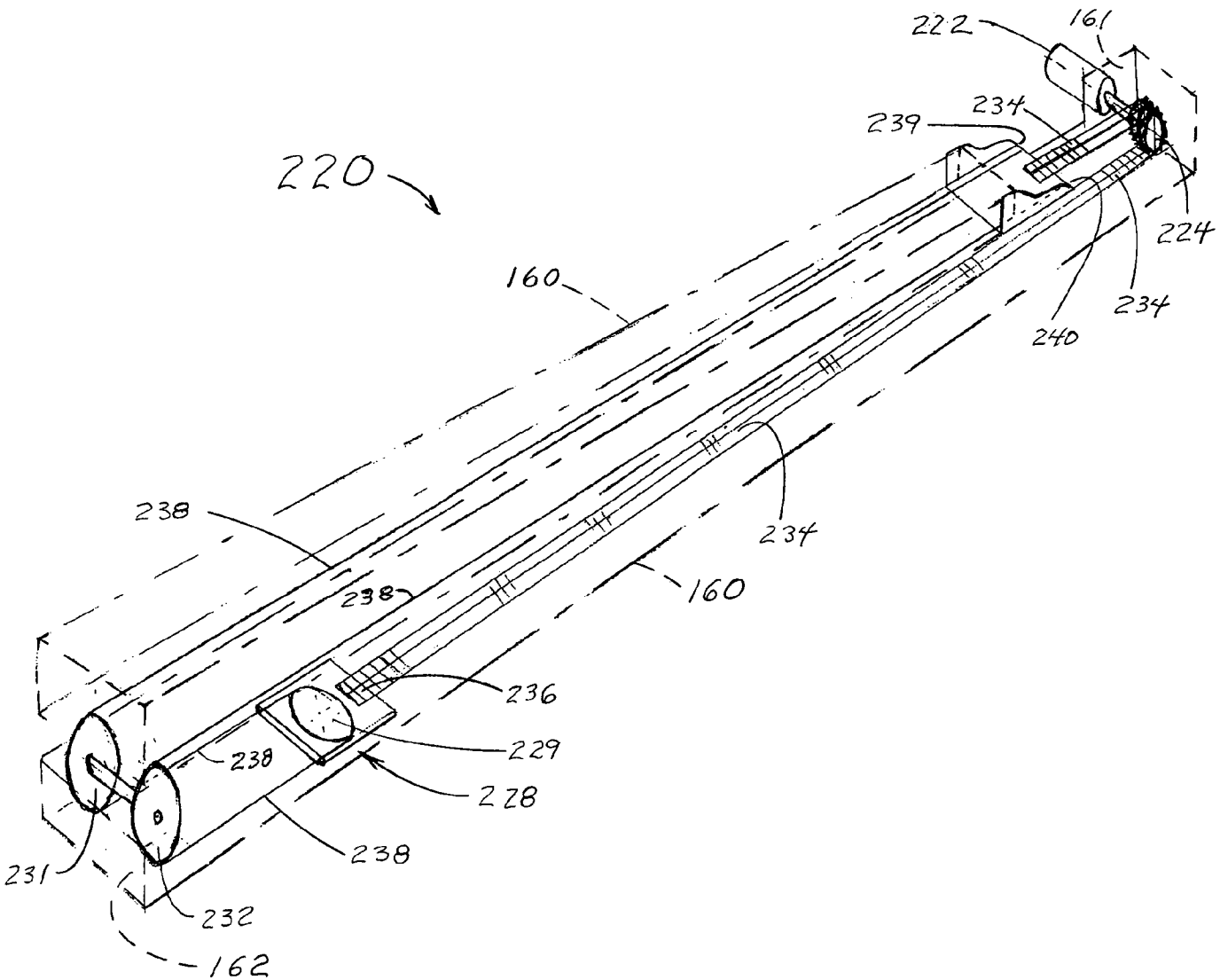
FIG. 9 is a perspective schematic of a sled driving means of this invention.
Figure 10:
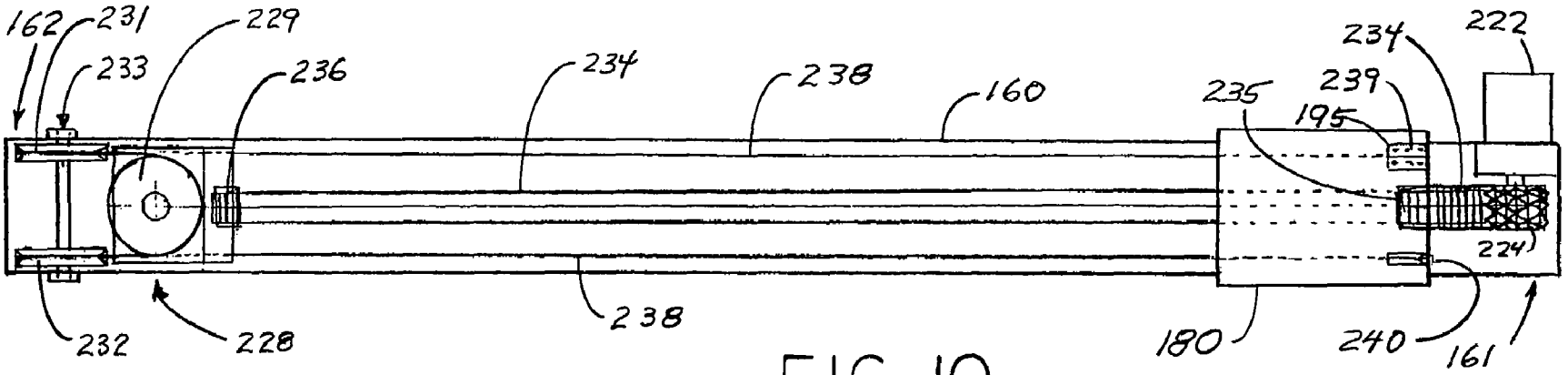
FIG. 10 is a front or fore view of the sled driving means of FIG. 9 with the sled fully upcrowded.
Figure 12:
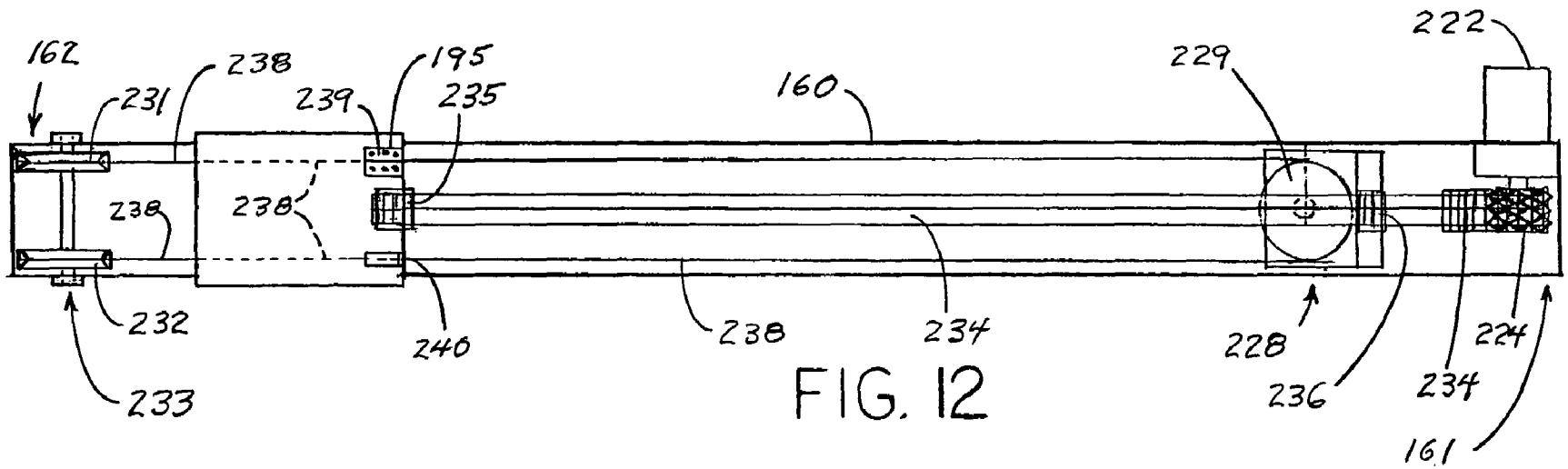
FIG. 12 is a front or fore view of the sled driving means of FIG. 9 with the sled fully downcrowded.
Figure 13:
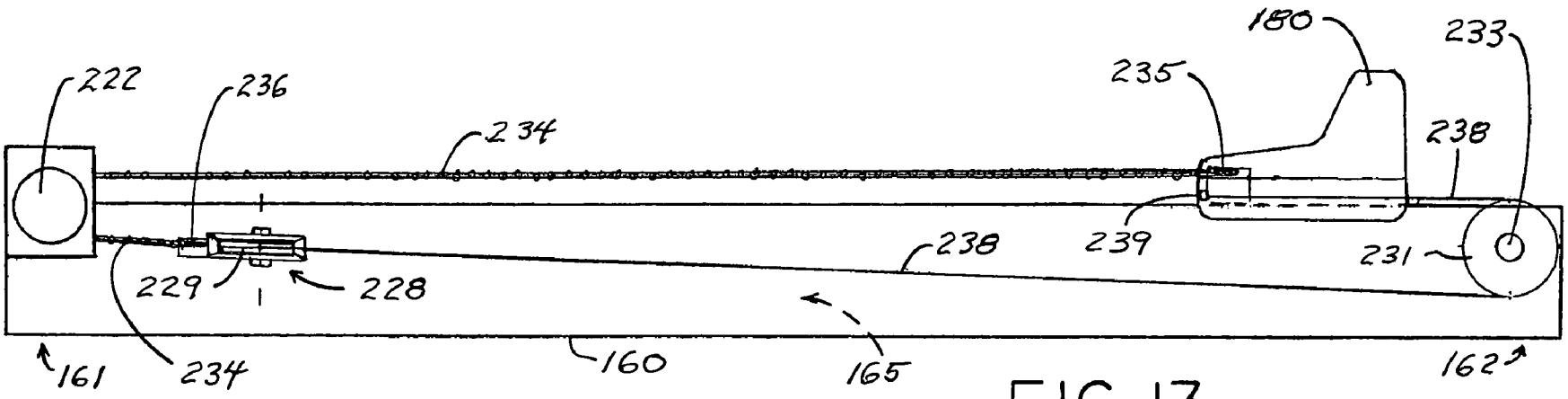
FIG. 13 is an elevational view of the sled driving means corresponding to FIG. 12.
Figure 11:
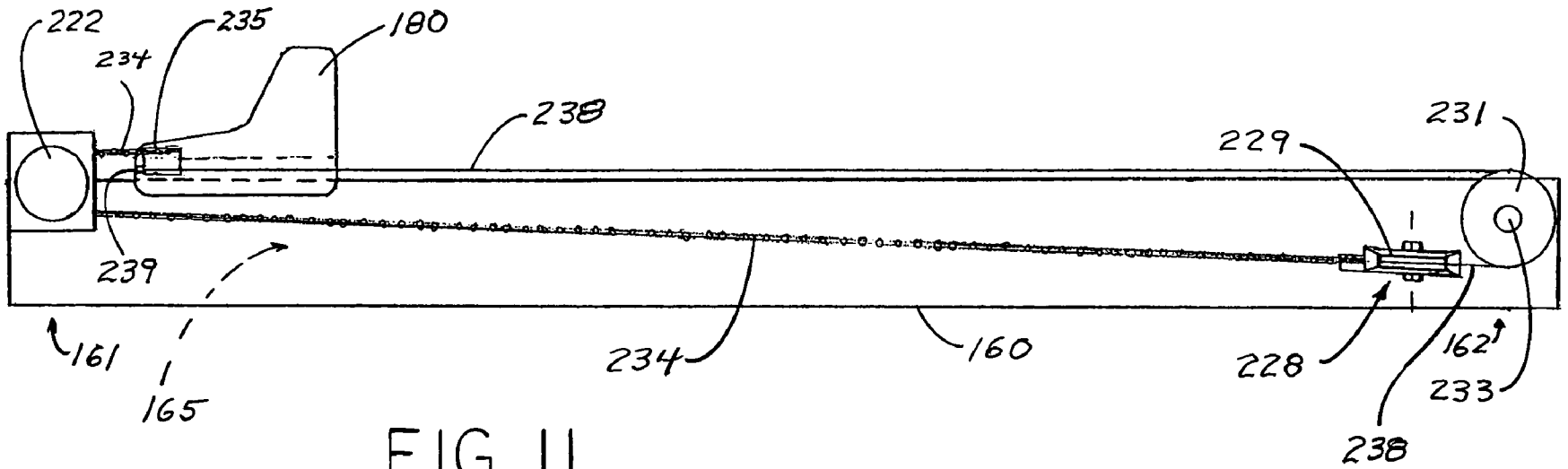
FIG. 11 is an elevational view of the sled driving means corresponding to FIG. 10.

With reference to FIGS. 9 and 14, in this embodiment portions of sprocket gear 224, a triple chain 234 suitable for being driven by gear 224, fixed sheaves 231 and 232, and a cable 238 reside outside of mast 160, while traveling sheave assembly 228 resides completely within central longitudinal cavity 165 of mast 160. A first end 235 of triple chain 234 is secured to sled 180 and the chain drawn tautly over gear 224. A second end 236 of chain 234 is secured to traveling sheave assembly 228.

A first end 239 of cable 238 is secured to sled 180, then drawn tautly down over fixed sheave 231, then around traveling sheave 229, then up over fixed sheave 232 with a second end 240 of cable 239 then tautly secured to sled 180, thereby forming a flexible connection system for driving sled 180 along mast 160 by actuation of rotary motor 222. At second end 240 of cable 238, means is provided for easily maintaining effective tautness in the flexible connection system.

As shown in FIGS. 15 and 16, traveling sheave assembly 228 comprises a base plate 241 having a tie-down block 242 welded thereto for mounting one end 235 of triple chain 234. Assembly 228 further comprises a housing 243 welded to base plate 241. Housing 243 supports bearing means 244 on which traveling sheave 229 is mounted. Housing 243 also shields cable 238 as it travels over sheave 229.

Figure 17:
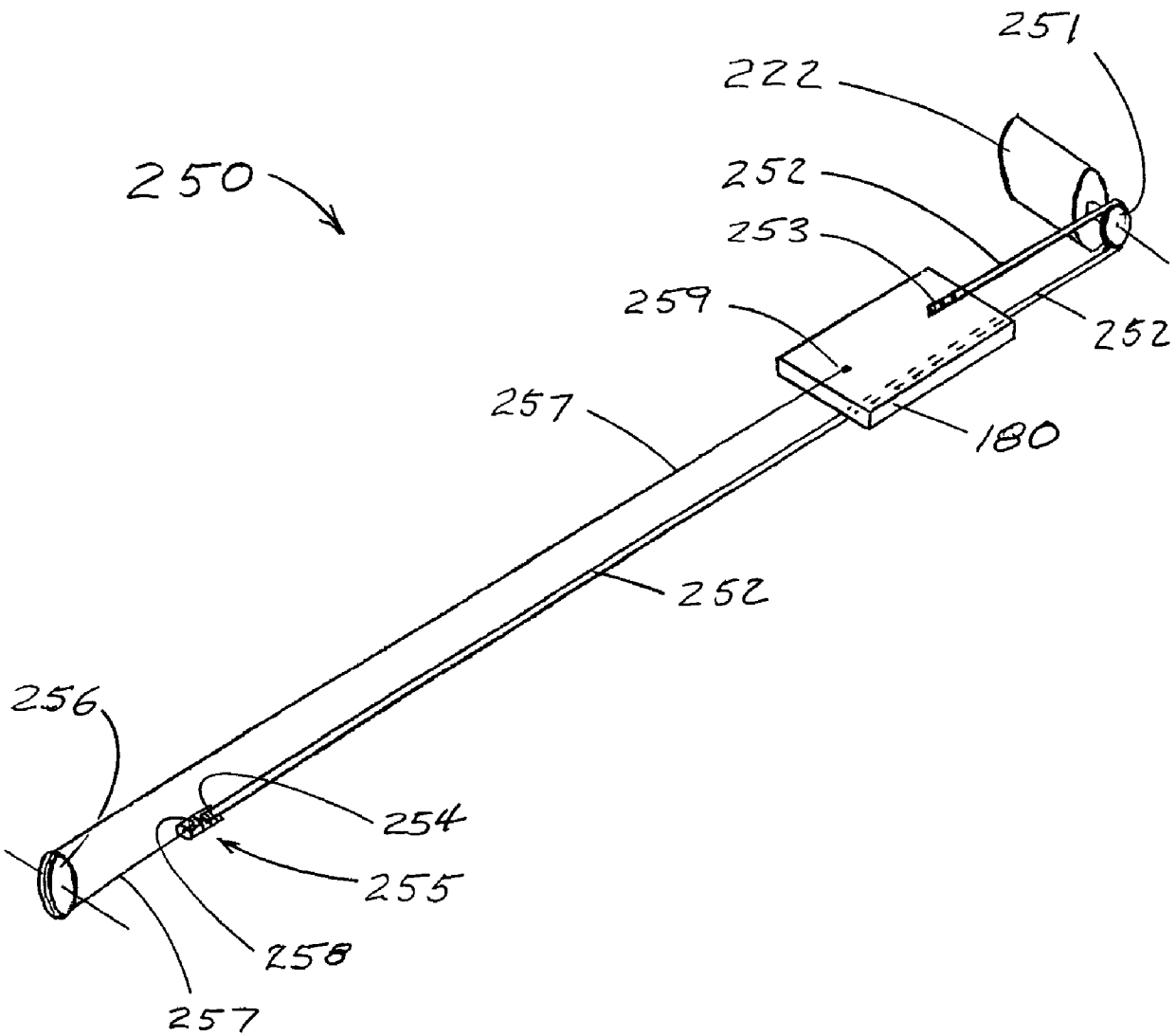
FIG. 17 is a perspective schematic of an alternative sled driving means of this invention for lighter duty.
Figure 18:
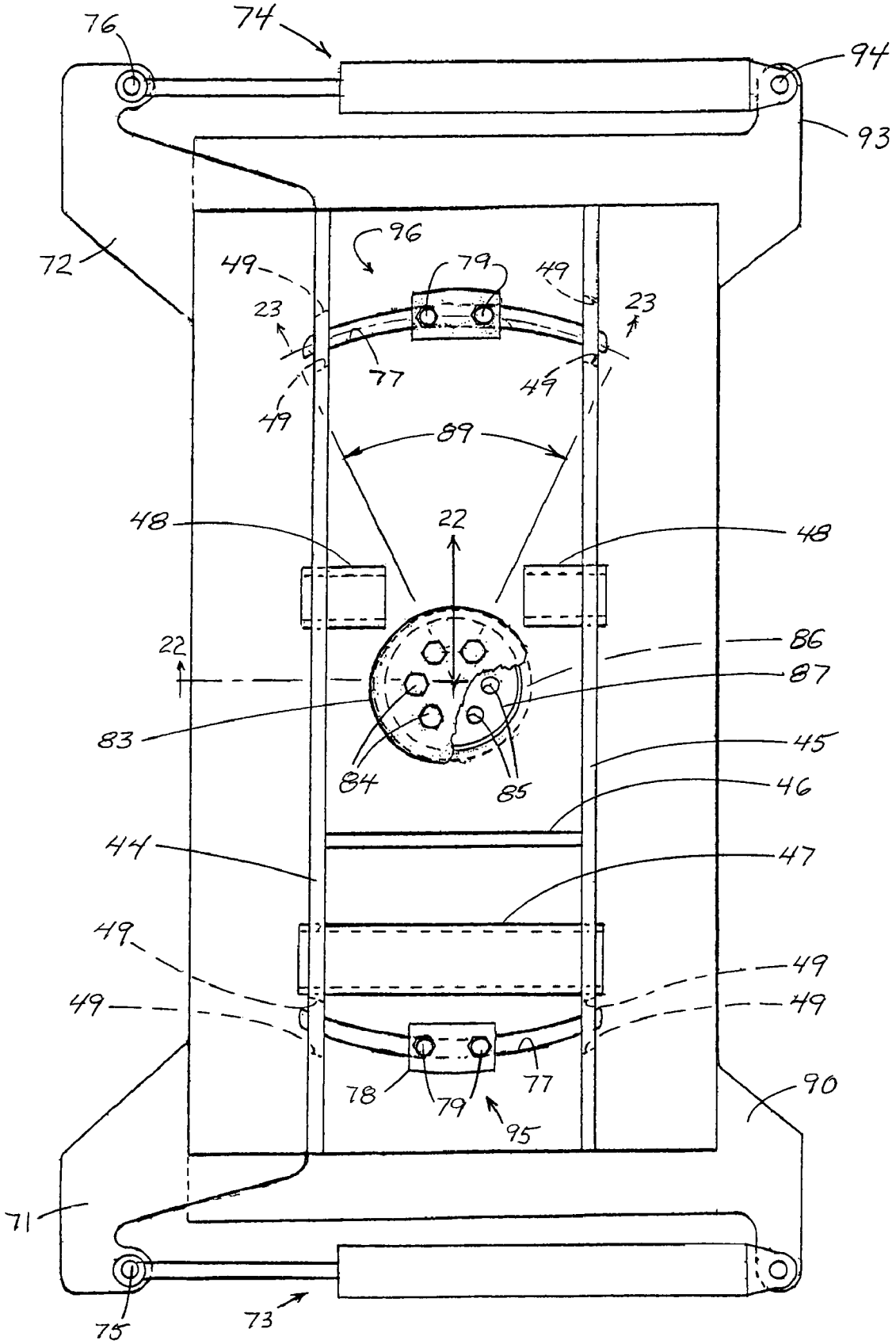
FIG. 18 is a rear or aft view of a side-to-side tilt system of this invention.

FIG. 17 is a schematic representation of another embodiment having sled driving means 250 that is useful for a lighter duty excavation than that shown in FIGS. 9 to 13. In this embodiment sled driving means 250 comprises a rotary motor 222 mounted on mast 160 proximate upper or first end 161 thereof, and a flexible connection system.

The flexible connection system comprises a sprocket gear 251 driven by rotary motor 222, a traveling chain-to-cable unit 255, and a fixed sheave 256 rotatably mounted on mast 160 proximate lower or second end 162 thereof.

A first end 253 of a chain 252 is attached to sled 180 and the chain drawn tautly over sprocket gear 251. A second end 254 of chain 252 is secured to chain-to-cable unit 255, and a first end 258 end of a cable 257 is secured to chain-to-cable unit 255 and drawn tautly up over fixed sheave 256. A second end 259 of cable 257 is tautly secured to sled 180 thereby forming a flexible connection system for driving sled 180 along mast 160 by actuation of rotary motor 222. At second end 259 of cable 257, means is provided for easily maintaining effective tautness in the flexible connection system.

Side-to-Side Tilt Adjustment

Returning to side-to-side tilt means 70, a section of boom connector 40, is illustrated in more detail in FIGS. 18, 19, 20, 21, 22 and 23. In this embodiment of this invention boom connector 40 comprises a first base plate 43;

spaced apart parallel longitudinal walls 44 and 45 welded to and perpendicular to first base plate 43;

lateral buttress plate 46 welded to and perpendicular to first base plate base 43 and walls 44 and 45;

lateral journal bearing member 47 welded to and perpendicular to walls 44 and 45 for pivotal connection to distal end 503 of boom 502;

and opposite and axially aligned lateral journal bearing members 48 welded to and perpendicular to walls 44 and 45 for pivotal connection to the piston end of hydraulic cylinder actuator 510.

Side-to-side tilt means 70 also comprises lower tilt arm 71 welded to first base 43 for pivotal connection of lower tilt hydraulic cylinder actuator 73 with pin 75, and upper tilt arm 72 welded to first base plate 43 for pivotal connection of upper tilt hydraulic cylinder actuator 74 with pin 76.

Side-to-side tilt means 70 further comprises a second base plate 50 spaced apart from and parallel to first base plate 43. Second base plate 50 comprises a relatively large diameter central journal 87 welded to second base plate 50. Journal 87 is pivotally supported by journal bearing 86 which is welded to first base plate 43. Circular cap 83 is secured to journal 87 by fasteners 84 threaded into threaded holes 85 in central journal 87 thereby preventing second base plate 50 and journal 86 from separating from journal bearing 87 and first base plate 43. Grease can be applied to journal 87 through fitting 88 in journal bearing 86.

Figure 19:
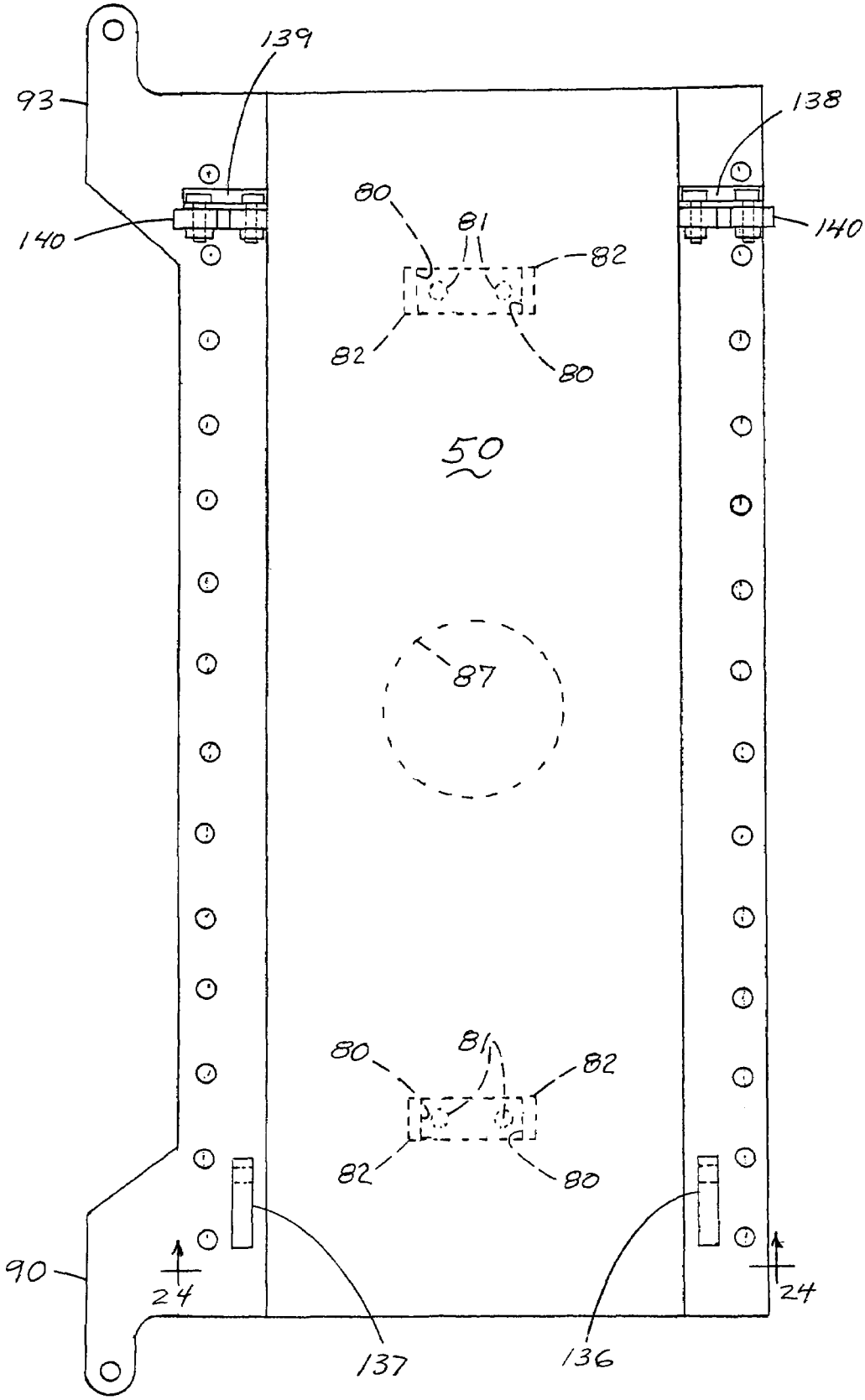
FIG. 19 is a fore view of the side-to-side tilt system of FIG. 18.
Figure 20:
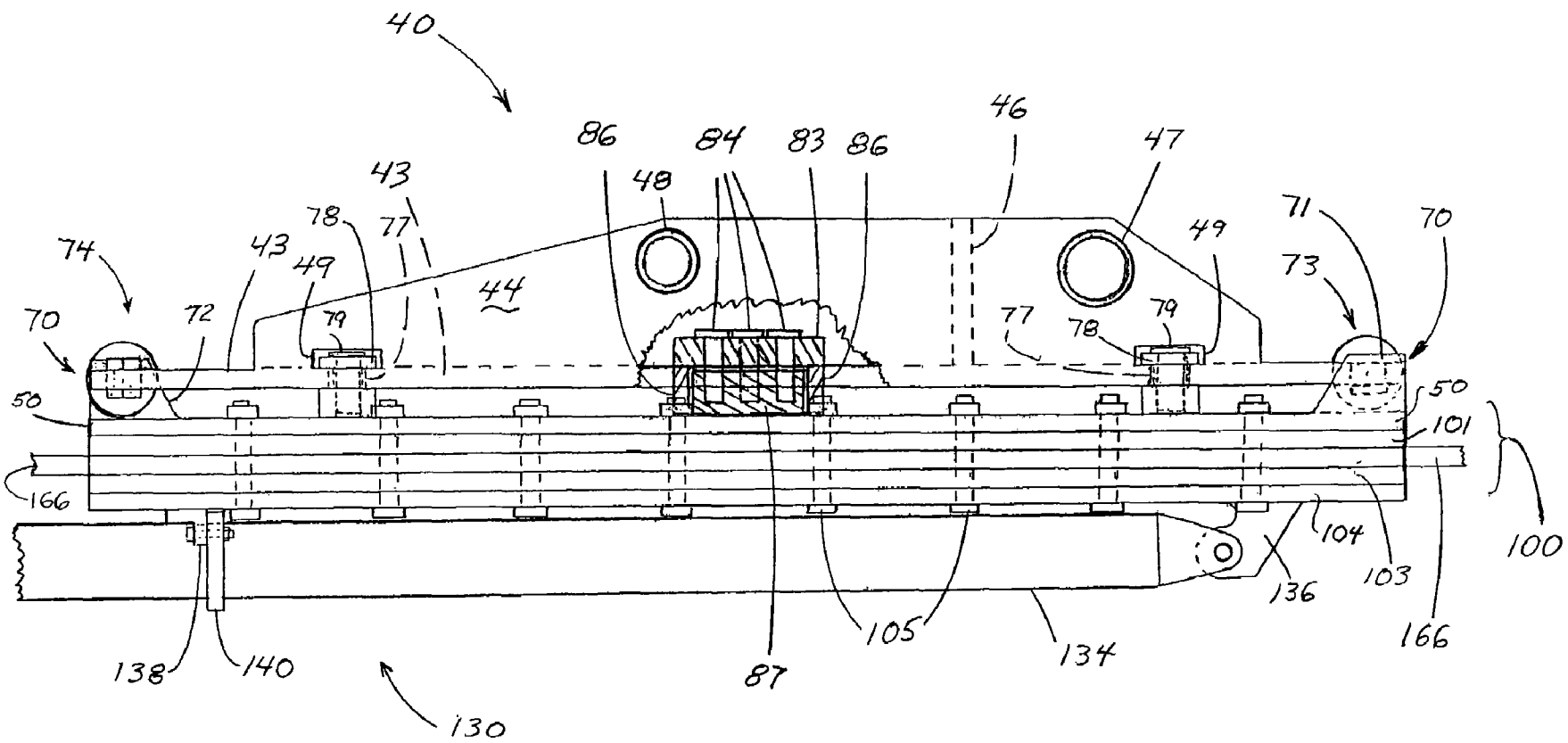
FIG. 20 is an elevational view of the side-to-side tilt system of FIG. 18 attached to the boom connector and hydraulic cylinder actuator of this invention.
Figure 21:
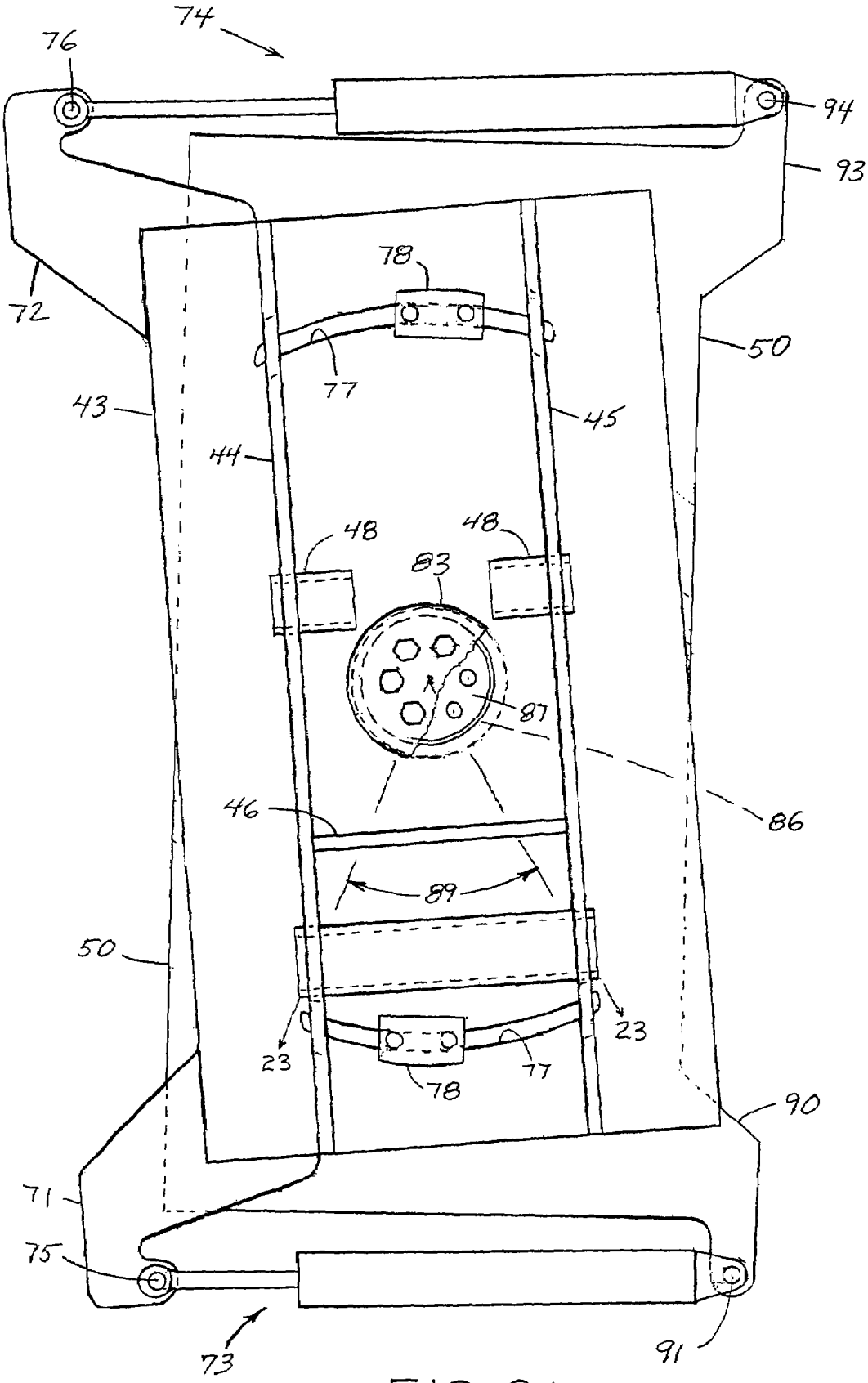
FIG. 21 is a fore view of the side-to-side tilt system of FIG. 18 with the mechanism tilted slightly.
Figure 22:
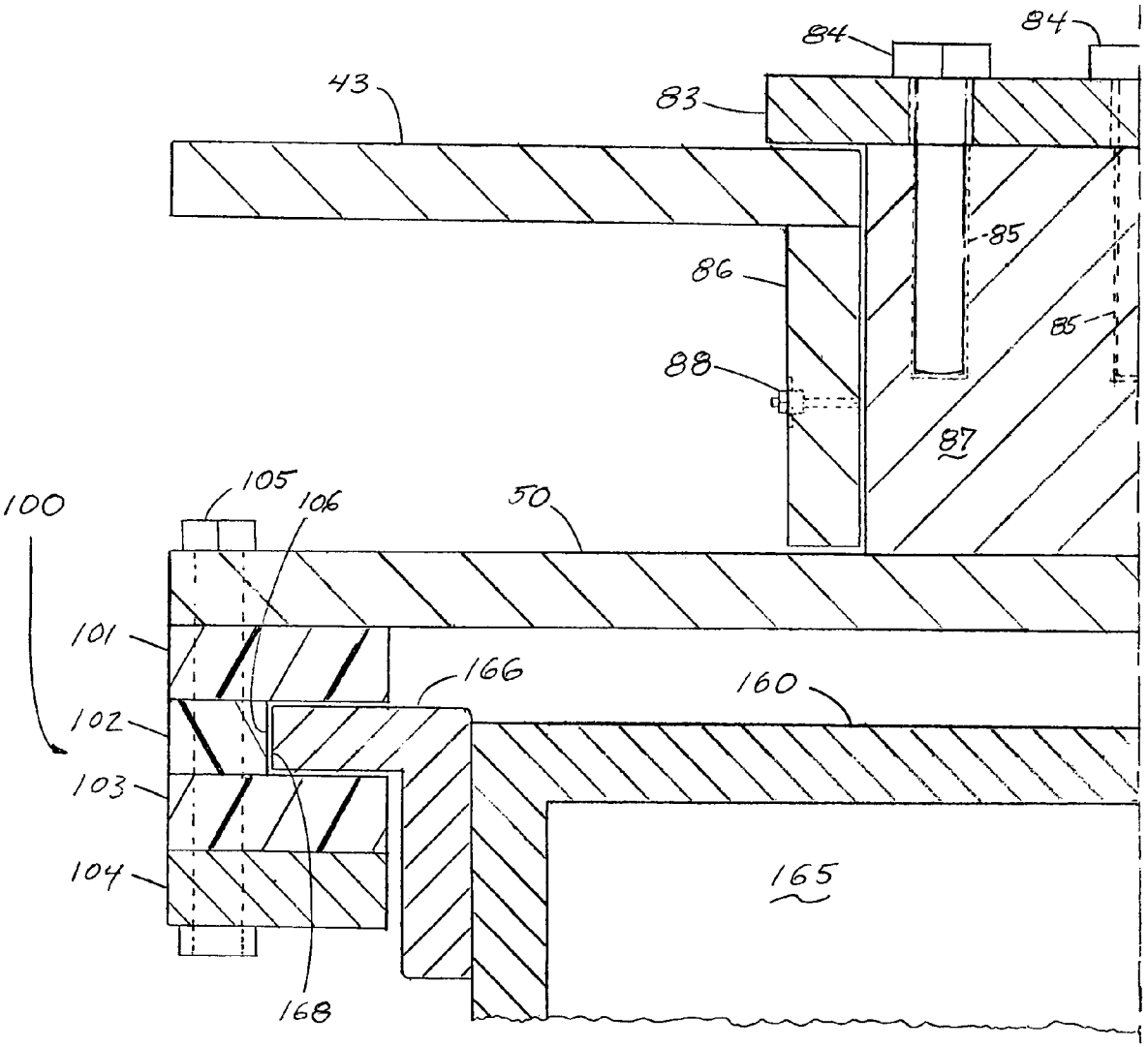
FIG. 22 is an enlarged detailed view of the central journal bearing of side-to-side tilt system, and mast-to-slide bushing assembly taken in the direction of line 22-22 of FIG. 20.
Figure 23:
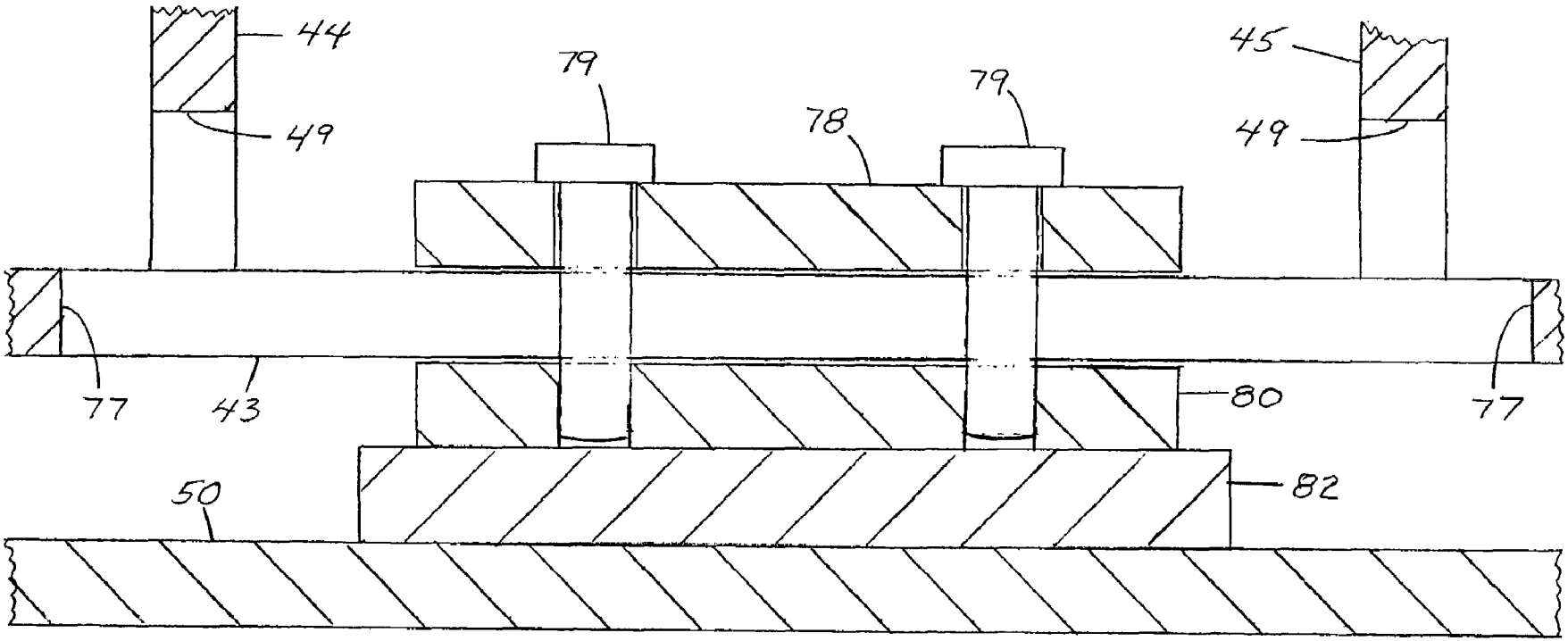
FIG. 23 is an enlarged detailed view of tilt system's mechanism for limiting the amount of tilt taken in the direction of articulate line 23-23 of FIG. 18.

As illustrated in FIG. 19, second base plate 50 also comprises elevated lower tilt arm 90 welded thereto for pivotal connection of lower tilt hydraulic cylinder actuator 73 with pin 91, and elevated upper tilt arm 93 welded to second base plate 50 for pivotal connection of upper tilt hydraulic cylinder actuator 74 with pin 94.

To limit the extent to which mast 160 can be tilted with relative to the plane of boom 302, and to reduce stress on base plates 43 and 50, journal bearing 86 and journal 87, a lower restraint means 95, and an upper restraint means 96 are provided.

Lower restraint means 95 and upper restraint means 96 each comprise an articulate slot 77 in first base plate 43, a slide cap 78 secured by fasteners 79 to internally threaded holes 81 in slide block 80. Slide block 80 is welded to spacer block 82, which is welded to second base plate 50 as shown on FIGS. 18 and 23.

The radii of curvature of articulate slots 77 are equal and the axes thereof are coaxial with the axis of journal bearing 86. Upper and lower slots 49 in walls 44 and 45 allow slide caps 78 to pass partially through walls 44 and 45 until fasteners 79 abut the end of articulate slots 77 thereby limiting the extent of tilt permitted.

Lower restraint means 95 is positioned between journal bearing 86 and hydraulic cylinder actuator 73. Upper restraint means 96 is positioned between journal bearing 86 and hydraulic cylinder actuator 74. In this embodiment, the side to side tilt system is limited to an inclusive angle 89. In one embodiment angle 89 is about 40°.

Journal elements 83, 84, 85, 86 and 87 must be strong enough to support mast 160, and all components attached thereto including outer kelly section 270, inner kelly section 330, rotary motors 222 and 390, and excavation tool 490.

Boom Connector-to-Mast Slide Bushing

In one embodiment of this invention, mast 160 can be downcrowded and upcrowded relative to boom connector 40.

For example, in the embodiment illustrated in FIGS. 14, 19, 20, 22 and 24, mast 160 comprises a first set of two parallel and spaced apart slide rails 166 and 167 protruding from opposite sides of mast 160. Slide rails 166 and 167 lie in a common plane.

Slide rails 166 and 167 are constrained to straight line movement in a plane defined by boom connector-to-slide bushing assemblies 100 and 110. Slide bushing assemblies 100 and 110 comprise opposite side portions of second base plate 50, which as described above is, in this embodiment, a part of boom connector 40.

Slide bushing assembly 100 also comprises members 101, 102 and 103 made of the low friction materials, and a confinement member 104. A series of the fasteners 105 compresses members 101, 102, 103 and 104 together against second base plate 50.

Slide bushing assembly 110 also comprises members 111, 112 and 113 made of the low friction materials, and a confinement member 114. Another series of the fasteners 105 compresses members 111, 112, 113 and 114 together against second base plate 50.

The following pairs of members are mirror images of each other: 101 and 111, 102 and 112, 103 and 113, and 104 and 114. In fact, slide bushing assembly 110 is the mirror image of slide bushing assembly 101 and is positioned on mast 160 at the same elevation thereon as slide bushing assembly 100.

Figure 24:
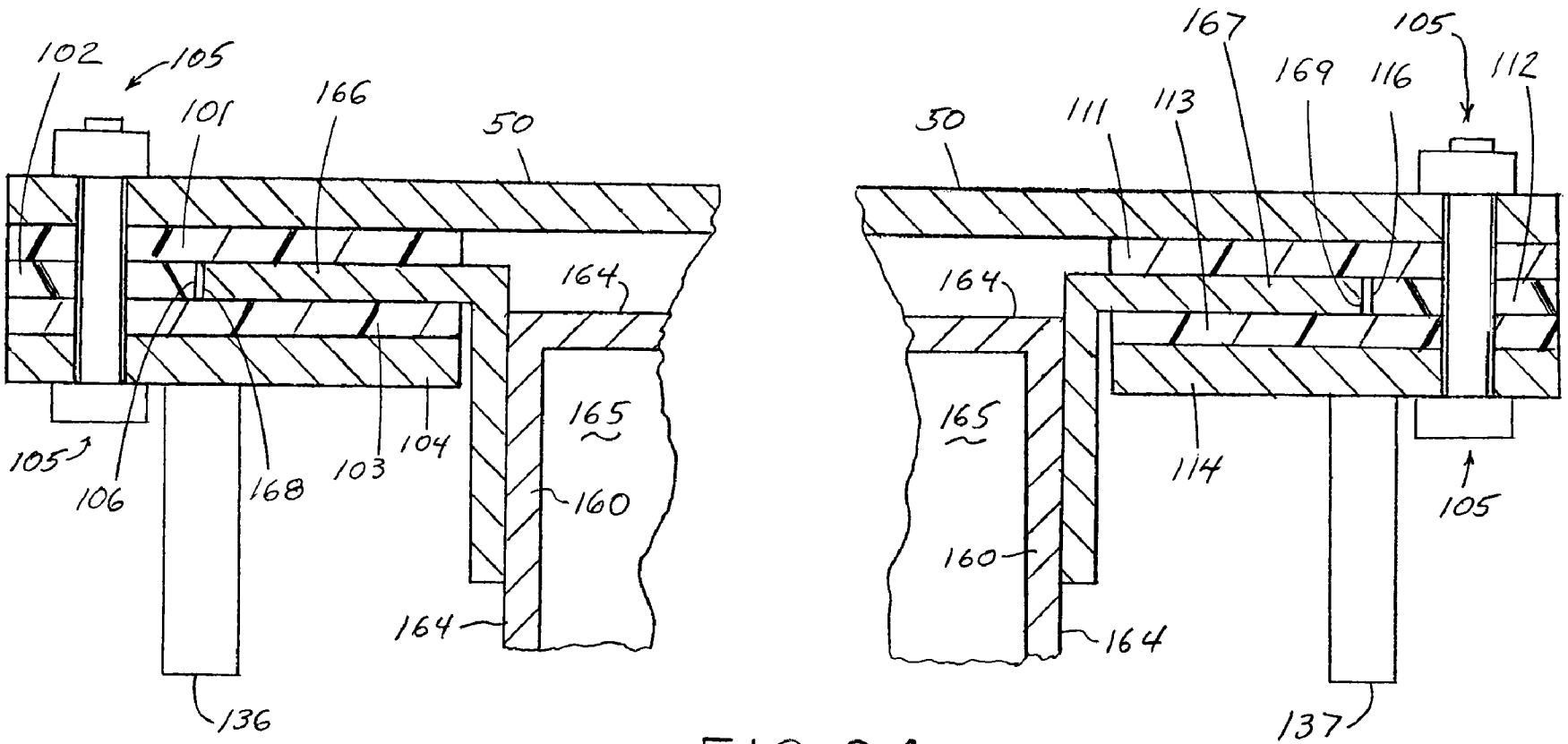
FIG. 24 is an enlarged detailed view of boom connector to mast slide bushing with hydraulic cylinder actuator mounting brackets taken in the direction of lines 24-24 of FIG. 19.

As illustrated in FIG. 24, low friction members 101 and 103 abut low friction member 102 on one side of mast 160, and low friction members 111 and 113 abut low friction member 112 on the other side of mast 160. There are small clearances between low friction members 101 and 103 and slide rail 166 on one side of mast 160, and low friction members 111 and 113 and slide rail 167 on the other side of mast 160. There is also a small clearance between inside surface 106 of member 102 and surface 168 of slide rail 166, and inside surface 116 and surface 169 of slide rail 167. These clearances are preferably about 0.060 of an inch.

Slide bushing assemblies 100 and 110, therefore, restrict slide rails 166 and 167 to straight line movement in a plane defined by members 102 and 112 of slide bushing assemblies 100 and 110, respectively.

In one embodiment of this invention the portion of members 101, 102, 103, 104, 111, 112, 113 and 114 that provide the slide features of slide bushing assemblies 100 and 110 are about 8 feet long with fasteners spaced about 5 inches apart along the lengths thereof. Members 101, 102, 103, 111, 112 and 113 are about 0.5 inches thick. Members 101, 103, 104, 111, 113 and 114 are about 5 inches wide, and members 102 and 112 are about 2 inches wide.

Preferably the members 101, 102, 103, 111, 112 and 113 are made from high abrasion resistant and low friction plastics such as a fluoropolymer. Slide rails 166 and 167 can be made from angle steel welded to the outside surface 164 of mast 160.

Downcrowding and Upcrowding Mast

As mentioned above, hydraulic cylinder actuator 130 and 131 downcrowd and upcrowd mast 160 relative to boom connector 40. However, since confinement members 104 and 114 of slide bushing assemblies 100 and 110 are bolted to second base plate 50 of boom connector 40, downcrowding and upcrowding mast 160 relative to confinement members 104 and 114 will achieve effective and efficient downcrowding and upcrowding of the mast relative to boom connector 40.

As illustrated in FIGS. 8A, 8B, 19, 20 and 24, mounting brackets 136 and 137 are welded perpendicular to a lower distal end of confinement members 104 and 114, respectively. Mounting brackets 136 and 137 are for pivotal attachment of barrel ends 134 and 135 of hydraulic cylinder actuators 130 and 131, respectively. Articulate brackets 138 and 139 are welded perpendicular to the upper distal ends of confinement members 104 and 114, respectively. A set of articulate coupling brackets 140 are bolted to each of articulate brackets 138 and 139 and surround the barrels of actuators 130 and 131 thereby further restraining and supporting the barrel of actuators 130 and 131 and preventing piston rods 132 and 133 from bending during downcrowding and upcrowding.

Lastly, the distal ends of piston rods 132 and 133 of actuators 130 and 131 are pivotally connected to mounting brackets 142 and 143, respectively, which are welded to opposite sides of mast 160 at the same elevation thereon.

Thus, extension of actuators 130 and 131 upcrowds mast 160 relative to boom connector 40, and retraction of actuators 130 and 131 downcrowds mast 160 relative to boom connector 40.

In this embodiment hydraulic cylinder actuators 130 and 131 extend about 10 feet, which is the difference in the downcrowded distance between FIGS. 1 and 2 and FIG. 3 and 4.

Mast-to-Sled Slide Bushing

As mentioned above, sled 180 can be downcrowded relative to mast 160 by a sled driving means.

Figure 25:
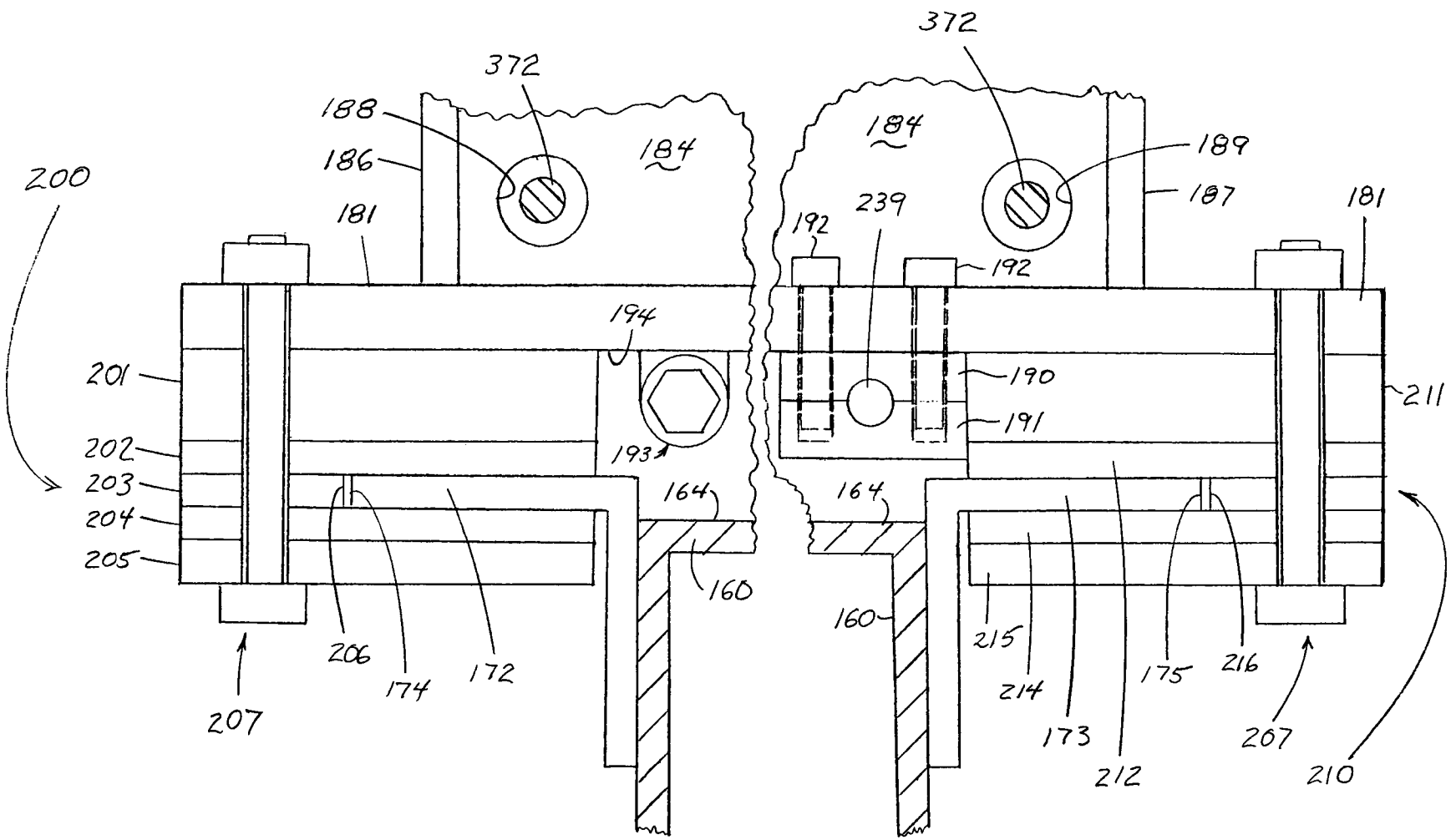
FIG. 25 is an enlarged detailed view of mast to sled slide bushing, cable tie-downs and portions of the sled taken in the direction of lines 25-25 of FIG. 26.

For example, in the embodiment illustrated in FIGS. 14 and 25, mast 160 comprises a second set of two parallel and spaced apart slide rails 172 and 173 protruding from opposite sides of mast 160. Slide rails 172 and 173 are also spaced away from and parallel to the first set of slide rails 166 and 167.

Slide rails 172 and 173 lie in and define a plane that dictates the straight line movement of mast-to-sled slide bushing assemblies 200 and 210.

Mast-to-sled slide bushing assemblies 200 and 210 comprise side portions of a sled base plate 181. Mast-to-sled slide bushing assembly 200 also comprises members 201, 202, 203 and 204 made of the low friction materials, and a confinement member 205. A series of the fasteners 207 compresses members 201, 202, 203, 204 and 205 together against one side portion of sled base plate 181.

Similarly, in addition to sled base plate 181 mast-to-sled slide bushing assembly 210 also comprises members 211, 212, 213 and 214 made of the low friction materials, and a confinement member 215. Another series of the fasteners 207 compresses members 211, 212, 213, 214 and 215 together against the other side portion of sled base plate 181.

As shown in FIG. 25, mast-to-sled slide bushing assemblies 200 and 210 mount sled 180 to slide rails 172 and 173 of mast 160 and allow sled 180 to move in a slidable relationship along mast 160 when driven by the sled driving means.

The following pairs of members are mirror images of each other: 201 and 211, 202 and 212, 203 and 213, 204 and 214, and 205 and 215. In fact, slide bushing assembly 210 is the mirror image of slide bushing assembly 200 and is positioned on mast 160 at the same elevation thereon as slide bushing assembly 200.

As illustrated in FIG. 25, low friction members 202 and 204 abut low friction member 203 on one side of mast 160, and low friction members 212 and 214 abut low friction member 214 on the other side of mast 160.

There are small clearances between low friction members 202 and 204 and slide rail 172 on one side of mast 160, and low friction members 212 and 214 and slide rail 173 on the other side of mast 160. There is also a small clearance between inside surface 206 of member 203 and surface 174 of slide rail 172, and inside surface 216 and surface 175 of slide rail 173. These clearances are preferably about 0.060 of an inch.

Slide rails 172 and 173, therefore, restrict slide bushing assemblies 200 and 210 to straight line movement to a plane dictated by slide rails 172 and 173. Thus sled base plate 181 slides in a plane parallel to and offset from the plane of rails 172 and 173.

In one embodiment of this. invention the portion of members 201, 202, 203, 204, 205, 211, 212, 213, 214 and 215 that are required for the slide feature are about 2.5 feet long with fasteners spaced about 4.5 inches apart near the outer perimeter thereof. Members 202, 203, 204, 212, 213 and 214 are about 0.5 of an inch thick. Members 201 and 211 are about 1 inch thick and are merely light-weight spacers for positioning outer kelly section 270, when attached to sled 180, at a predetermined distance away from mast 160. Members 201, 202, 204, 205, 211, 212, 214 and 215 are about 5 inches wide, and members 203 and 213 are about 2 inches wide.

Preferably the members 201, 202, 203, 204, 211, 212, 213 and 214 are made from high abrasion resistant and low friction plastics such as a fluoropolymer. Slide rails 172 and 173 can be made from angle steel welded to the outside surface 164 of mast 160.

Thus, downcrowding and upcrowding of sled 180 along slide rails 172 and 173 downcrowds and upcrowds outer kelly section 270 in a plane dictated by slide rails 172 and 173 and parallel to mast 160.

In this embodiment of this invention sled 180 can be downcrowded about 10 feet relative to mast 160.

Sled

Figure 26:
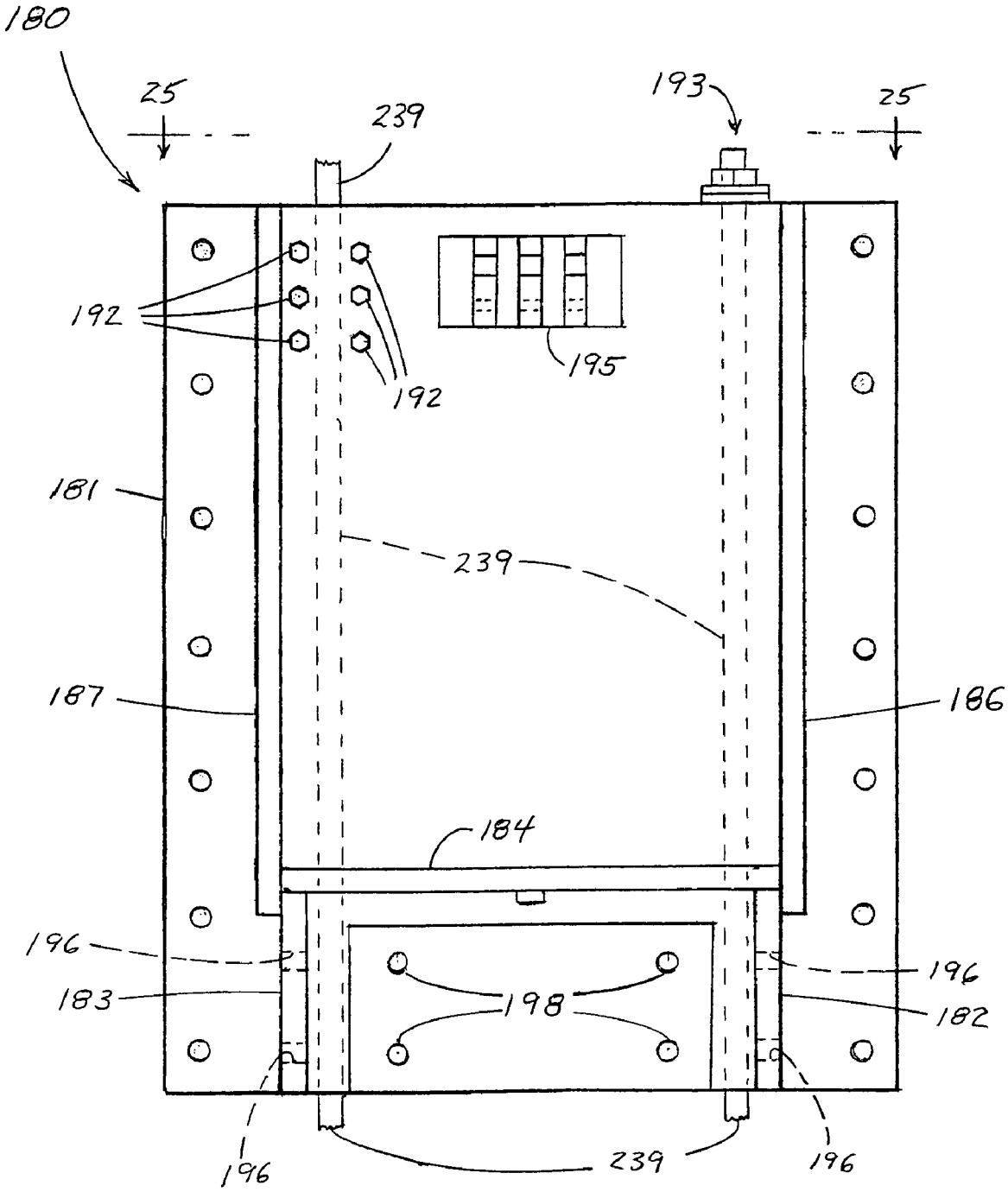
FIG. 26 is an enlarged fore or front view of the sled of this invention.
Figure 27:
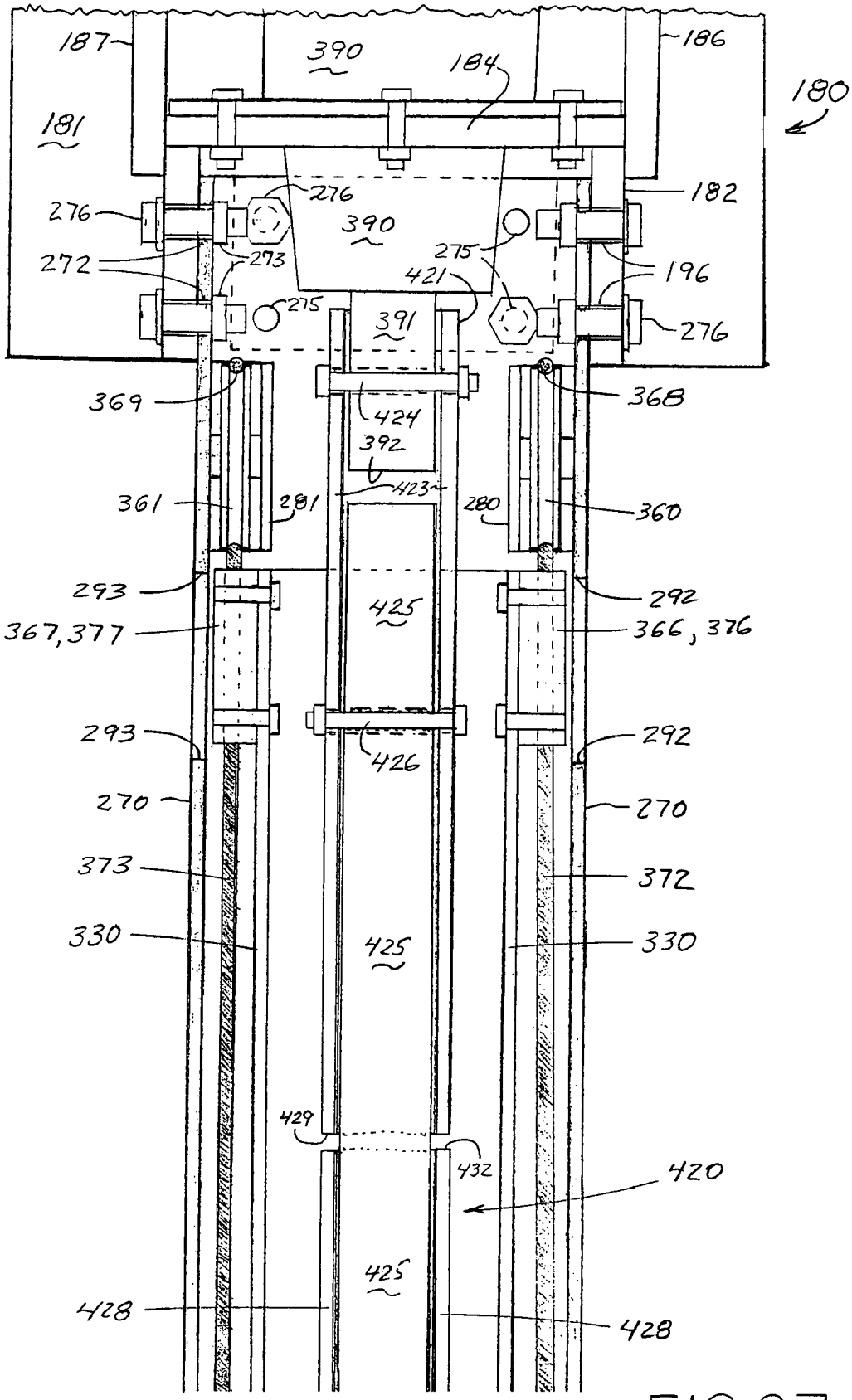
FIG. 27 is an enlarged detailed view, in cross section, looking in the aft direction of a portion of the sled, the outer and inner kelly sections, the kelly cables and sheaves therefor, and telescopic shaft means of a first embodiment of this invention.

In one embodiment of this invention, illustrated in FIGS. 25, 26 and 27, sled 180 comprises:

the sled base plate 181, spaced apart parallel longitudinal lower walls 182 and 183 welded to and perpendicular to sled base plate 181, a lateral rotary motor mounting plate 184 welded to and perpendicular to sled base plate 181 and walls 182 and 183, and spaced apart parallel longitudinal upper walls 186 and 187 welded to and perpendicular to sled plate 181, mounting plate 184 and longitudinal lower walls 182 and 183.

As shown in the schematic representations of a sled driving means in FIG. 9 the first end 239 and the second end 240 of cable 238 are secured to sled base plate 181.

A tie-down block 190 with a semicircular channel is welded to an underside 194 of sled base plate 181. An associated tie-down block 191 with a matching semicircular channel and with a series of internally threaded holes, and a series of fasteners 192 provide a tie-down means for securing a first end 239 of cable 238 to sled base plate 181.

The second end of 240 of the cable is attached to an adjustment means 193 for adjusting the tension in cable 238 and for easily maintaining effective tautness in the flexible connection system without re-anchoring cable 238 between tie-down blocks 190 and 191. Adjustment means 193 is welded to underside 194 of sled base plate 181.

Outer Kelly Section

As mentioned above outer kelly section 270 is secured at upper or first end 271 thereof to sled 180 in a non-rotational relationship as further illustrated in FIG. 27.

In this embodiment, outer kelly section 270 contains bolt holes 272 in each side proximate the first end 271 with nuts 273 welded to the inside wall surface of the outer kelly section in line with bolt holes 272. Nuts 273 are also aligned with bolt holes 196 in walls 182 and 183 of sled 180.

Sled 180 also has a spacer block 197 welded to sled base plate 181 between walls 182 and 183. Spacer block 197 positions outer kelly section 270 a predetermined distance away from fore face 177 of mast 160; see FIG. 26.

Block 197 has internally threaded bolt holes 198. Aft facing wall 274 of outer kelly section 270 proximate first end 271 thereof has bolt holes 275 that are aligned with internally threaded bolt holes 198 in block 197. Fasteners 276 secure the upper or first end 271 of outer kelly section 270 to sled walls 182 and 183 and aft facing wall 274 of outer kelly section 270 to spacer block 197.

Kelly Section Extension System

Figure 28:
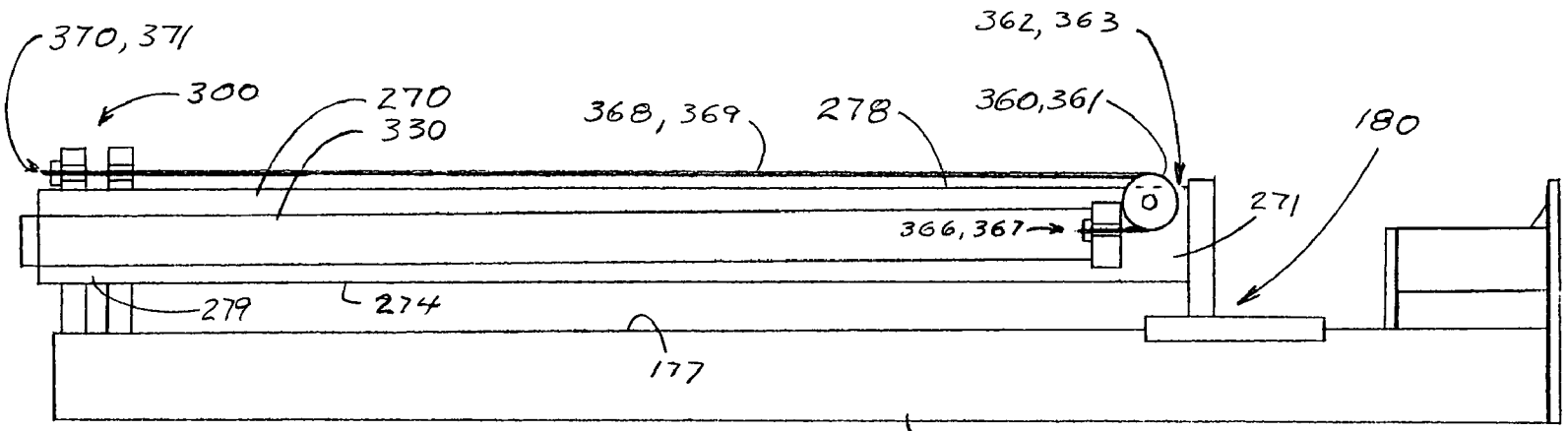
FIG. 28 is a schematic elevational view of the kelly extension system upcrowd mechanism of this invention.
Figure 29:
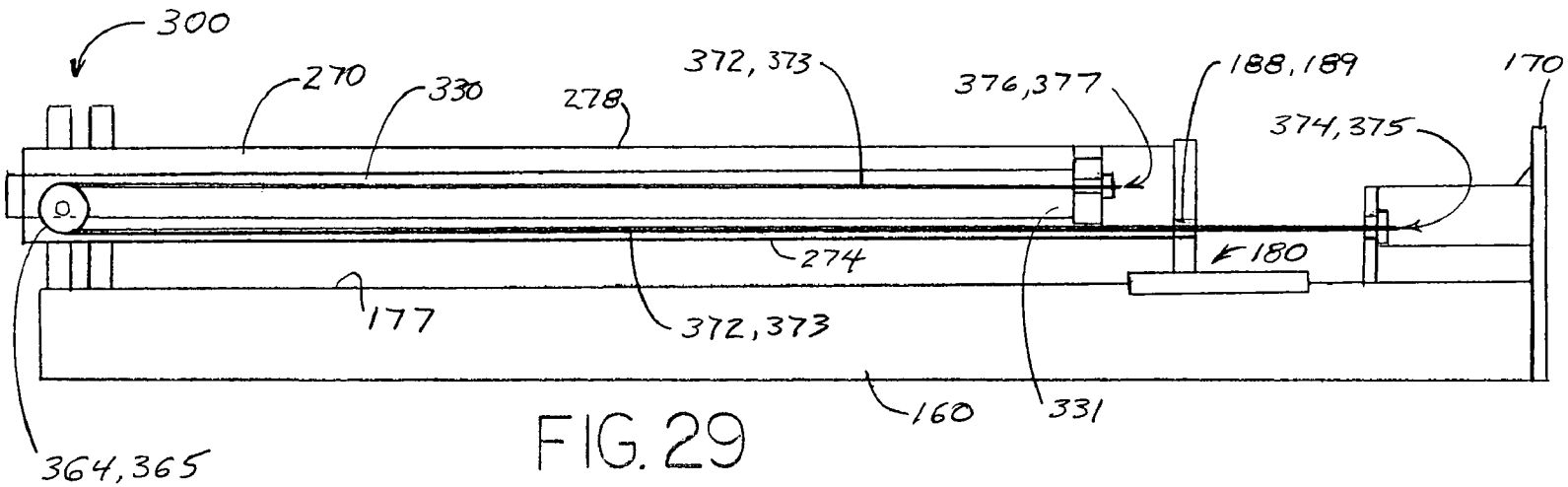
FIG. 29 is a schematic elevational view of the kelly extension system downcrowd mechanism of this invention.
Figure 30:
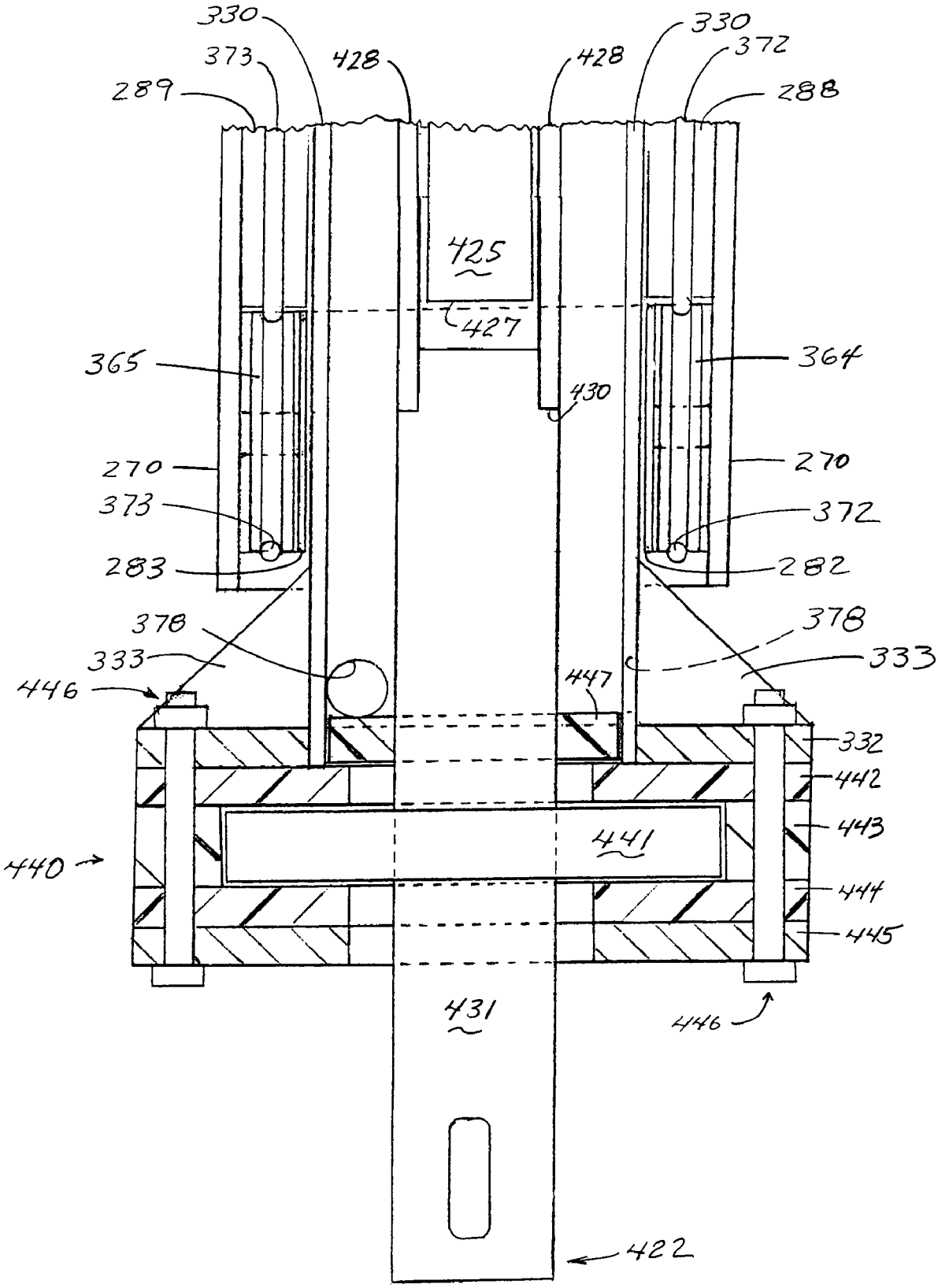
FIG. 30 is an enlarged detailed view, in cross section, looking in the aft direction of a portion of the outer and inner kelly sections, the lower centralizers, the telescopic shaft means, and the lower shaft bearing assembly of the first embodiment of FIG. 27.
Figure 34:
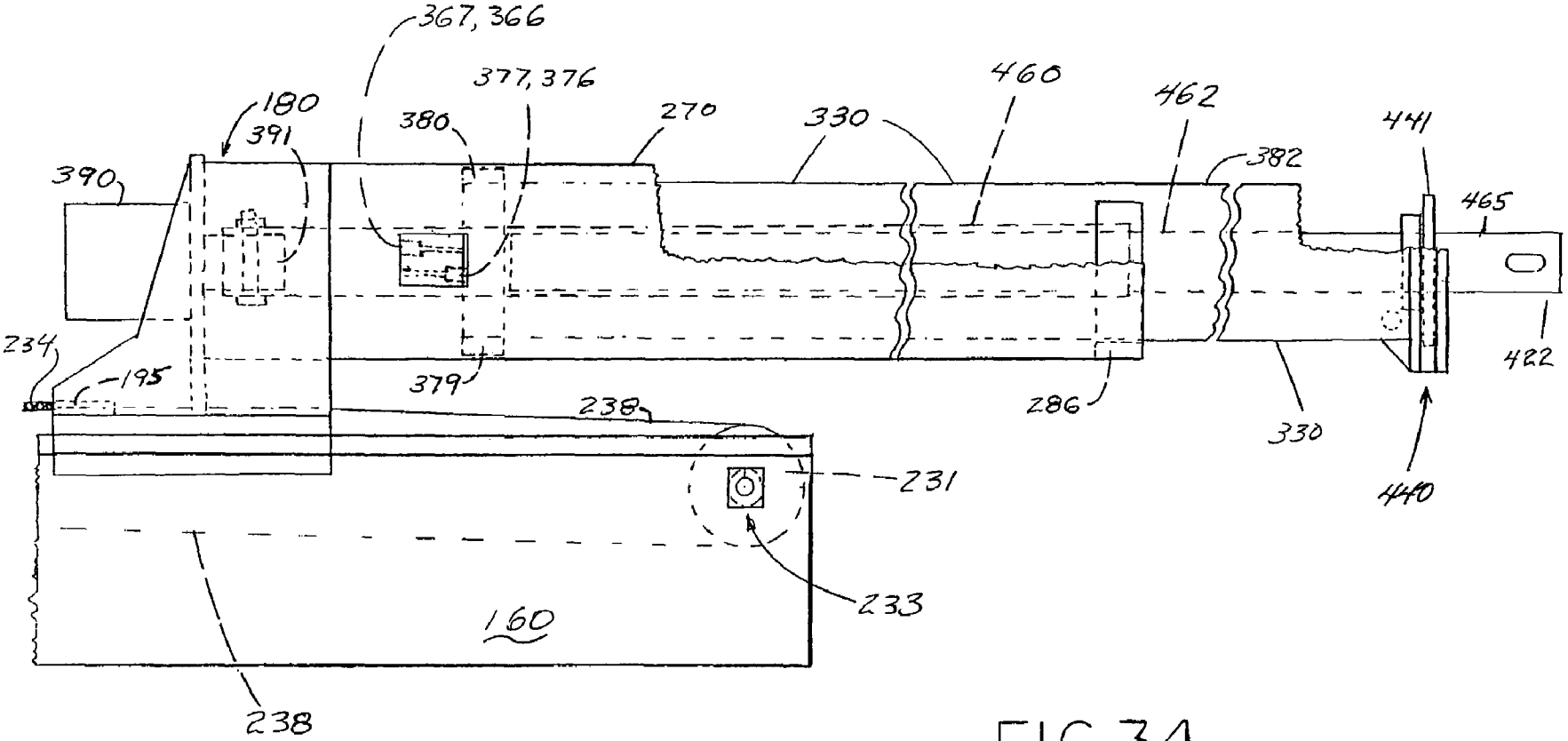
FIG. 34 is a schematic elevational view, greatly foreshortened, of the centralizers on the outer and inner kelly sections for the second embodiment of FIGS. 31 and 32.

In this embodiment of this invention a kelly section extension system is illustrated schematically in FIGS. 28, 29 and 34 and in more detail in FIGS. 14, 27 and 30. Schematically represented in FIGS. 28 and 29 are mast 160 having attached thereto upper end plate 170 and outer kelly section lower slide bushing assembly means 300. Sled 180 is schematically represented as slidably mounted on outer kelly section 270. Inner kelly section 330 is axially centered in outer kelly section 270 the details of which will be disclosed later below.

The kelly section extension system comprises upper sheaves 360 and 361 independently rotatably mounted inside outer kelly section 270 but on opposite walls thereof proximate an upper end 271 thereof. A small portion of each upper sheaves 360 and 361 protrudes through small openings 362 and 363, respectively in the fore face 278 of outer kelly section 270.

Where two element numbers separated by a comma are shown in FIGS. 28 and 29, the second element number is on the opposite side of the apparatus. Accordingly, views of the opposite sides of those shown in FIGS. 28 and 29 if schematically represented would merely be the mirror image of FIGS. 28 and 29.

Lower sheaves 364 and 365 are independently rotatably mounted on the inside surface of outer kelly section 270 but on opposite sides thereof proximate the lower end 279 of the outer kelly section.

Tie-down blocks 366 and 367 are attached to opposite outside side walls of inner kelly section 330 proximate an upper end 331 thereof. Upcrowd cables 368 and 369 are securely anchored to tie-down blocks 366 and 367, respectively, and to the housing of outer kelly section lower slide bushing assembly means 300 with tie-down means 370 and 371, respectively. Tie-down means 370 and 371 are spaced apart on a fore portion of the housing of lower slide bushing assembly means 300. Portions of downcrowd cables 368 and 369 are always outside of fore face 278 of outer kelly section 270.

Tie-down blocks 376 and 377 are attached to opposite outside side walls of inner kelly section 330 proximate the upper end 331 thereof. Downcrowd cables 372 and 373 pass through passageways 188 and 189, respectively, in rotary motor mounting plate of sled 180, and are securely anchored to tie-down blocks 376 and 377, respectively, and to an upper end plate 170 of mast 160 with tie-down means 374 and 375, respectively.

When sled 180 is fully upcrowded with respect to mast 160, tie-down blocks 366 and 376 are accessible through window 292 in one side of outer kelly section 270, and tie-down blocks 367 and 377 are accessible through window 293 in the other side of outer kelly section 270.

Upcrowd cables 368 and 369 and downcrowd cables 372 and 373 are made taut before they are finally anchored.

As can be appreciated from FIG. 29, the kelly section extension system forces the inner kelly section 330 to downcrowd two inches relative to mast 160 for every one inch that sled 180 is downcrowded relative to mast 160.

Likewise, as can be appreciated from FIG. 28, the kelly section extension system forces the inner kelly section 330 to upcrowd two inches relative to mast 160 for every one inch that sled 180 is upcrowded relative to mast 160.

It can also be appreciated that slippage between outer kelly section 270 and inner kelly section 330 is prevented by the kelly section extension system of this invention.

It can further be appreciated that slippage of outer and inner kelly sections relative to mast 160 is prevented by the kelly section extension system of this invention in combination with the sled driving means of this invention.

One improvement of the kelly section extension system of this invention is that it does not require a reel for the collection and storage of cable or chain to downcrowd or upcrowd the inner kelly section relative to the outer kelly section, or to downcrowd or upcrowd the sled and outer kelly section relative to the mast.

Upper sheaves 360 and 361 are independently rotatably mounted between the inside of outer kelly section 270 and internal housing members 280 and 281, respectively, as illustrated in more detail in FIG. 27.

Lower sheaves 364 and 365 are independently rotatably mounted between inside outer kelly section 270 and internal housing members 282 and 283, respectively, as illustrated in FIG. 30.

The lower end of inner kelly section 330, when fully upcrowded relative to outer kelly section 270, extends slightly below outer kelly section 270, as illustrated in FIG. 30.

In one embodiment of this invention tie-down block 366 also serves as tie-down block 376 for downcrowd cable 372, and tie-down block 367 also serves as tie-down block 377 for downcrowd cable 373. These tie-down blocks preferably also function as the centralizer means as described later below.

FIGS. 14, 27 and 30 also illustrates portions of upcrowd cables 368 and 369 and downcrowd cables 372 and 373.

In this embodiment of this invention when sled 180 is downcrowded 10 feet relative to mast 160, inner kelly section 330 is downcrowded 20 feet relative to mast 160.

Telescopic Shaft Means

FIGS. 27 and 30 also illustrate one embodiment of the telescopic shaft means 420 of this invention. In this embodiment rotary motor 390 has a shaft 391 that has a square cross section. The telescopic shaft means 420 comprises a shaft adapter 423 with a square cross section coupled to shaft 391 with a pin 424. Shaft adapter 423, which is relatively short compared to inner kelly section 330, is coupled to a smaller inner and upper kelly bar shaft 425 having a square cross section with a pin 426. Upper kelly bar shaft 425 has a lower end 427 that extends to nearly the lower end 279 of outer kelly section 270. The coupled length of adapter 423 and upper shaft 425 is about the same length as inner kelly section 330.

A larger outer and lower kelly bar shaft 428 with a square cross section is slidably mounted over smaller kelly bar shaft 425. An upper end 432 of lower kelly bar shaft 428, when sled 180 is fully upcrowded, is preferably a fraction of an inch below a lower end 429 of shaft adapter 423. A lower end 430 of lower kelly bar shaft 428 is welded to a tool receiver bar 431. The end of tool receiver bar 431 is the lower end 422 of the telescopic shaft means 420 in this embodiment.

Lower Shaft Alignment Assembly

As illustrated in FIG. 30, tool receiver 431 is rotatably mounted in and supported by a lower shaft alignment assembly 440.

Lower shaft alignment assembly 440 comprises an inner kelly section foot plate 332 welded to the lower end of inner kelly section 330, a plurality of radially extending gusset members 333 welded to kelly foot plate 332 and to the lower end of inner kelly section 330, and a disk bearing 441 welded to tool receiver bar 431.

Lower shaft alignment assembly 440 further comprises annular members 442, 443 and 444 made of low friction materials, and a confinement member 445 all of which are in axial alignment with inner kelly section 330, which is in axial alignment with shaft 391 of rotary motor 390. A series of fasteners 446 compresses members 442, 443, 444 and 445 together against kelly foot plate 332. Thus, disk bearing 441 is constrained to axial rotation along the axis of inner kelly section 330 and shaft 391 at a fixed distance from kelly foot plate 332.

Accordingly, as inner kelly section 330 is downcrowded and upcrowded a distance relative to outer kelly section 270, lower kelly bar shaft 428 and tool receiver bar 431 are also downcrowded and upcrowded the same distance relative to upper kelly bar 425 shaft while at the same time kelly bar shafts 425 and 428 may, or may not, be rotating. This is possible in this invention because outer kelly bar shaft 428 is not coupled to inner kelly bar shaft 425 but only slidable mounted thereto. In this invention since outer kelly section 270 and inner kelly section 330 are non-rotating, a large upper or lower bearing for outer kelly section 270 or inner kelly section 330 is not required thereby greatly simplifying the excavation apparatus and eliminating the servicing of such bearings.

A plurality of spaced apart holes 378 through the wall of the lower end of inner kelly section 330 permits any debris that may be present to be spun out of inner kelly section 330 during unloading of excavated material from auger.

An annular member 447 for preventing debris from working into bushing assembly 440 is fitted to tool receiving bar 431 before installation of lower kelly bar shaft 428 into upper kelly bar shaft 427.

Preferably the members 442, 443, 444 and 447 are made from high abrasion resistant and low friction plastics such as a fluoropolymer. The clearances between disk bearing 441 and low friction members 442, 443 and 444 are preferably about 0.060 of an inch.

Alternative Telescopic Shaft Means Embodiment

An alternative embodiment of the telescopic shaft means is illustrated in FIGS. 31 and 32. In this embodiment rotary motor 390 has an output shaft 391 that is square shaped. Output shaft 391 drives outer and upper kelly bar shaft 460 which is prevented from separating from shaft 391 by pin 424. Kelly bar shaft 460 is about the same length as inner kelly section 330 and has a lower end 461 that extends to about the lower end 279 of outer kelly section 270.

A inner and lower kelly bar shaft 462 with a square cross section is slidably mounted into larger kelly bar 460. An upper end 463 of lower kelly bar shaft 462, when the sled 180 is fully upcrowded relative to mast 160, is preferably a fraction of an inch below a lower end 392 of shaft 391 of rotary motor 390. A lower end 464 of lower kelly bar shaft 462 is welded to a tool receiver bar 465. The end of tool receiver bar 465 is the lower end 422 of the telescopic shaft means 420 in this embodiment.

This embodiment of the telescopic shaft means is preferred over the embodiment illustrated in FIGS. 27 and 30 because it does not require a shaft adapter such as adapter 423 and because lower kelly bar shaft 462 can be closer to shaft 391 of rotary motor 390 and therefore can be longer than lower kelly bar shaft 428, thereby permitting greater overlap of the lower kelly bar with the upper kelly bar for all extensions.

Upper Shaft Alignment Assembly

Figure 33:
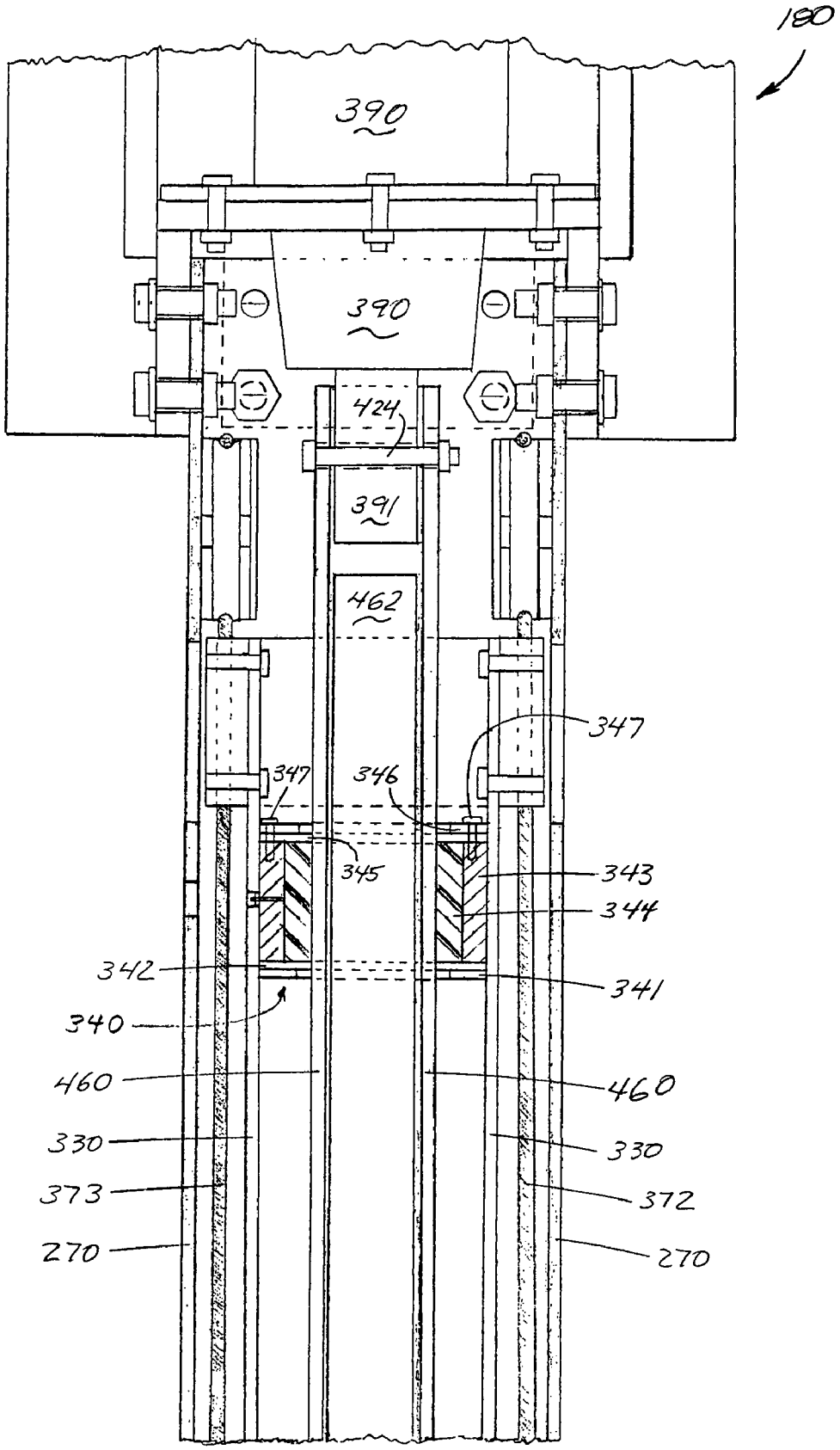
FIG. 33 is a detailed view similar to FIG. 32 but with an optional upper telescopic shaft alignment means.

In a further embodiment of this invention an upper shaft alignment assembly is provided if needed to prevent misalignment of the telescopic shaft means with rotary motor 390. This feature can be added if desired to various embodiments and variations of this invention. For example, as illustrated in FIG. 33 an upper shaft alignment assembly 340 is attached to inner kelly section 330 below tie-down blocks 366, 367, 376 and 377.

Bushing assembly 340 comprises a lower retainer ring 341 attached to inner kelly section 330, a lower gasket 342, a bushing housing 343 attached to the inner kelly section, a bushing 344 rotatably mounted in housing 344, an upper gasket 345, and an upper retainer ring 346 attached to bushing housing 343.

Lower retainer ring 341 and bushing housing 343 are preferably welded to the inner kelly section.

Gaskets 342 and 345 are made from a resilient material and have a square shaped central opening that fits snugly around upper kelly bar shaft 462 and a circular outside diameter that rotates freely within assembly 340.

Upper retainer ring 346 attached to bushing housing with a plurality of small bolts 347. Retainer rings 342 and 346 have a central circular opening that allows square shaped upper kelly bar shaft 462 to rotate freely therein.

Bushing 344 has a square-shape central opening that fits around outer squared-shaped shaft 462 and a cylindrical outside diameter. Housing 343 has a cylindrical axial cavity that allows bushing 344 to rotate freely therein while maintaining shaft 462 in axial alignment with rotary motor 390. A grease fitting 348 permits lubrication of the cylindrical surfaces between housing 343 and bushing 344 through an access port 284 in outer kelly section 270.

Preferably bushing 344 is made from high abrasion resistant and low friction plastics such as a fluoropolymer. The clearance between bushing housing 343 and bushing 344 is preferably about 0.060 of an inch.

Bushing assembly 340 can be attached to inner kelly section 330 at any point that permits assembly 340 to fit around outer kelly bar shaft 460.

An upper shaft alignment assembly, however, is not believed to be necessary in most embodiments of this invention.

Inner Kelly Section Centralizers

As illustrated schematically in FIGS. 28, 29 and 34 and in more detail in FIGS. 14, 27 and 30, tie-down blocks 366, 367, 376 and 377 attached to the upper end of inner kelly section 330 also function as centralizer means for centering the upper end of inner kelly section 330 between the sides of outer kelly section 270.

Aft and fore centralizer blocks 379 and 380, respectively, that are attached to the upper end of aft and fore faces 381 and 382, respectively, of inner kelly section 330, center the upper end of inner kelly section 330 between the aft and fore walls of outer kelly section 270.

Therefore upper blocks 366, 367, 376, 377, 379 and 380, which are at the same elevation, maintain inner kelly section 330 centered within outer kelly section 270 at the upper end of outer kelly section 270.

At the lower end of outer kelly section 270, aft and fore centralizer blocks 286 and 287 are attached to aft and fore inside walls of outer kelly section 270, respectively as illustrated in FIGS. 14 and 34.

Side centralizer blocks 288 and 289 are attached to the inside side walls of outer kelly section 270 proximate aft centralizer block 286, and side centralizer blocks 290 and 291 are attached to the inside side walls of outer kelly section 270 proximate fore centralizer block 287. Lower blocks 286, 287, 288, 289, 290 and 291 are at the same elevation and maintain inner kelly section 330 centered within outer kelly section 270 at the lower end of the outer kelly section. Thus the upper and lower centralizer blocks allow the inner kelly section to move within the outer kelly section while maintaining the axes of the kelly sections coaxial.

The spaces between blocks 286 and 288, and 288 and 290, provide passage for downcrowd cable 372. The spaces between blocks 286 and 289, and 289 and 291, provide passage for downcrowd cable 373.

Outer Kelly Section Lower Slide Bushing Assembly Means

Figure 35:
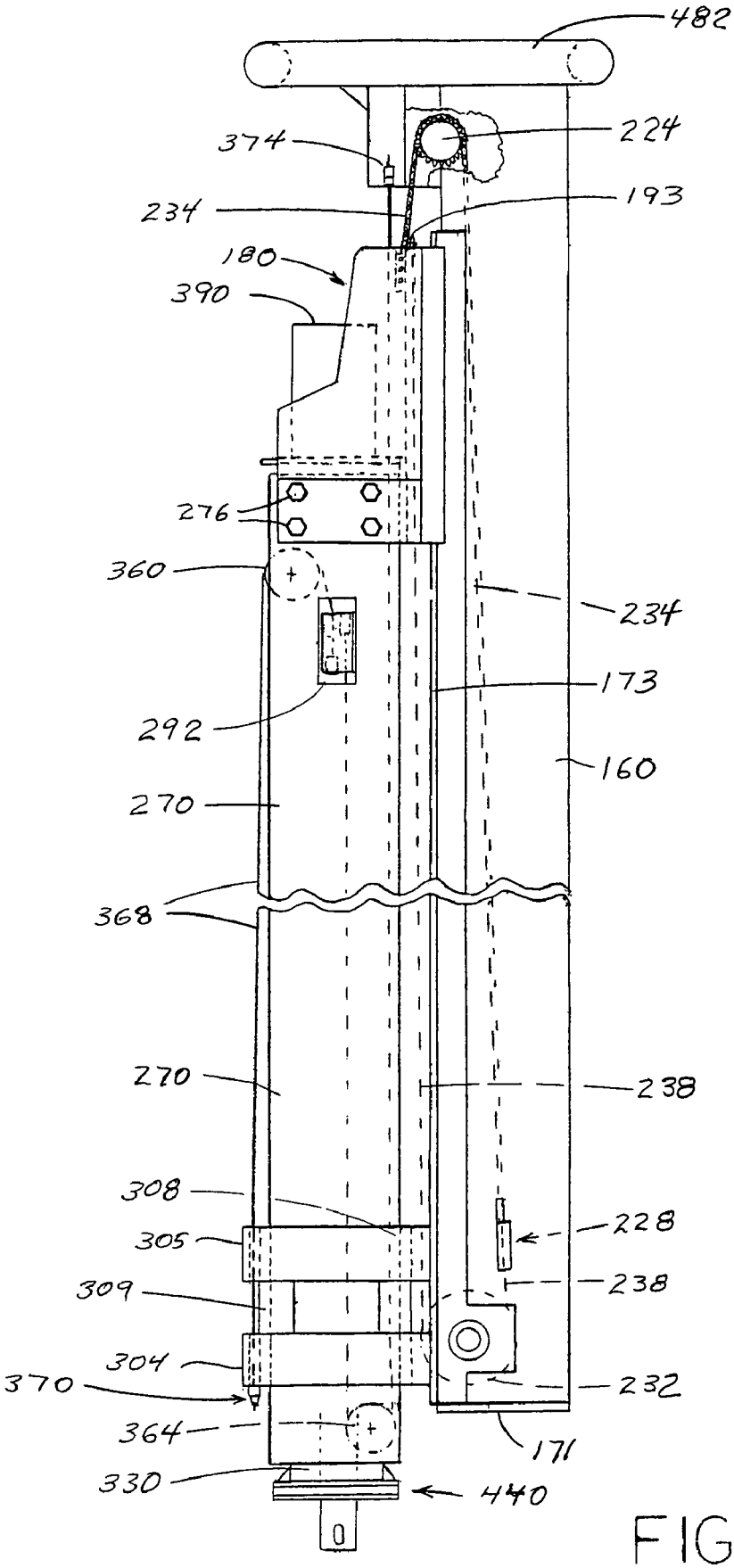
FIG. 35 is a schematic elevational view, greatly foreshortened, of the lower bushing assembly for the outer kelly section.

As illustrated in FIGS. 7A, 14 and 35, an outer kelly section slide bushing assembly means 300 is attached to the lower end of mast 160. Bushing assembly means 300 comprises traversely spaced apart parallel base members 302 and 303, and longitudinally spaced apart surrounding outer kelly section housings 304 and 305 welded to base members 302 and 303. Confined within kelly housings 304 and 305 are four flat bushing plates, namely side bushing plates 306 and 307, and aft and fore bushing plates 308 and 309, respectively, that surround outer kelly section 270.

The four bushing plates are rectangular with a thickness of about 0.75 inches and with sufficient width for providing a clearance of about 0.125 inches around outer kelly section 270. The axial length of housings 304 and 305 is about 6 inches and they are spaced about 6 inches apart. For a 12 inch outer kelly section the aft and fore bushing plates are about 14 inches by 18 inches and the two bushing plates are about 12.5 inches by 18 inches. The four plates are mounted inside of and span housings 304 and 305. Base members 302 and 303 are attached to mast 160 with a plurality of fasteners 301.

Bushing assembly means 300 maintains the lower end of outer kelly section 270 at the same predetermined distance away from mast 160 as that distance maintained by sled 180. The predetermined distance is sufficient to provide enough clearance for chain 234 and cable 238 to move unobstructively when downcrowding and upcrowding the sled.

Outer kelly section 270 is constrained to slidable movement through the bushing assembly means 300 in a direction parallel to the axis of mast 160 as sled 180 is downcrowded and upcrowded along mast 160.

Traversely spaced apart upcrowd cables 386 and 387 are anchored with tie-downs means 370 and 371, respectively, to kelly housing 304 of bushing assembly means 300 as illustrated in FIG. 14.

Bushing plates 306, 307, 308 and 309 are made from high abrasion resistant and low friction plastics such as a fluoropolymer.

Mast 160 also has a removable lower end plate 171 shown in FIG. 35 to protect sheaves 231 and 232 and other components of the sled driving means from being damaged. End plate 171 is attached to end flange 178 with fasteners through bolt holes 179 seen in FIG. 14.

In one embodiment of this invention illustrated in FIGS. 31 and 32 the lengths of the following components are:

mast 160 about 29.1 feet
outer kelly section 270 about 24 feet
inner kelly section 330 about 23.3 feet
upper kelly bar shaft 460 about 22 to 23 feet
lower kelly bar shaft 462 about 22 to 23 feet.

These components can be made from 0.375 inch wall thickness, square kelly bar steel stock, grade A-500, of the following stock sizes:

| | |
|---|---|
| mast | 12 inches |
| outer kelly section | 12 inches |
| inner kelly section | 8 inches |
| shaft 460 | 4 inches |
| shaft 462 | 3 inches. |

Other sizes can, of course, be used depending on the maximum depth and width or diameter of excavation and the number of inner kelly sections. In the illustrated embodiment only one inner kelly section is used; however, additional inner kelly sections can be used if desired.

EXAMPLES OF SUITABLE COMPONENTS

A Sweco 4 inch by 10 foot hydraulic cylinder actuators can be used for mast 160 downcrowd and upcrowd actuators 130 and 131.

A Sweco 4 inch by 18.5 inch hydraulic cylinder actuators can be used for tilting mast 160 in side-to-side tilt means 70.

A Reggianna #RR510DMC/136 Planetary Linde #HMR075 regulated hydraulic motor can be used for downcrowding and upcrowding sled 180.

Ten inch diameter sheaves can be used for the fixed sheaves 231 and 232 and traveling sheave 229, and cable 238 can be a 0.75 inch diameter in sled driving means 220.

Six inch diameter sheaves can be used for the upcrowd sheaves 362 and 363 and downcrowd sheaves 364 and 365, and cables 368, 369, 372 and 373 can be 0.625 inch diameter in the kelly section extension system.

A McMillan X14-KL2 hydraulic motor can be used as rotary motor 390 for rotating the telescopic shaft.

As mentioned above a number of components are preferably made from high abrasion resistant and low friction plastics such as a fluoropolymer. For example, in boom connector-to-mast slide bushing assemblies 100 and 110, components 101, 102, 103, 111, 112 and 113; in mast-to-sled slide bushing assemblies 200 and 210, components 201, 202, 203, 204, 211, 212, 213 and 214; in lower shaft alignment assembly 440, components 442, 443, 444 and 447; in upper shaft alignment assembly 340, bushing 344 and in slide bushing assembly means 300, bushing plates 306, 307, 308 and 309. An example of a high abrasion resistant and low friction plastics such as a fluoropolymer is RULON® plastic material, stock shape designation UHMW. The RULON product can be used as a slide and rotary bushing material.

The excavation apparatus can be mounted on and operated and controlled from a Hitachi ZX-200LC tractor.

Torque Increasing Means—One Speed Transmission

Referring to FIGS. 7B and 32, in one embodiment of this invention a one speed transmission is attached to the inner kelly section foot plate 332 instead of the lower shaft alignment assembly 440. For example in FIG. 32 bearing elements 442, 443, 444 and 445 are not used and lower kelly bar shaft 462 is modified, in part by omitting the tool receiver bar 465 extension of shaft 462, for connection to a one speed transmission 600 shown in schematic FIGS. 36 and 37.

Drive shaft coupler 622 is pinned to a modified lower kelly bar shaft 462. Then the one speed transmission 600 is bolted to inner kelly section foot plate 332 and transmission input shaft 624 is pinned to coupler 622. Common axis 620 of transmission 600 is in alignment with the axis of shaft 462.

One speed transmission 600 and most of its rotating components have a common axis 620. An exception is the six axes of the planet gears 632. The input shaft 624 has mounted thereon a sun gear 628 causing it to rotate at the RPM of input shaft 624, i.e. at the input RPM to the transmission.

Sun gear 628 engages the twelve planet gears 632, which are arranged in two rows of six gears each, causing the planet gears to rotate about their six respective pins or spindles 636. Pins 636, which are spaced 60° apart, are mounted in a rotatable planet gear carrier housing 640. Housing 640 is mounted on and drives output shaft 644. Pins 636 having a flanged top 637 are secured in housing 640 by pin retainers 638 and retainer ring 690.

The two rows of planet gears 32 engage two stationary ring gears 648, respectively, that are fixed to transmission case 652 with plug welds 653. The rotation of planet gears 632 causes their pins 636 to orbit about the common axis 620, thereby causing housing 640 to rotate which then drives output shaft 644 at a RPM which is lower than the input RPM to shaft 624. A preferred ratio of input RPM to output RPM is about 3/1. The output RPM depends on the ratio of the number of gear teeth on sun gear 628 and ring gears 648.

An intermediate thrust bearing 656 between input shaft 624 and output shaft 644 prevents shaft 624 from grinding into shaft 644.

Figure 37:
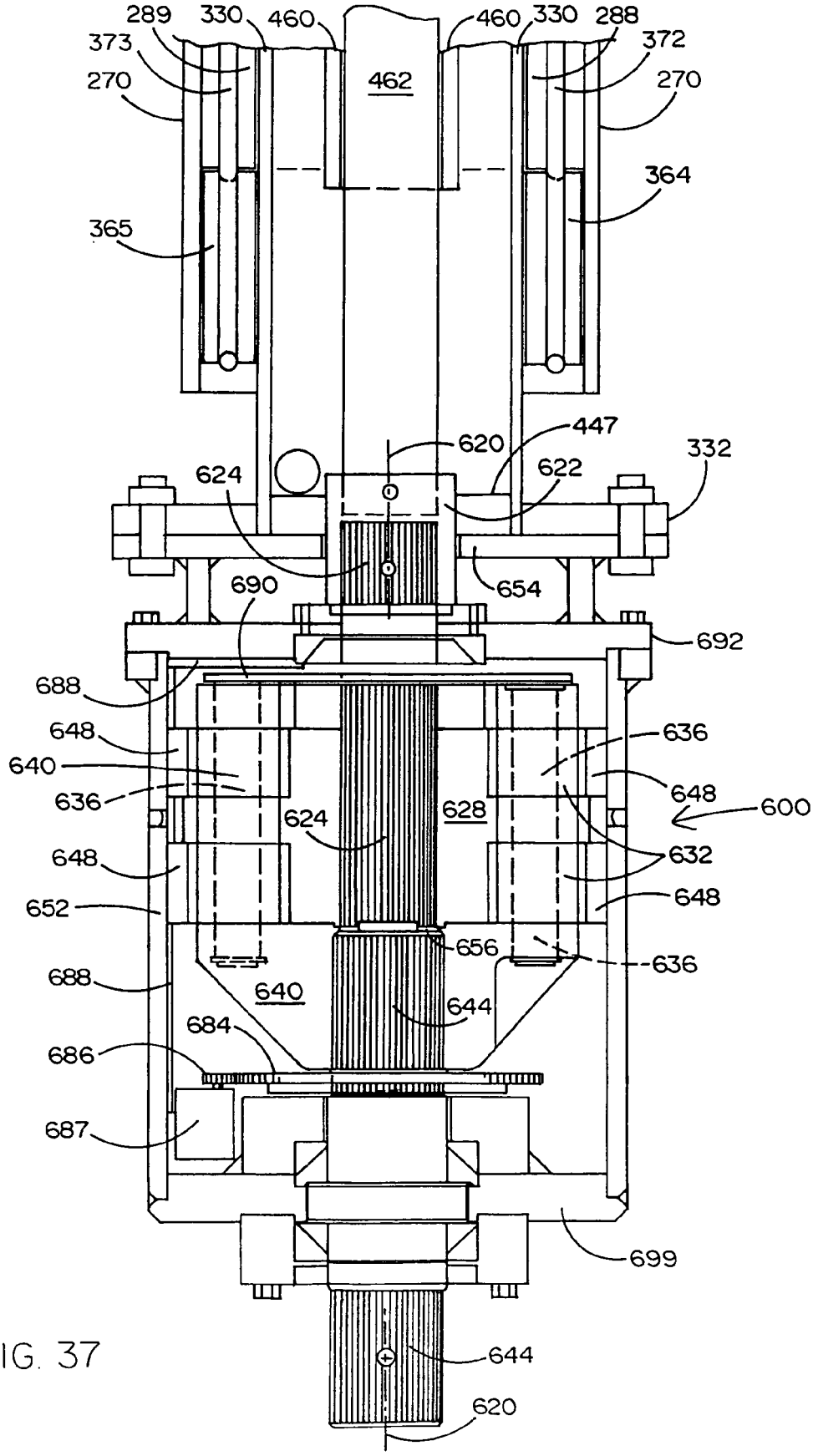
FIG. 37 is the transmission of FIG. 36 connected to the lower end of inner kelly section of FIG. 32.

Drive shaft coupler 622 is pinned to lower kelly bar shaft 462 as illustrated in FIG. 37. Next the adapter plate 654 of the one speed transmission 600 is bolted directly to inner kelly foot plate 332 and transmission input shaft 624 is pinned to coupler 622.

Transmission 600 is self lubricating and requires no external lubricant-transporting hoses to and from the transmission. Oil pump driver gear 684, which is driven by output shaft 644, powers oil pump driven gear 686 and causes pump 687 to pump transmission fluid up through oil delivery tube 688 to upper bearing oil director 689 located above the top of retainer ring 690 for lubricating Timken® tapered roller bearing 691, all gears therebelow, and planet gear carrier housing 640.

Bearing 691 is held by upper plate housing 692 which is bolted to the upper flange of transmission case 652. A seal and retainer flange assembly 693 seals and secures bearing 691 to upper plate housing 692.

The amount of transmission fluid should be sufficient to cover the top of housing 640 so that the sun gear and planet gears are always covered with transmission fluid. Thus it can be seen that transmission 600 is a sealed unit and require no transmission fluid to be pumped externally into and out of the transmission.

Other components of transmission 600 includes lower thrust flange 694 between lower Timken® roller bearings 695 and 696, held by lower plate with bearing housing 697 and housing seal 698 that are secured and supported by lower plate housing 699.

Two Speed Transmission

In another embodiment of this invention a two speed transmission is attached to the inner kelly section foot plate 332 instead of the lower shaft alignment assembly 440 seen for example in FIGS. 7B and 32. As in the case of the one speed transmission 600, bearing elements 442, 443, 444 and 445 are not used and lower kelly bar shaft 462 is modified, in part by omitting the tool receiver bar 465 extension of shaft 462, for connection to a two speed transmission 700 shown in schematic FIGS. 38 and 39.

Figure 38:
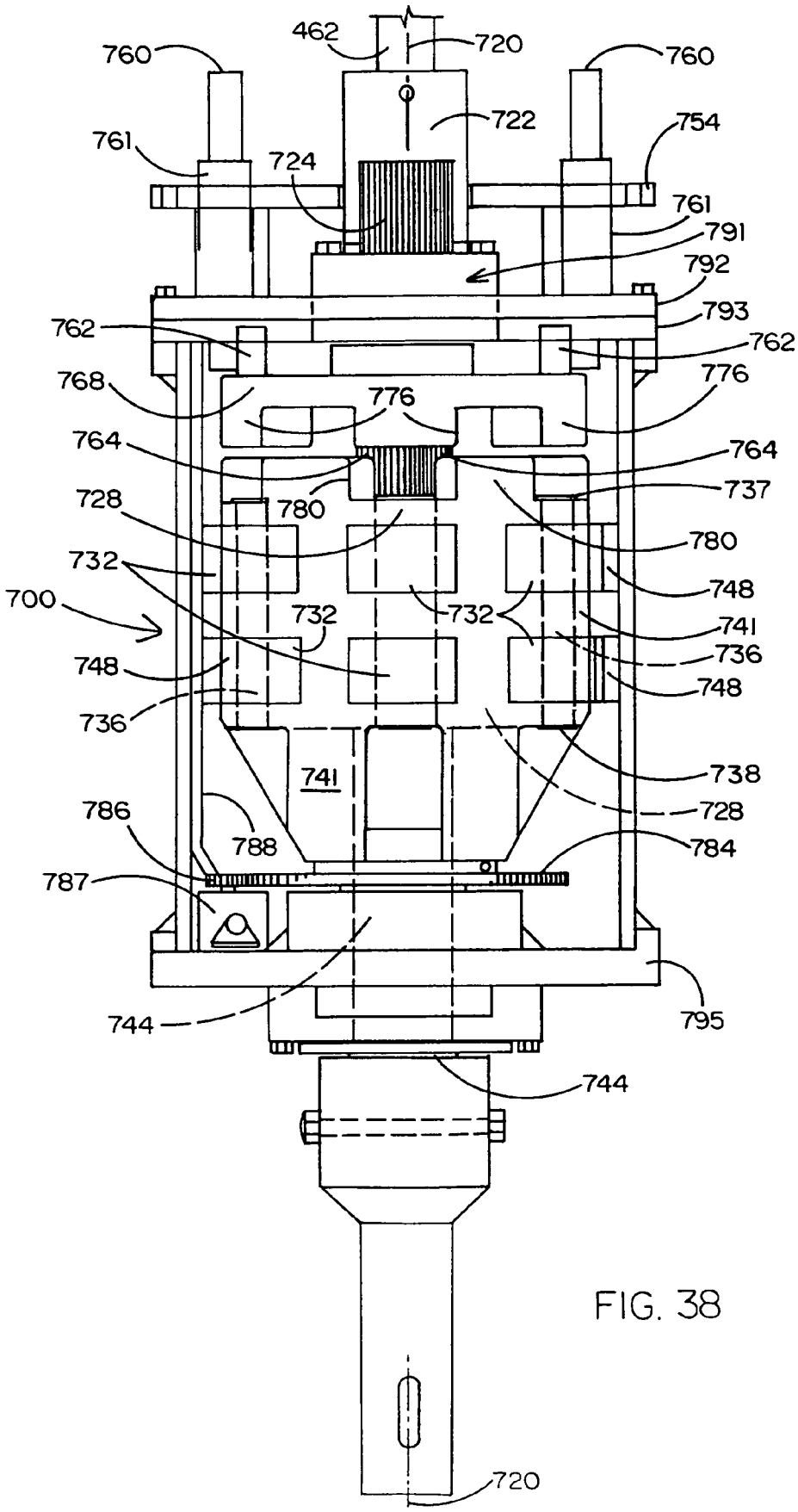
FIG. 38 is a two speed transmission.
Figure 39:
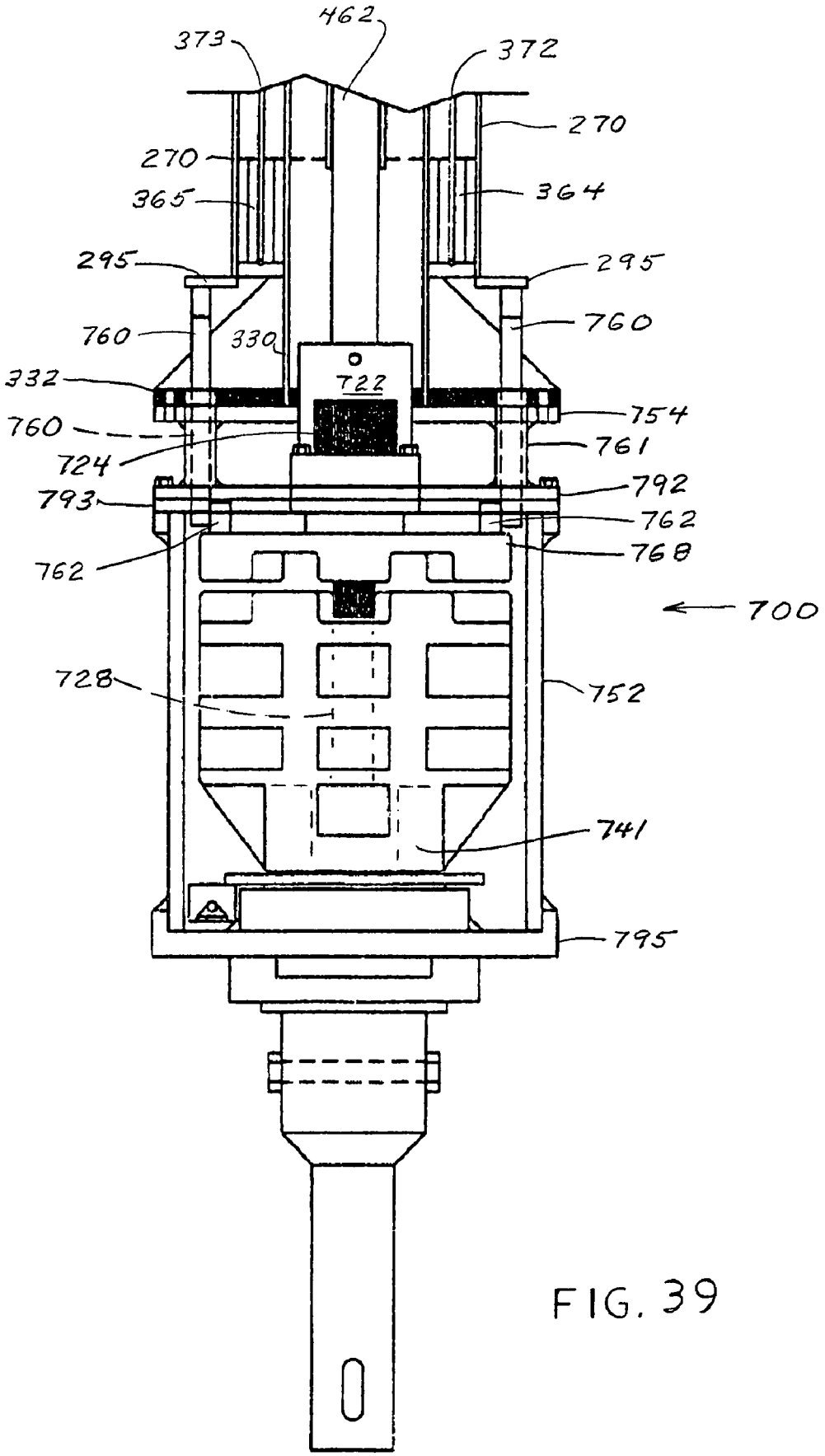
FIG. 39 is the transmission of FIG. 38 connected to the lower end of inner kelly section of FIG. 32.

FIGS. 38 and 39 illustrate a two speed transmission 700 with the transmission in low gear. When in low gear the two speed transmission 700 functions in a similar manner as one speed transmission 600.

As illustrated in FIG. 38, when shifter rods 760 are not depressed a drive plate standoff spring 764 prevents upper engagement dogs 776 of upper direct drive plate 768 from engaging lower engagement dogs 780 of planet gear carrier housing 741, thereby preventing the transmission from being in direct drive.

As illustrated in FIG. 39, drive shaft coupler 722 is pinned to a modified lower kelly bar shaft 462. Two speed transmission 700 is bolted to inner kelly section foot plate 332 and transmission input shaft 724 is pinned to coupler 722. Common axis 720 of transmission 700 is in alignment with the axis of shaft 462.

Two speed transmission 700 and most of its rotating components have a common axis 720. An exception is the six axes of the planet gears 732. The input shaft 724 has mounted thereon a sun gear 728 causing it to rotate at the RPM of input shaft 724, i.e. at the input RPM to the transmission. Sun gear 728 is inside of carrier housing 741 as indicated in FIG. 38.

FIG. 38 illustrates the internal configuration of the two speed transmission 700 when shifter rods 760 are fully extended thereby enabling the transmission to be in low gear and accordingly operable for delivering increased torque to the transmission output shaft 744. As mentioned before, when in low gear two speed transmission 700 operates like one speed transmission 600 described earlier.

Briefly, sun gear 728 engages the twelve planet gears 732, which are arranged in two rows of six gears each, causing the planet gears to rotate about their six respective pins or spindles 736. Pins 736, which are spaced 60° apart and are mounted in carrier housing 741. Carrier housing 741 is mounted on and drives output shaft 744. Pins 736, which have flanged tops 737, are secured in housing 741 by pin retainers 738.

Figure 36:
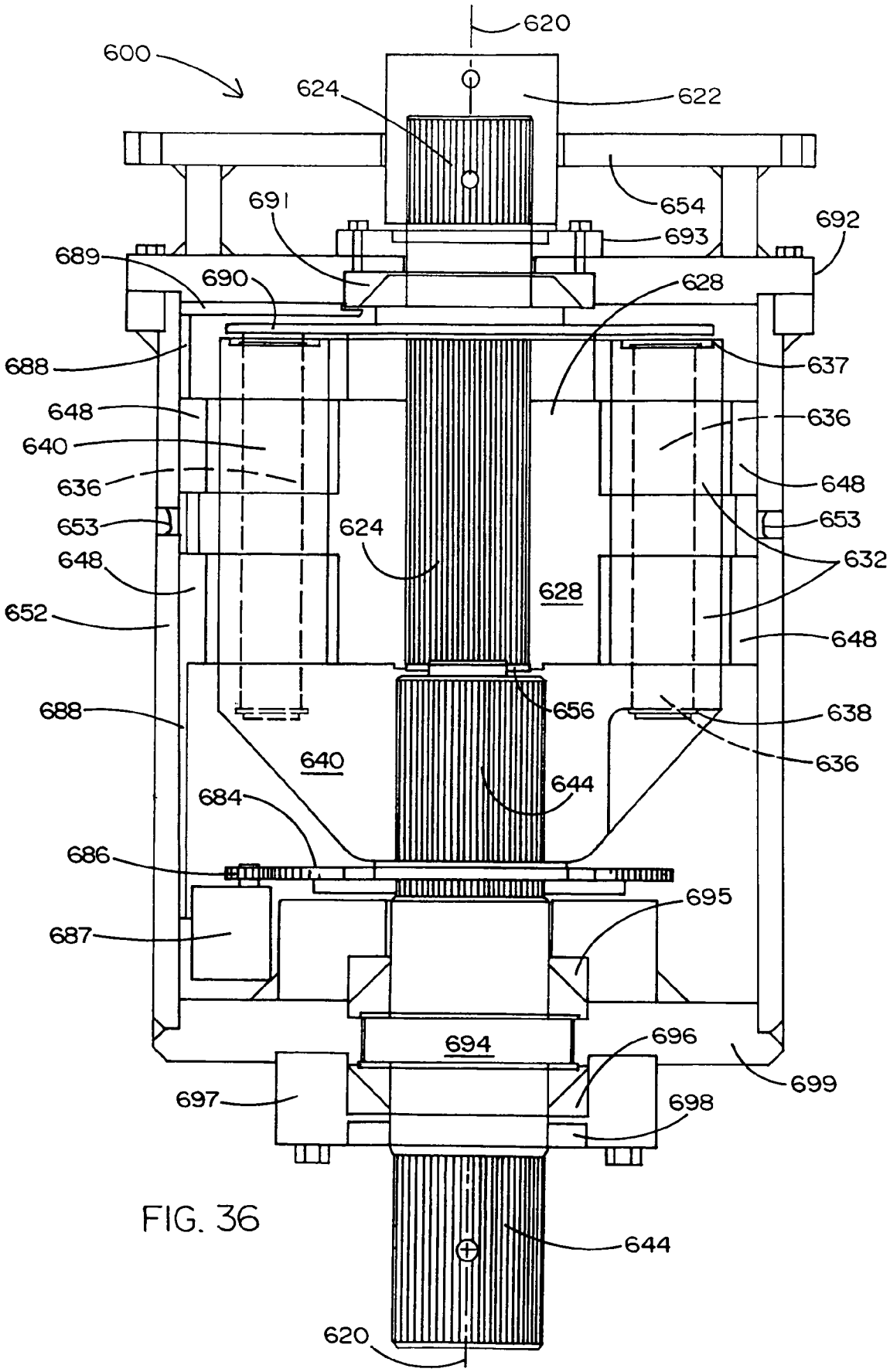
FIG. 36 is a one speed direct drive transmission.

As in the case of the one speed transmission of FIGS. 36 and 37, the two rows of planet gears 732 also engage two stationary ring gears 748 that are fixed to transmission case 752 with plug welds. The rotation of planet gears 732 causes their pins 736 to orbit about common axis 720, thereby causing housing 741 to rotate which then drives output shaft 744 at a RPM which is lower than the input RPM of input shaft 724. A preferred ratio of input RPM to output RPM is about 3/1. The output RPM depends on the ratio of the number of gear teeth on sun gear 728 and ring gears 748.

As in the case of one speed transmission 600 an intermediate thrust bearing between input shaft 724 and output shaft 744 prevents shaft 724 from grinding into shaft 744.

As in the case of one speed transmission 600, two speed transmission 700 is self lubricating and requires no external hoses for pumping transmission fluid to and from the transmission. Oil pump driver gear 784, which is driven by output shaft 744, powers oil pump driven gear 786 and causes pump 787 to pump transmission fluid up through oil delivery tube 788 to the top innermost part of the transmission for lubricating all gears and bearings.

The amount of transmission fluid should be sufficient to lubricate the entire transmission. Thus transmission 700 is a sealed unit that requires no transmission fluid to be pumped externally into and out of the transmission.

An upper bearing housing 791 is secured to an upper bearing plate 792 which is bolted to an upper plate housing 793 and an upper flange of transmission case 752. An upper Timken® tapered roller bearing is provided in housing 791 for input shaft 724.

As in the case of one speed transmission 600, two speed transmission 700 includes a Timken® taper roller bearing, a bearing housing, a seal, and a lower thrust flange for output shaft 744, all of which are supported by and secured to a lower plate housing 795, which is secured to transmission case 752.

The transmission is automatically shifted into direct drive when inner kelly section 330 is fully retracted into the outer kelly section 270. In such case-transmission shifter rods 760 will engage shifter rods abutments 295 that extend radially outwardly from outer kelly section 270 causing the shifter rods to be depressed downwardly into associated shifter rod guides 761 and causing the shifter rods to overpower drive plate standoff spring 764 and to engage associated shifter rollers 762, which engage upper direct drive plate 768. Direct drive plate 768 has upper engagement dogs 776 which are then forced downward and engage lower engagement dogs 780 which in turn causes carrier housing 741 to rotate at the same RPM as upper direct drive plate 768 thereby causing transmission output shaft 744 to rotate at the same RPM as the transmission input shaft 724. In such configuration transmission 700 is in high gear or direct drive and the result produced would be the same as if the transmission were not present but in a configuration equivalent to that of FIG. 32. Thus the two speed transmission has the advantage of providing greater torque for drilling and greater output shaft RPM for spin-off or discharge of excavated soil with the added advantage that both speeds are automatically shifted and without having to pump transmission fluid into and out of the downhole transmission.

Other Features

The excavation apparatus preferably has a service winch system 480 comprising a hydraulic powered winch with reel 481, a bridge 482 with sheaves 483 and 484 for deployment of a service cable 485, as illustrated in FIG. 7A. Winch 481 is mounted on the aft side of mast 160 above mounting brackets 142 and 143 for hydraulic cylinder actuators 130 and 131.

A Pullmaster M-8 hydraulic motor can be used as rotary motor 390 for service winch system 480.

OPERATIONAL EXAMPLE

The excavation on a sloping grade for preparing a foundation site for the installation of a microwave relay cell tower.

With the excavation apparatus mounted on a tractor at the site for excavation and auger attached to end 422 of shaft, the mast 160 and sled 180 are fully upcrowded. With boom connector 40 at a convenient height, the mast is positioned vertically over the site a small distance above the ground. The sled is downcrowded until the auger touches the ground. The auger is rotated in the excavation direction and the mast is then downcrowded to fill the auger with soil.

Rotation of the auger is stopped and the mast and sled are then fully upcrowded, thereby bringing the excavated soil above ground. The boom of the tractor is then swung over to a temporary soil accumulation site and the auger rotated in an unload direction, thereby unloading the soil.

The boom is then returned to the excavation site, the sled downcrowded to the bottom of the hole and auger rotation started. The mast is then downcrowded to excavate more soil. The process repeated until the desired depth of excavation is reached.

While the preferred embodiments of the present invention have been described, various changes, adaptations and modifications may be made thereto without departing from the spirit of the invention and the scope of the appended claims. The present disclosure and embodiments of this invention described herein are for purposes of illustration and example and modifications and improvements may be made thereto without departing from the spirit of the invention or from the scope of the claims. The claims, therefore, are to be accorded a range of equivalents commensurate in scope with the advances made over the art.

What is claimed is:

1. An excavation apparatus comprising:

a mast having a mast first end and a mast second end, and a mast planar surface;

a sled slidably mounted on the mast planar surface;

sled driving means supported by the mast for driving the sled along the mast planar surface from proximate the mast first end to proximate the mast second end, and for driving the sled back along the mast planar surface from proximate the mast second end to proximate the mast first end;

an outer kelly section attached to the sled, the outer kelly section having a first end and a second end such that the outer kelly section first end is nearer to mast first end than is the outer kelly section second end, the outer kelly section also having a straight longitudinal axis and a central longitudinal cavity;

outer kelly section bushing means secured to the mast proximate the mast second end for maintaining the outer kelly section in a slidable relationship relative to the outer kelly section bushing means, and for maintaining the longitudinal axis of the outer kelly section approximately parallel to the mast planar surface;

an inner kelly section having a first end and a second end such that the inner kelly section first end is nearer to outer kelly section first end than is the inner kelly section second end, the inner kelly section having a straight longitudinal axis and a central longitudinal cavity, and at least a longitudinal portion of the inner kelly section including the first end thereof are acceptable into the central longitudinal cavity of the outer kelly section;

extension and retraction means for extending and retracting the inner kelly section partially out of and partially back into the outer kelly section a proportional distance equal to at least about twice a distance that the sled is moved along the mast planar surface, and for preventing slippage of the inner kelly section relative to the outer kelly section;

rotary drive means attached to the sled and having a drive shaft having an axis, the rotary drive means connected to and rotates a telescopic shaft means, the telescopic shaft means for providing a variable length, the telescopic shaft means having a first end connected to the drive shaft of the rotary drive means, and a second end for attaching an excavation tool, wherein the telescopic shaft means is also for permitting the simultaneously extension and retraction of the telescopic shaft means as the inner kelly section extends from and retracts into the central longitudinal cavity of the outer kelly section, whereby, when the sled driving means is activated in a first direction the sled is driven towards the mast second end and the inner kelly section is extended out of the central longitudinal cavity of the outer kelly section, and whereby, when the sled driving means is activated in a second direction that is the opposite of the first direction the sled is driven towards the mast first end and the inner kelly section is retracted back into the central longitudinal cavity of the outer kelly section.

2. The excavation apparatus of claim 1, wherein the outer kelly section and the inner kelly section are non-rotational.

3. The excavation apparatus of claim 1, further comprising a second mast planar surface on the mast spaced apart from and approximately parallel to the first-mentioned mast planar surface;

boom connector means slidably mounted on the second mast planar surface, the boom connector means for attaching the mast to a boom; and means for downcrowding and upcrowding the mast on the boom connector.

4. The excavation apparatus of claim 1, further comprising:

a second mast planar surface on the mast spaced apart from and approximately parallel to the first-mentioned mast planar surface;

boom connector means for attaching the mast to a boom;

side to side tilt means supported by the boom connector means for tilting the mast to the left and to the right relative to the boom connector means; and means for downcrowding and upcrowding the mast on the boom connector.

5. The excavation apparatus of claim 1, wherein the mast has an annular cross section having a straight longitudinal axis and a central longitudinal cavity, wherein the mast straight longitudinal axis is approximately parallel to the straight longitudinal axis of the outer kelly section, wherein the sled driving means further comprises a rotary motor mounted on the mast proximate the mast first end for driving a flexible connection system attached to the sled, the flexible connection system spanning approximately between the mast first end and the mast second end.

6. The excavation apparatus of claim 5, wherein the flexible connection system comprises a sprocket gear driven by the rotary motor, a sheave rotatably supported by the mast proximate the mast second end, a chain effective for being driven by the sprocket gear, the chain having a first end connected to the sled and a second end being linked to a cable, the cable being connected to the sled, with the chain being tautly drawn over the sprocket gear and the cable being tautly drawn over the sheave and connected to the sled.

7. The excavation apparatus of claim 6, wherein the sprocket gear is a multisprocket gear and the chain is a multitrack chain corresponding to the sprocket gear.

8. The excavation apparatus of claim 7, wherein a portion of the sprocket gear is in the central longitudinal cavity of the mast and another portion is outside of the mast, wherein a portion of the sheave is in the central longitudinal cavity of the mast and another portion is outside of the mast, wherein a portion of the chain is in the central longitudinal cavity of the mast and another portion is outside of the mast, and wherein a portion of the cable is in the central longitudinal cavity of the mast and another portion is outside of the mast.

9. The excavation apparatus of claim 6, wherein the flexible connection system comprises a multisprocket gear driven by the rotary motor, a traveling sheave rotatably connected to a traveling yoke, a chain corresponding to the multisprocket gear and having a first end connected to the sled and a second end connected to the traveling yoke, a first sheave rotatably supported by the mast proximate the mast second end, a second sheave rotatably supported by the mast proximate the mast second end and axially aligned with the first sheave, and a cable having a first end connected to the sled and a second end, wherein the cable is drawn tightly over the first sheave, the traveling sheave, and the second sheave, and the second end of the cable then connected to the sled.

10. The excavation apparatus of claim 9, wherein a portion of the multisprocket gear and an axis thereof are in the central longitudinal cavity of the mast and another portion of the multisprocket gear protrudes outside of the mast, wherein a portion of the first sheave and an axis thereof are in the central longitudinal cavity of the mast and another portion of the first sheave protrudes outside of the mast, wherein a portion of the second sheave and an axis thereof are in the central longitudinal cavity of the mast and another portion of the second sheave protrudes outside of the mast, wherein a portion of the chain is in the central longitudinal cavity of the mast and another portion is outside of the mast, wherein a portion of the cable is in the central longitudinal cavity of the mast and another portion is outside of the mast, and wherein of the traveling sheave and the traveling yoke are entirely within the central longitudinal cavity of the mast.

11. The excavation apparatus of claim 1, further comprising centralizer means for maintaining the inner kelly section approximately centered longitudinally within the central longitudinal cavity of the outer kelly section and in an extendable and retractable relationship relative to the outer kelly section, and for maintaining the inner kelly section longitudinal axis parallel to the outer kelly section longitudinal axis.

12. The excavation apparatus of claim 1, wherein the cross sections of the outer kelly section and the inner kelly section are approximately square shaped.

13. The excavation apparatus of claim 1, wherein the extension and retraction means further comprises a downcrowd cable having a first end and a second end, a downcrowd sheave rotatably supported by the outer kelly section proximate the second end thereof, an upcrowd cable having a first end and a second end, and an upcrowd sheave rotatably supported by the outer kelly section proximate the first end thereof, wherein the first end of the downcrowd cable is tied down to the mast proximate first end thereof, wherein the second end of the downcrowd cable is tied down to the inner kelly section proximate the first end thereof, wherein the downcrowd cable is tautly drawn over the downcrowd sheave, wherein the first end of the upcrowd cable is tied down proximate to the mast or a member attached thereto proximate longitudinally the mast second end, wherein the second end of the downcrowd cable is tied down to the inner kelly section proximate the first end thereof, and wherein the upcrowd cable is tautly drawn over the upcrowd sheave.

14. The excavation apparatus of claim 13, wherein the downcrowd sheave is entirely in the central longitudinal cavity of the outer kelly section, and wherein a portion of the upcrowd sheave and an axis thereof are in the central longitudinal cavity of the outer kelly section and another portion of the upcrowd sheave protrudes outside of the outer kelly section.

15. The excavation apparatus of claim 13, wherein the first end of the upcrowd cable is tied down to the outer kelly section bushing means.

16. The excavation apparatus of claim 1, wherein the extension and retraction means further comprises a common cable having a first end and a second end, a downcrowd sheave rotatably supported by the outer kelly section proximate the second end thereof, and an upcrowd sheave rotatably supported by the outer kelly section proximate the first end thereof, wherein the first end of the common cable is tied down to the mast proximate to the first end thereof, wherein the second end of the common cable is tied down to the mast or a member attached thereto proximate longitudinally the mast second end, wherein the common cable is tautly drawn over the downcrowd sheave and the upcrowd sheave, and wherein the common cable is tied down to the inner kelly section proximate the first end thereof.

17. The excavation apparatus of claim 16, wherein the downcrowd sheave is entirely in the central longitudinal cavity of the outer kelly section, and wherein a portion of the upcrowd sheave and an axis thereof are in the central longitudinal cavity of the outer kelly section and another portion of the upcrowd sheave protrudes outside of the outer kelly section.

18. The excavation apparatus of claim 16, wherein the second end of the common cable is tied down to the outer kelly section bushing means.

19. The excavation apparatus of claim 1, wherein the outer kelly section bushing means secured to the mast proximate the mast second end is secured to the mast planar surface.

20. The excavation apparatus of claim 1, further comprising a transmission for increasing torque with an input shaft connected to the lower end of the telescopic shaft means and an output shaft for connection to an excavation tool.

21. The excavation apparatus of claim 1, wherein the inner kelly section comprises an inner kelly section end flange attached to the second end of the inner kelly section in axial alignment with the drive shaft of the rotary drive means, wherein the second alignment means secured to the inner kelly section second end further comprises a first annular bushing disk adjacent the inner kelly section end flange, an annular shaft disk adjacent the first annular bushing disk, the annular disk being attached to the telescopic shaft means proximate the second end thereof and in axial alignment therewith, a annular bushing ring circumferentially surrounding the annular shaft disk and adjacent the first annular bushing disk, a second annular bushing disk adjacent the annular shaft disk and first annular bushing disk, an annular final flange abutting the second annular bushing disk, means for securing the annular final flange, the second annular bushing disk, the annular bushing ring, and the first annular bushing disk to the inner kelly section flange, and for axially aligning the annular final flange, the annular shaft disk, the second annular bushing disk, the annular bushing ring, the annular shaft disk, and the first annular bushing disk with the inner kelly section end flange.

22. An excavation apparatus comprising:

a mast having a mast first end and a mast second end, and a mast planar surface;

a sled slidably mounted on the mast planar surface;

sled driving means supported by the mast for driving the sled along the mast planar surface from proximate the mast first end to proximate the mast second end, and for driving the sled back along the mast planar surface from proximate the mast second end to proximate the mast first end;

an outer kelly section attached to the sled, the outer kelly section having a first end and a second end such that the outer kelly section first end is nearer to mast first end than is the outer kelly section second end, the outer kelly section also having a straight longitudinal axis and a central longitudinal cavity;

outer kelly section bushing means secured to the mast proximate the mast second end for maintaining the outer kelly section in a slidable relationship relative to the outer kelly section bushing means and for maintaining the longitudinal axis of the outer kelly section approximately parallel to the mast planar surface;

an inner kelly section having a first end and a second end such that the inner kelly section first end is nearer to outer kelly section first end than is the inner kelly section second end, the inner kelly section having a straight longitudinal axis and a central longitudinal cavity, and at least a longitudinal portion of the inner kelly section including the first end thereof are acceptable into the central longitudinal cavity of the outer kelly section;

centralizer means for maintaining the inner kelly section approximately centered longitudinally within the central longitudinal cavity of the outer kelly section and in an extendable and retractable relationship relative to the outer kelly section, and for maintaining the inner kelly section longitudinal axis parallel to the outer kelly section longitudinal axis;

extension and retraction means for extending and retracting the inner kelly section partially out of and partially back into the outer kelly section a proportional distance equal to at least about twice a distance that the sled is moved along the mast planar surface, and for preventing slippage of the inner kelly section relative to the outer kelly section;

rotary drive means attached to the sled and having a drive shaft having an axis, the rotary drive means connected to and rotates a telescopic shaft means, the telescopic shaft means for providing a variable length, the telescopic shaft means having a first end connected to the drive shaft of the rotary drive means, and a second end for attaching an excavation tool, alignment means secured to the inner kelly section second end, the alignment means for rotatably supporting the telescopic shaft means in axial alignment with the drive shaft of the rotary drive means and for maintaining the second end of the telescopic shaft means at a set longitudinal distance outside of the second end of the inner kelly section; and wherein the first end of the telescopic shaft means is connected to the drive shaft of the rotary drive means, wherein the telescopic shaft means is also for permitting the simultaneously extension and retraction of the telescopic shaft means as the inner kelly section extends from and retracts into the central longitudinal cavity of the outer kelly section in response to movement of the sled relative to the mast, and wherein the second end of the telescopic shaft means is for attaching an excavation tool, whereby, when the sled driving means is activated in a first direction the sled is driven towards the mast second end and the inner kelly section is extended out of the central longitudinal cavity of the outer kelly section, and whereby, when the sled driving means is activated in a second direction that is the opposite of the first direction the sled is driven towards the mast first end and the inner kelly section is retracted back into the central longitudinal cavity of the outer kelly section.

23. An excavation apparatus comprising:

a mast having a mast first end and a mast second end, a mast planar surface, and an annular cross section having a straight longitudinal axis and a central longitudinal cavity;

a sled slidably mounted on the mast planar surface;

sled driving means supported by the mast for driving the sled along the mast planar surface from proximate the mast first end to proximate the mast second end, and for driving the sled back along the mast planar surface from proximate the mast second end to proximate the mast first end, and wherein the sled driving means further comprises a rotary motor mounted on the mast proximate the mast first end for driving a flexible connection system attached to the sled, the flexible connection system spanning approximately between the mast first end and the mast second end;

an outer kelly section attached to the sled, the outer kelly section having a first end and a second end such that the outer kelly section first end is nearer to mast first end than is the outer kelly section second end, the outer kelly section also having a straight longitudinal axis and a central longitudinal cavity, and wherein the mast straight longitudinal axis of the outer kelly section is approximately parallel to the straight longitudinal axis of the mast;

outer kelly section bushing means secured to the mast proximate the mast second end for maintaining the outer kelly section in a slidable relationship relative to the outer kelly section bushing means, and for maintaining the longitudinal axis of the outer kelly section approximately parallel to the mast planar surface;

an inner kelly section having a first end and a second end such that the inner kelly section first end is nearer to outer kelly section first end than is the inner kelly section second end, the inner kelly section having a straight longitudinal axis and a central longitudinal cavity, and at least a longitudinal portion of the inner kelly section including the first end thereof are acceptable into the central longitudinal cavity of the outer kelly section;

extension and retraction means for extending and retracting the inner kelly section partially out of and partially back into the outer kelly section a proportional distance equal to at least about twice a distance that the sled is moved along the mast planar surface, and for preventing slippage of the inner kelly section relative to the outer kelly section, wherein the extension and retraction means has a downcrowd cable having a first end and a second end, a downcrowd sheave rotatably supported by the outer kelly section proximate the second end thereof, an upcrowd cable having a first end and a second end, an an upcrowd sheave rotatably supported by the outer kelly section proximate the first end thereof, wherein the first end of the downcrowd cable is tied down to the mast proximate first end thereof, the second end of the downcrowd cable is tied down to the inner kelly section proximate the first end thereof, the downcrowd cable is tautly drawn over the downcrowd sheave, and wherein the first end of the upcrowd cable is tied down proximate to the mast or a member attached thereto proximate longitudinally the mast second end, the second end of the downcrowd cable is tied down to the inner kelly section proximate the first end thereof, and the upcrowd cable is tautly drawn over the upcrowd sheave;

rotary drive means attached to the sled and having a drive shaft having an axis, the rotary drive means connection to and rotates a telescopic shaft means, the telescopic shaft means for providing a variable length, the telescopic shaft means having a first end connected to the drive shaft of the rotary drive means, and a second end for attaching an excavation tool, wherein the first end of the telescopic shaft means is connected to the drive shaft of the rotary drive means, wherein the telescopic shaft means is also for permitting the simultaneously extension and retraction of the telescopic shaft means as the inner kelly section extends from and retracts into the central longitudinal cavity of the outer kelly section in response to movement of the sled relative to the mast, and wherein the second end of the telescopic shaft means is for attaching an excavation tool, whereby, when the sled driving means is activated in a first direction the sled is driven towards the mast second end and the inner kelly section is extended out of the central longitudinal cavity of the outer kelly section, and whereby, when the sled driving means is activated in a second direction that is the opposite of the first direction the sled is driven towards the mast first end and the inner kelly section is retracted back into the central longitudinal cavity of the outer kelly section.

* * * * *